US006081935A

United States Patent [19]

Kishi et al.

[11] Patent Number: 6,081,935

[45] Date of Patent: Jul. 4, 2000

[54] TECHNOLOGICALLY ADVANCED PORTABLE TOILET AND METHOD OF SUPPLYING PURIFYING AGENT THERETO

[75] Inventors: Tomomi Kishi; Hisashi Nakano; Katuyoshi Kodera, all of Aichi-ken, Japan

[73] Assignees: Toyota Jidosha Kabushiki Kaisha, Toyota; Kabushiki Kaisha Coderadynax, Nagoya, both of Japan

[21] Appl. No.: 09/251,458

[22] Filed: Feb. 17, 1999

[30] Foreign Application Priority Data

Feb. 27, 1998 [JP] Japan ..... 10-047519

[51] Int. Cl.[7] ..... E03D 9/02

[52] U.S. Cl. ..... 4/222; 4/300; 4/317; 4/213; 4/321; 4/78; 4/228.1

[58] Field of Search ..... 4/222, 223, 224, 4/459, 471, 228.1, 434, 441, 442, 321, 323, 300, 662, 317

[56] References Cited

U.S. PATENT DOCUMENTS

| | | | |
|---|---|---|---|
| 3,566,417 | 3/1971 | Gross | 4/317 |
| 3,585,649 | 6/1971 | Miya | 4/300 |
| 3,609,772 | 10/1971 | Howard | 4/321 |
| 3,772,711 | 11/1973 | Spector | 4/78 |
| 3,939,501 | 2/1976 | Sargent | 4/78 |
| 4,751,753 | 6/1988 | Sargent et al. | 4/321 |
| 5,305,472 | 4/1994 | Eger | 4/213 |
| 5,566,401 | 10/1996 | Kishi et al. | 4/300 |
| 5,745,927 | 5/1998 | Hoareau | 4/213 |

FOREIGN PATENT DOCUMENTS

| | | | |
|---|---|---|---|
| 916351 | 5/1999 | European Pat. Off. . | |
| 401235738 | 9/1989 | Japan | 4/228.1 |
| 7-23704 | 5/1995 | Japan . | |

OTHER PUBLICATIONS

Thetford Corporation, "Thetford Cassette Porta Potti", Feb. 22, 1989.

Automatic Public Toilet Article, all pages, Jun. 16, 1988.

*Primary Examiner*—Henry J. Recla
*Assistant Examiner*—Khoa Huynh
*Attorney, Agent, or Firm*—Oblon, Spivak, McClelland, Maier & Neustadt, P.C.

[57] ABSTRACT

A technologically advanced portable toilet has a purifying agent producing/supplying device built into a periphery of a toilet bowl. Due to an ozone producing mechanism, a tank assembly, and a bubble generating tank, which are provided by this purifying agent producing/supplying device, when an upper cover of the toilet is opened, a purifying agent that is an aggregate of ozone-containing bubbles is supplied to an inside of the toilet bowl. As a result, a superior odor-extinguishing effect can be obtained.

19 Claims, 37 Drawing Sheets

TECHNOLOGICALLY ADVANCED PORTABLE TOILET AND METHOD OF SUPPLYING PURIFYING AGENT THERETO

BACKGROUND OF THE INVENTION

1. Field of the Invention

The present invention relates to a technologically advanced portable toilet and a method of supplying a purifying agent thereto.

2. Description of the Related Art

Water-washable portable toilets for various utilization purposes have been marketed from the past. Below, an example of this kind of conventional water-washable portable toilet will be explained.

Water-washable portable toilets provide a main toilet body portion comprising a waste tank disposed at the lower portion side, and a fresh water tank disposed at the upper portion side and connected to the waste tank. A toilet seat and a toilet seat cover thereon are provided on the upper surface of the fresh water tank. A bellows-type pump is disposed at the fresh water tank, and by pushing this pump by hand, a predetermined amount of water comes to be stored in a bowl inside the waste tank. After the toilet is used and a valve is pulled, wastes disposed inside the bowl flows into the waste tank.

However, this water-washable portable toilet is merely portable, and is a structure that in the end may be said to be insufficient with regard to contrivances to extinguish odors.

SUMMARY OF THE INVENTION

An object of the present invention is to consider the above-described circumstances and provide a technologically advanced portable toilet with which a superior odor-extinguishing effect can be obtained, as well as a method of supplying a purifying agent thereto.

In accordance with a first aspect of the present invention, a technologically advanced portable toilet is provided comprising: a toilet bowl in the form of a bowl, disposed inside a container body and having a lower end portion formed as an aperture; a toilet seat disposed at an upper end side of the toilet bowl inside the container body; a toilet seat cover provided at the container body, the toilet seat cover being either rotatable or attachable/detachable and able to close or open the toilet seat by rotation or attachment/detachment; a waste storage tank disposed at a lower side of the toilet bowl inside the container body, the waste storage tank communicating with said toilet bowl; and a purifying agent producing/supplying means provided inside the container body, the means producing a purifying agent formed as an aggregate of bubbles having an odor-extinguishing effect and supplying the purifying agent to at least one of an inside of the toilet bowl and an inside of the waste storage tank Namely, after a user opens the toilet seat cover, he or she sits on the toilet seat and relieves him or herself. The wastes eliminated by the user are stored inside the waste storage tank, which is disposed at the lower side of the toilet bowl and which communicates with the toilet bowl.

At this time, since in the present invention the purifying agent formed as the aggregate of bubbles having an odor-extinguishing effect is produced, and the purifying agent producing/supplying means which supplies the purifying agent to at least one of the inside of the toilet bowl and the inside of the waste storage tank is provided, the wastes eliminated by the user is covered by the purifying agent formed as the aggregate of bubbles having an odor-extinguishing effect. As a result, the path of diffusion of odors from the wastes is intercepted and odors are extinguished.

In accordance with a second aspect of the present invention, the bubbles are ozone-containing bubbles comprising: an ozone-containing film wherein ozone is dissolved inside the film; and an ozone-containing gas enclosed inside this ozone-containing film.

Namely, since the bubbles are ozone-containing bubbles comprising the ozone-containing film in which ozone is dissolved in the film and an ozone-containing gas enclosed inside this ozone-containing film, the path of diffusion of the odors from the wastes is intercepted when the wastes are covered by the ozone-containing bubbles. Further, because the individual ozone-containing bubbles defoam, the ozone-containing film of the ozone-containing bubbles become ozone water having an odor-extinguishing and germ-killing action, adhering to and seeping into the wastes. As a result, with respect to the wastes, odors are extinguished and germs are killed. Still further, because the individual ozone-containing bubbles defoam, the ozone-containing gas enclosed in the ozone-containing film is released, diffusing into at least one of the inside of the toilet bowl and the inside of the waste storage tank. As a result, odors already emitted by the wastes are also extinguished with the ozone-containing gas.

In accordance with a third aspect of the present invention, the purifying agent producing/supplying means is formed so as to comprise purifying agent producing/supplying means is formed so as to comprise: a tank assembly that mixes fixed amounts of each of a plurality of types of liquids necessary for producing the bubbles by utilizing free fall descent which depends upon self-weight of each liquid; and a compressed air supplying portion for supplying compressed air to this tank assembly.

Thus, it is possible to carry out mixing of fixed amounts of the plurality of types of liquids effectively. As a result, it is possible to prevent irregularities in the quality of the purifying agent from occurring.

In accordance with a fourth aspect of the present invention, the compressed air supplying portion comprises an air tank; and a compressor that is float-supported inside said air tank, by being elastically supported inside said air tank.

Thus, since the compressed air supplying portion comprises an air tank, and a compressor that is float-supported inside the air tank by being elastically supported inside the air tank, it is possible to carry out sound insulation of operating noise of the compressor with the air tank. Further, since the compressor is elastically supported inside the air tank, the compressor is float-supported inside the air tank, and it is possible to prevent operating noise of the compressor from being directly transmitted to walls of the air tank.

In accordance with a fifth aspect of the present invention, a shutter means is further comprised which includes: a shutter provided so as to be movable with respect to a closed position wherein a communicating passage of said toilet bowl and the waste storage tank is obstructed, and to an open position wherein the communicating passage is not obstructed; and a shutter driving portion that moves said shutter such that the shutter is moved to the closed position or the open position, the purifying agent being supplied to the inside of the toilet bowl.

Namely, since the shutter means is provided in addition to the above-described structural elements, before waste excretion the shutter may be positioned in the closed position by the shutter driving portion, and after waste excretion the shutter may be positioned in the open position by the shutter driving portion. When the shutter is in the closed position, the communicating passage of the toilet bowl and the waste storage tank is obstructed, and so it is possible to prevent the purifying agent supplied to the inside of the toilet bowl from leaking into the inside of the waste storage tank. As a result, since the wastes accumulate inside the accumulated purifying agent without leaking onto the shutter, odor extinguishing and germ killing can be carried out sufficiently and reliably.

In accordance with a sixth aspect of the present invention, smoothing tools for evening wastes stored inside the waste storage tank are provided at the shutter.

Namely, since smoothing tools for evening wastes stored inside the waste storage tank is provided at the shutter, when for example a detection means of a level indicator or the like is disposed at the waste storage tank, discrepancies between the detected volume and the actual volume of wastes no longer occur. As a result, it is possible to improve reliability with respect to storing wastes in the waste storage tank.

In accordance with a seventh aspect of the present invention, a cleaning means for cleaning said waste storage tank is further comprised, the shutter being disposed in the vicinity of a waste receiving opening provided at an upper portion of the waste storage tank, such that the cleaning means, when mounted at the waste receiving opening, forms a water chamber between itself and the shutter, and an opening is formed due to the shutter being elastically displaced (being displaced while being elastically deformed) as the water pressure inside the water chamber rises, jetting wash water from the opening in the peripheral direction of the shutter.

Namely, due to the fact that the shutter is disposed in the vicinity of the waste receiving opening provided at the upper portion of the waste storage tank and the cleaning means is mounted at the waste receiving opening, the water chamber is formed between the shutter and the cleaning means. When water is supplied to the inside of the water chamber by the cleaning means, the water chamber becomes full, and if water continues to be supplied the water pressure inside the water chamber rises, causing the shutter to be elastically displaced (to be displaced while being elastically deformed). As a result, an opening is formed and wash water is jetted from the opening, in the peripheral direction of the shutter. Therefore, it is not necessary to carry out operations wherein wash water is added inside the waste storage tank after the wastes are dumped out and the waste storage tank is shaken by hand or the like.

In accordance with an eighth aspect of the present invention, the waste storage tank is of a cassette-style that is attachable/detachable with respect to the container body, the container body providing a lid panel that is opened and closed during attachment/detachment of the waste storage tank, further providing connecting means which, when the lid panel is closed, interlocks with the closing operation to connect a lower end portion of the toilet bowl with the waste storage tank, and which, when the lid panel is open, interlocks with the opening operation to separate the lower end portion of the toilet bowl from the waste storage tank.

Namely, the waste storage tank is of a cassette-style that is attachable/detachable with respect to the container body. When the lid panel provided at the container body is closed, interlocking with this closing operation the lower end portion of the toilet bowl and the waste storage tank are connected by the connecting means. On the other hand, when the lid panel is opened, interlocking with this opening operation the lower end portion of the toilet bowl and the waste storage tank are detached by the connecting means, and it becomes possible to remove the waste storage tank from the container body.

In this way, a structure is proposed in the present invention wherein the waste storage tank is of the cassette style and the lower end portion of the toilet bowl and the waste storage tank are attached or detached by the connecting means, interlocking with opening/closing operations of the lid panel, the amount of labor is greatly reduced. As a result, the attachment/detachment operation property of the lower end portion of the toilet bowl and the waste storage tank can be greatly improved.

In accordance with a ninth aspect of the present embodiment, the toilet seat is formed of an elastic material, is formed as a ring-shaped seat that follows a circumferential direction without interruption at an upper end portion of the toilet bowl, and is made to closely contact a reverse surface of the toilet seat cover along the entire circumference of the toilet seat when the toilet seat cover is closed, due to an elastic restoring force.

Since the toilet seat is formed of an elastic material, is formed as a ring-shaped seat that follows the circumferential direction without interruption at the upper end portion of the toilet bowl, and is made to closely contact the reverse surface of the toilet seat cover as a whole when the toilet seat cover is closed, due to the elastic restoring force, the odors from inside the toilet bowl can be prevented from leaking outside. As a result, it is possible to improve the quality of sanitation of the technologically advanced portable toilet.

In accordance with a tenth aspect of the present invention, a method of supplying a purifying agent producing/supplying means to a technologically advanced portable toilet is provided that is applicable with respect to the technologically advanced portable toilet structured so as to comprise a toilet bowl in the form of a bowl, disposed inside a container body and having a lower end portion formed as an aperture, a toilet seat disposed at an upper end side of the toilet bowl inside the container body, a toilet seat cover provided at the container body, the toilet seat cover being either rotatable or attachable/detachable and able to close or open the toilet seat by rotation or attachment/detachment, and a purifying agent producing/supplying means provided at a container body, said means producing a purifying agent formed as an aggregate of bubbles having an odor-extinguishing effect and supplying the purifying agent to at least one of the inside of the toilet bowl and the inside of the waste storage tank. According to this method, the purifying agent producing/supplying means is operated due to the toilet seat cover being opened, supplying the purifying agent to at least one of the inside of the toilet bowl and the inside of the waste storage tank for a prescribed amount of time.

Namely, in accordance with this aspect, by the toilet seat cover being opened, the purifying agent producing/supplying means operates, and the purifying agent formed as an aggregate of bubbles having an odor-extinguishing effect is supplied for a prescribed amount of time to at least one of the inside of the toilet bowl and the inside of the waste storage tank. As a result, at a stage before the user carries out waste excretion, odor-extinguishing preparations depending upon the purifying agent can be carried out.

DESCRIPTION OF THE PREFERRED EMBODIMENT

Figure 1:
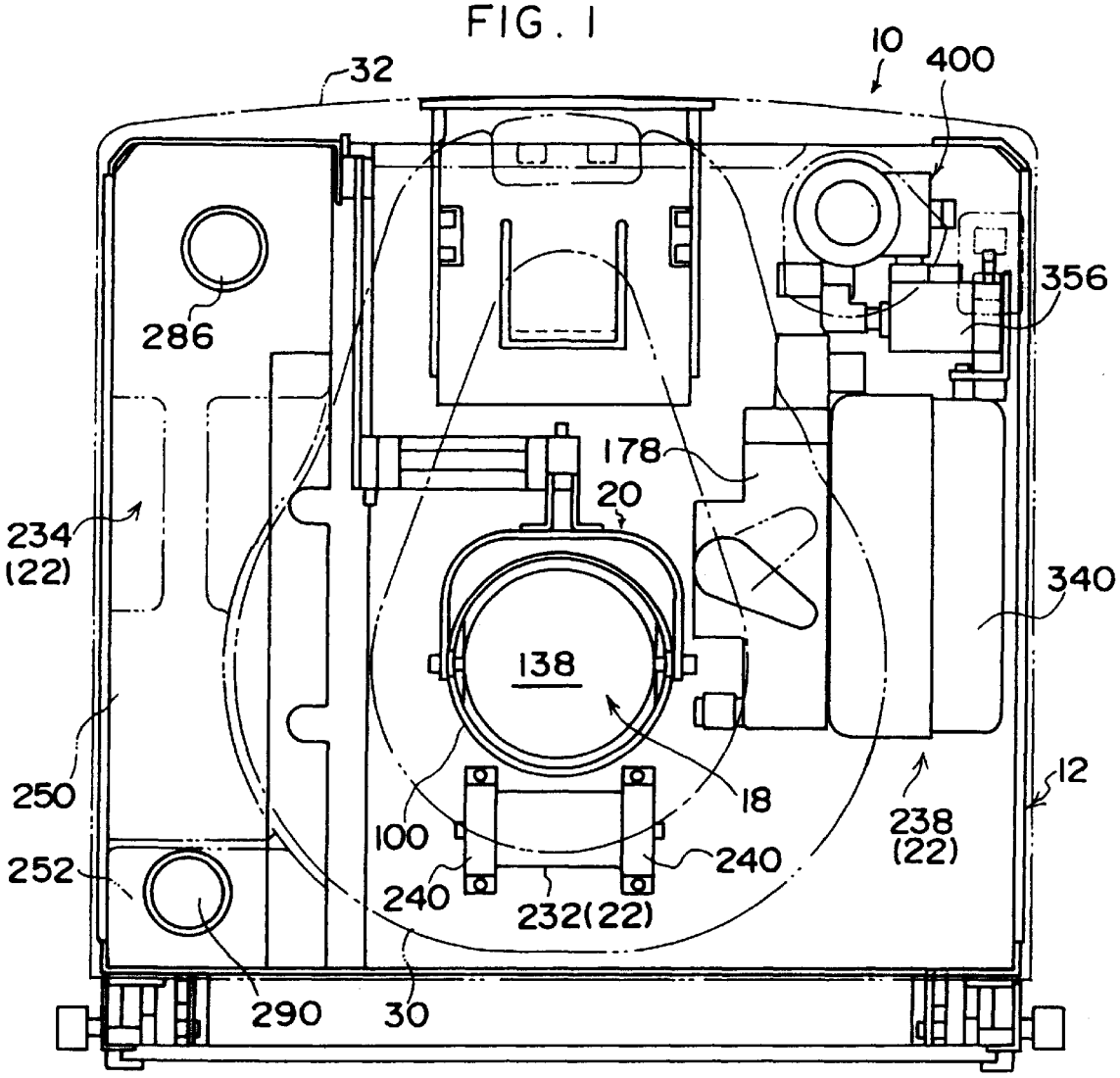
FIG. 1 is a plan view of a schematic structure of main portions of a technologically advanced portable toilet in accordance with a preferred embodiment of the present invention.

A description of a preferred embodiment of the technologically advanced portable toilet of the present invention will be given later while referring to FIGS. 1 to 37. Incidentally, in these figures, cross-hatching is omitted to a suitable degree in cases in which addition of cross-hatching would make the figures difficult to understand.

Schematic Structure of Main Portions of Technologically Advanced Portable Toilet 10

Firstly, a general explanation will be given of main portions of a schematic structure of a technologically advanced portable toilet 10 (lightweight toilet) in accordance with the present embodiment, while referring to FIGS. 1 to 4.

As indicated in these Figures, the technologically advanced portable toilet 10 in accordance with the present embodiment is structured so as to have the following as main portions: an outer structure portion, which has as a main portion a container body 12; a toilet bowl 14 disposed inside the container body 12; a cassette 16 for storing waste disposed at the lower part of the toilet bowl 14; a shutter means 18 which opens and shuts a waste receiving opening 138 (which will be described later) and which is disposed at the upper portion side of this cassette 16; a connecting means 20 which connects the lower end portion of the toilet bowl 14 and the cassette 16 such that the toilet bowl 14 and the cassette 16 can be separated; and a purifying agent producing/supplying means 22 which produces and supplies to the inside of the toilet bowl 14 a purifying agent 338 (refer to FIG. 30), which is an aggregate of bubbles containing ozone and which will be described later.

Figure 2:
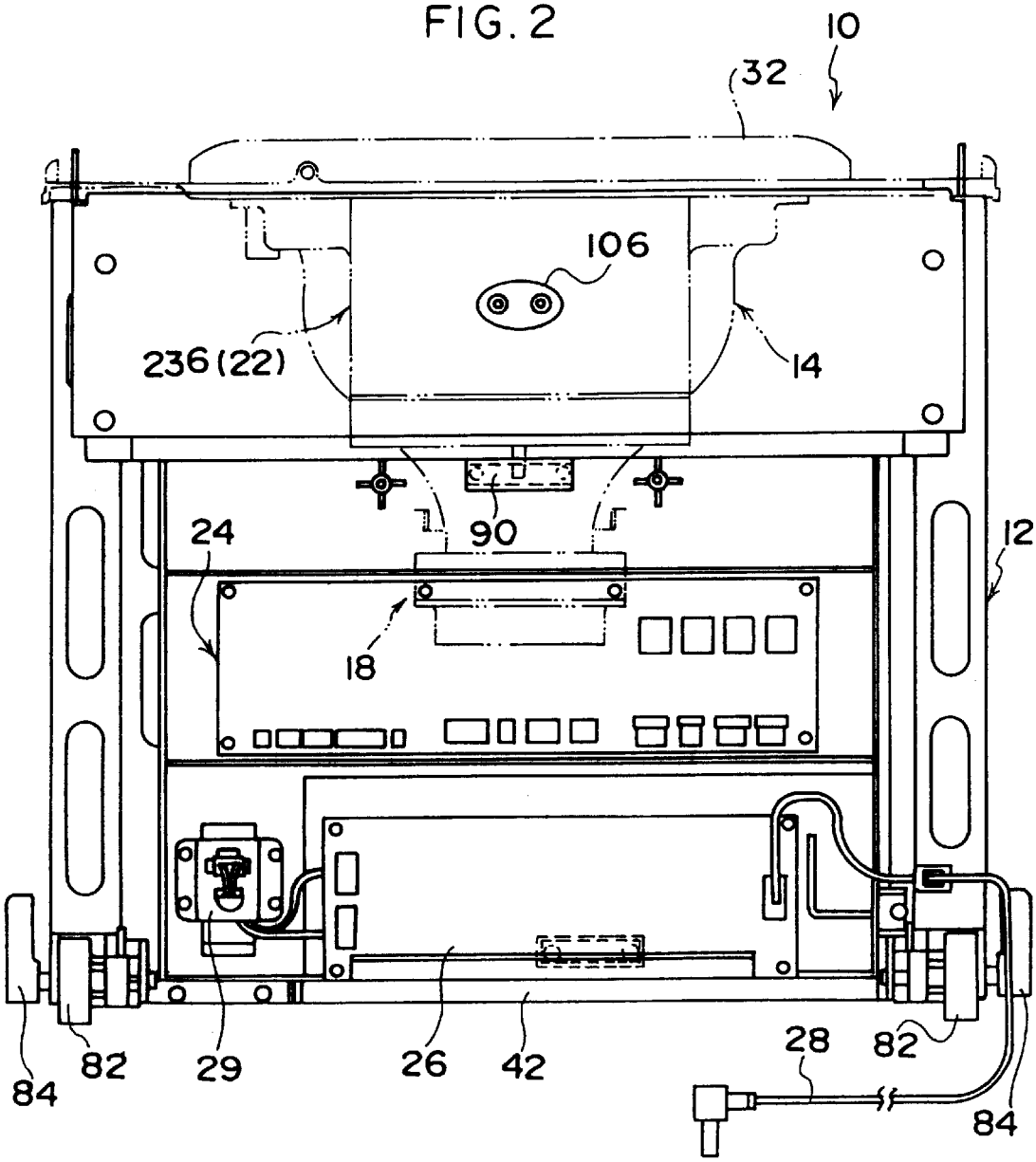
FIG. 2 is a rear view of the schematic structure of main portions of the technologically advanced portable toilet illustrated in FIG. 1.

A general explanation of principal auxiliary equipment will be given hereinafter. As indicated in FIG. 2, a controller 24 (broadly speaking, this controller may be understood to be a controlling means) is disposed at an intermediate portion of the rear surface side of the container body 12, in order to control the operation of the shutter means 18 and the purifying agent producing/supplying means 22 and the like. An AC power supply 26 is disposed at a lower portion of the rear surface side of the container body 12, and an AC power cable 28 attached to the AC power supply 26 is extended outside the container body 12. Further, a DC power supply connector (illustrated in FIG. 7) is disposed at a position adjacent to the AC power supply 26 in the container body 12.

Further, in the present embodiment, the structure is such that the AC power supply is disposed at a lower level of the rear side of the container body 12, i.e., the AC power supply 26 is stored inside the container body 12. However, possible structures are not limited to this and a structure wherein the AC power supply 26 is externally attached is also possible.

Next, a detailed structure of each of the above-mentioned main portions will be explained.

Outer Structure Portion of Technologically Advanced Portable Toilet 10

As is illustrated in FIGS. 5 to 8, FIGS. 9 to 11, and FIGS. 12 to 14 (each aforementioned group of Figures illustrating views of three sides), main portions of the exterior of the technologically advanced portable toilet 10 in accordance with the present embodiment include the following: the box-shaped container body 12 wherein a toilet seat 30 is provided; and an upper cover 32 which is a toilet seat cover that opens and shuts the toilet seat 30 of the container body 12. Below, the container body 12, the upper cover 32, and the toilet seat 30 will be explained in that order.

Container Body

Figure 11:
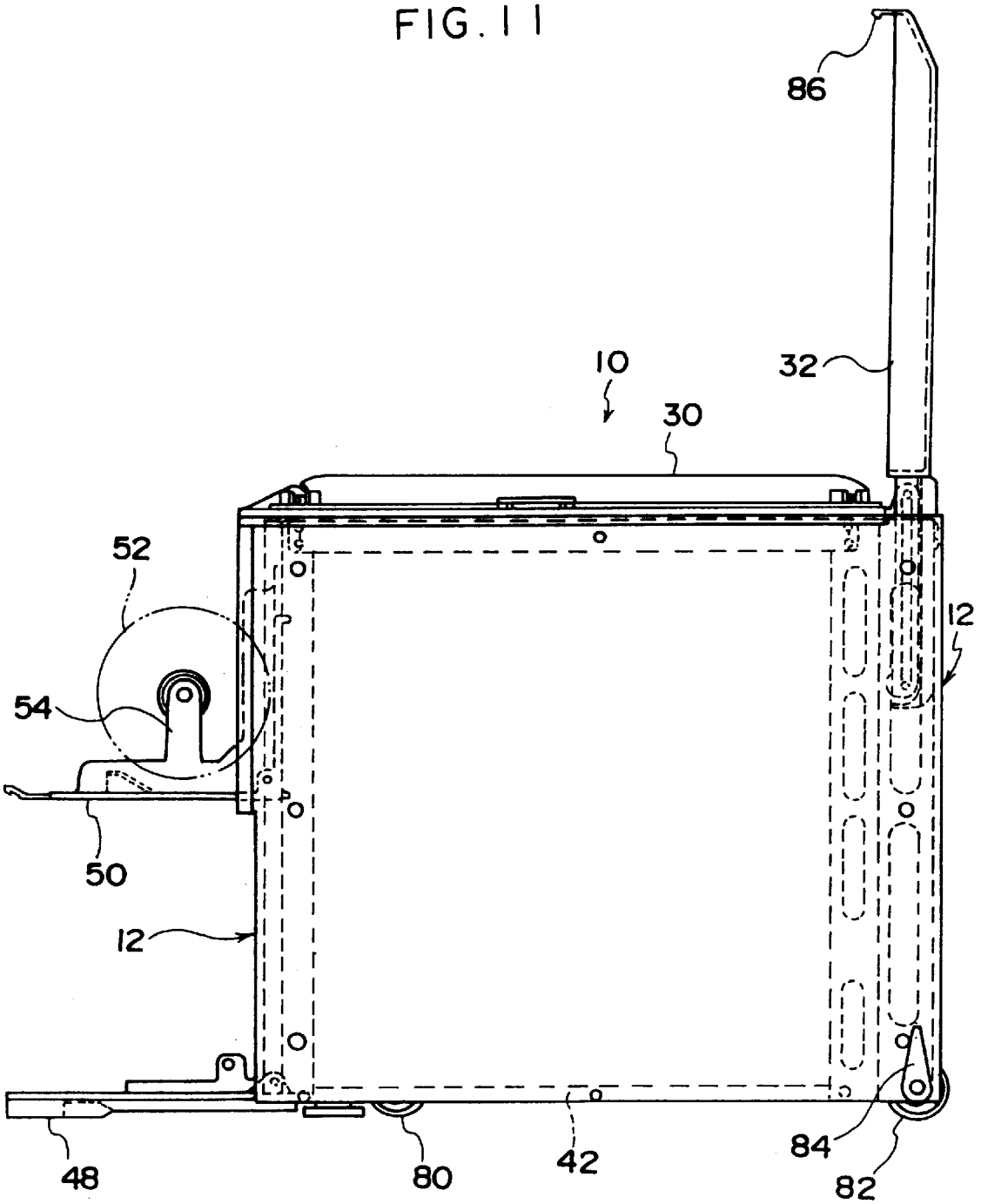
FIG. 11 is a left side view of the outer structure portion of the technologically advanced portable toilet illustrated in FIG. 9.

Schematically speaking, the container body 12 is a box-shaped structure including a front wall portion 34 which forms the front side (refer to FIG. 6), a rear wall portion 36 which forms the rear side (refer to FIG. 7), a pair of side wall portions 38 which forms the two sides (refer to FIG. 8), a top wall portion 40 which forms the top side (refer to FIG. 9) and a bottom wall portion 42 which forms the bottom side (refer to FIG. 11).

The structure of the front wall portion 34 includes the following: a pair of side panels 44 that are longer in the direction of the height of the apparatus, disposed such that a side panel 44 is disposed at each side of the apparatus; a pair of rectangular front panels 46 wherein a front panel 46 is disposed at an upper portion of the side nearer to the center of each of the side panels 44; a rectangular-shaped paper lid panel 50 disposed so as to be interposed between these front panels 46; a rectangular cassette lid panel 48 disposed at a position that is at the lower side of the front panels 46 and the paper lid panel 50, the rectangular cassette lid panel 48 being longer in the transverse direction of the apparatus.

Further, the paper lid panel 50 and the cassette lid panel 48 are each formed such that opening and closing is possible, with the lower edge side as a rotational axis. At the back side of the paper lid panel 50, a paper holder 54 is integrally formed in order to hold a toilet paper 52 (refer to FIG. 11).

The rear wall portion 36 includes: a rectangular rear inner panel 56 disposed at the upper portion side; and a rectangular rear outer panel 58 disposed at the lower side of this rear inner panel 56.

Figure 9:
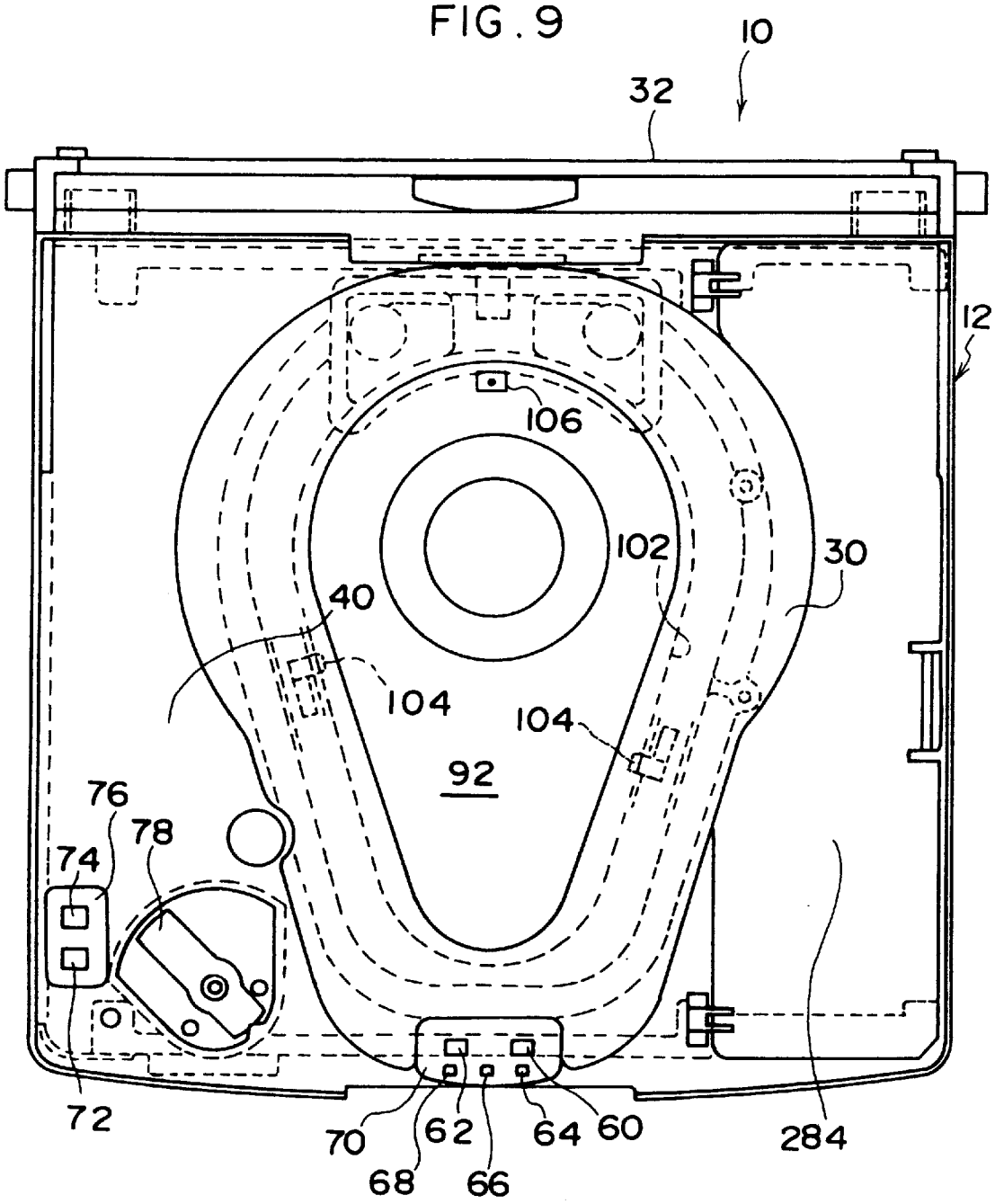
FIG. 9 is a plan view illustrating the outer structure portion of the technologically advanced portable toilet in accordance with the preferred embodiment wherein the upper cover is in an open position.
Figure 10:
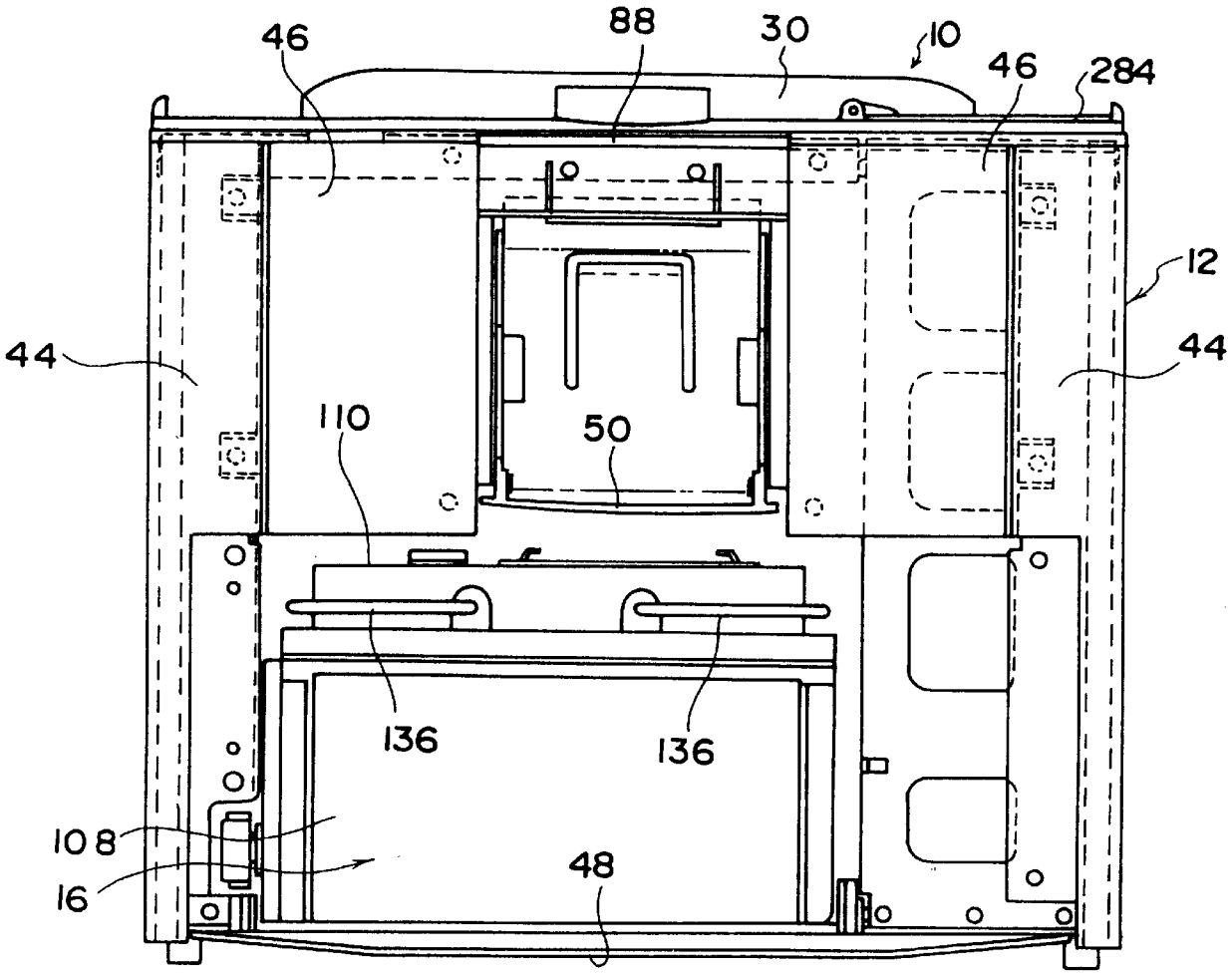
FIG. 10 is a front view illustrating the outer structure portion of the technologically advanced portable toilet illustrated in FIG. 9.

At an intermediate portion of the front end of the top wall portion 40, there is disposed an operating panel 70 which provides a cleaning switch 60, a washer switch 62, a no-liquid lamp 64, a cassette full water level lamp 66, and a heater lamp 68 (refer to FIG. 9). Another operating panel 76, which provides a power switch 72 and a heater switch 74, is disposed at a front corner portion of the top wall portion 40. Further, a manual pump level 78 is disposed in the vicinity of the operating panel 76.

Front casters 80 and rear casters 82 are disposed in the vicinity of the four corners of the bottom wall portion 42, and further, a caster lock lever 84 is disposed at each of the positions that correspond to the rear casters 82 provided as a pair on the side wall portions 38 (refer to FIG. 11).

Upper Cover

An upper cover 32 which opens and closes the toilet seat is disposed at the top wall portion 40 in the container body 12. This upper cover 32 is formed in a thin box-shape whose lower surface side is free, and can accommodate the toilet seat 30 when closed. A hook-shaped elastically displacable anchoring pawl 86 is integrally formed at an intermediate portion of a distal portion of the upper cover 32 (refer to FIG. 11). The upper cover 32 can be completely closed by elastically engaging the anchoring pawl 86 to the engagement portion 88, which is formed at the upper end side of the front wall portion 34 of the container body 12.

An upper cover detection sensor 90 for detecting when the upper cover 32 is open is disposed at an intermediate level of the rear surface side of the container body 12 (refer to FIG. 2).

Toilet Seat

Figure 12:
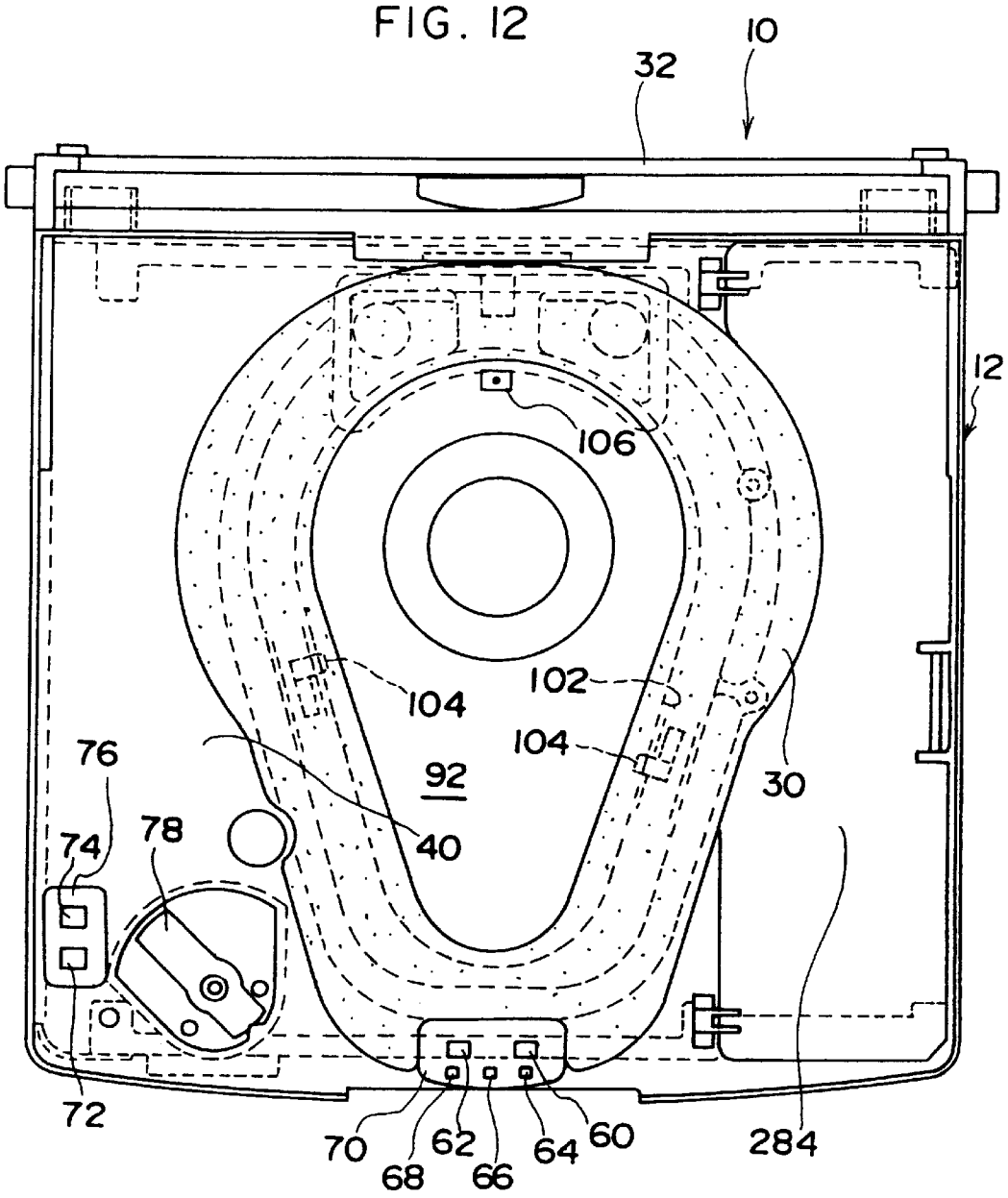
FIG. 12 is a plan view illustrating the outer structure portion of the technologically advanced portable toilet in accordance with the preferred embodiment wherein the characteristics of a toilet seat are shown.
Figure 13:
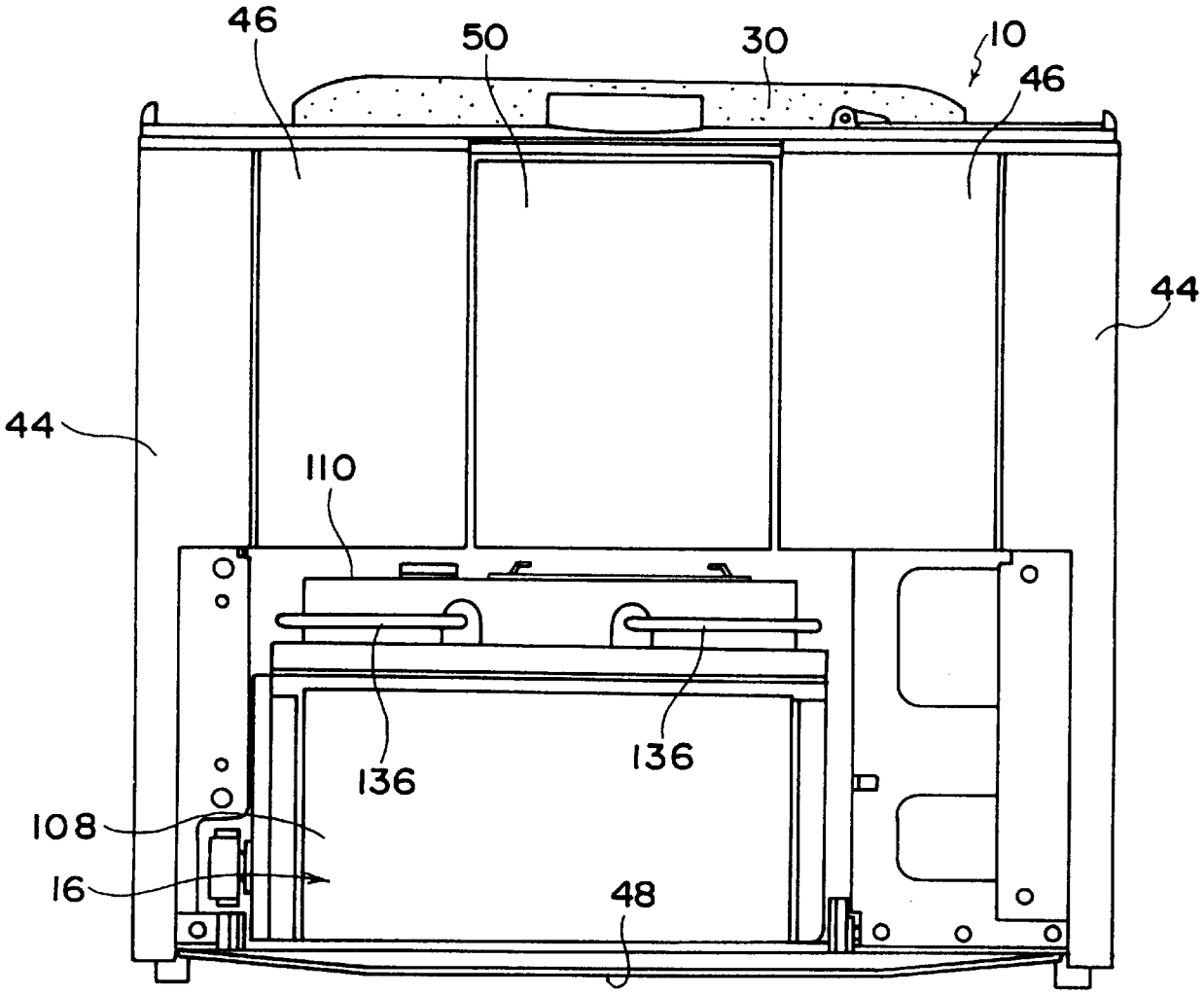
FIG. 13 is a front view illustrating, as the focus, the toilet seat, which is an element of the outer structure portion of the technologically advanced portable toilet illustrated in FIG. 12.
Figure 14:
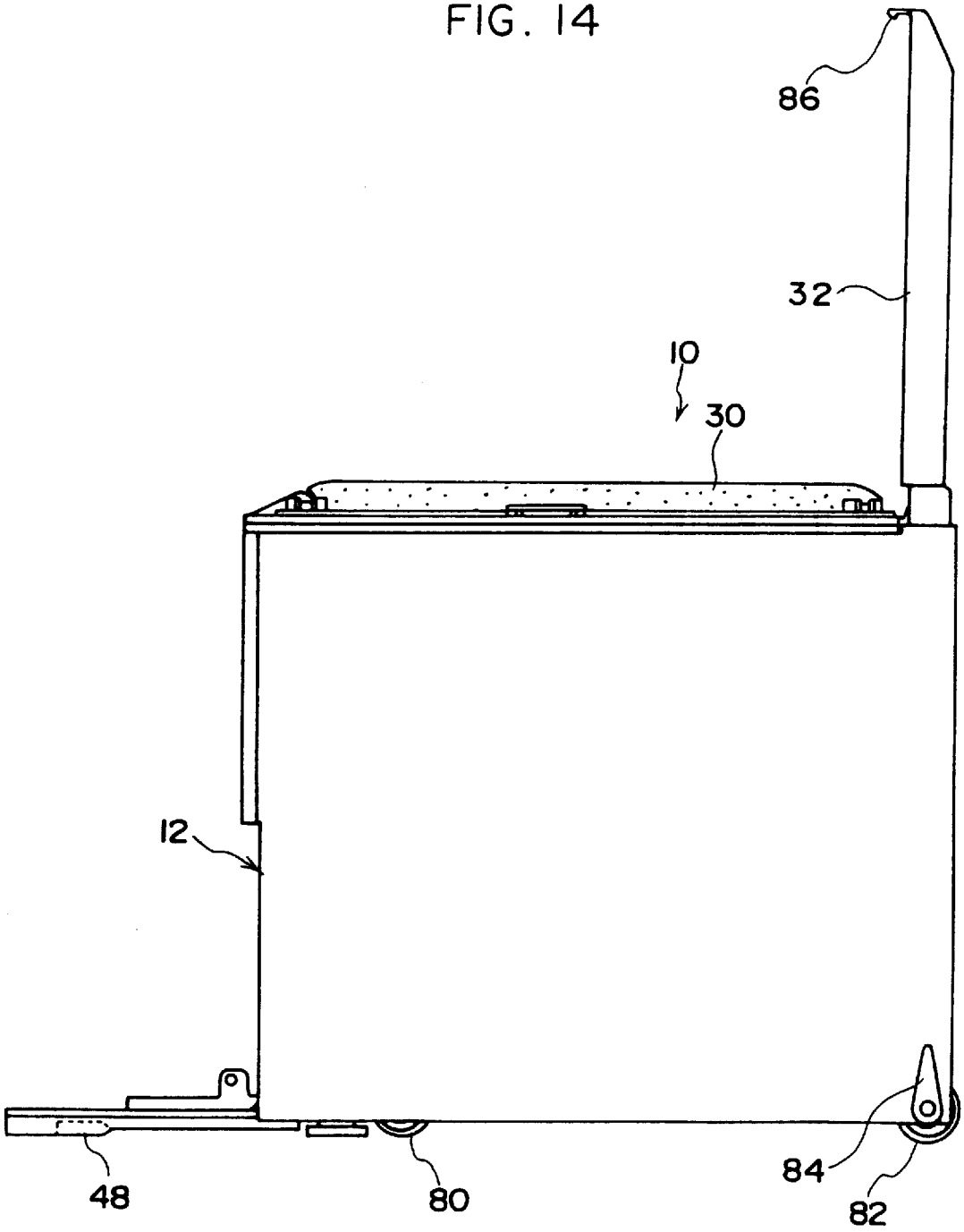
FIG. 14 is a left side view illustrating, as the focus, the toilet seat, which is an element of the outer structure portion of the technologically advanced portable toilet illustrated in FIG. 12.

As shown in FIGS. 12 to 14, an aperture portion 92 is formed at an intermediate portion of the top wall portion 40 of the container body 12. The toilet seat 30 is disposed at a position surrounding this aperture portion 92. As can be inferred from the appearance of the toilet seat 30 illustrated in these figures, the toilet seat 30 in the present embodiment is formed with a resin material in a spongy state with a cushioning property and a predetermined degree of hardness. In terms of shape, the toilet seat 30 is formed as a ring-shaped seat that follows the circumference without interruption.

The dimensions of the toilet seat 30 and the upper cover 32 are as follows. Namely, the dimensions of the toilet seat 30 and the upper cover 32 are set such that the entire circumference of the upper surface of the toilet seat 30 adheres to the back surface of the upper cover 32 due to an elastic restoration to an original state after the toilet seat 30 is slightly displaced while being slightly deformed (compressed) in an elastic manner in the thickness direction, due to the toilet seat and the upper cover being in a completely closed position after the anchoring pawl 86 of the upper cover 32 and the engagement portion 88 are engaged.

Structure of Toilet Bowl 14

Figure 4:
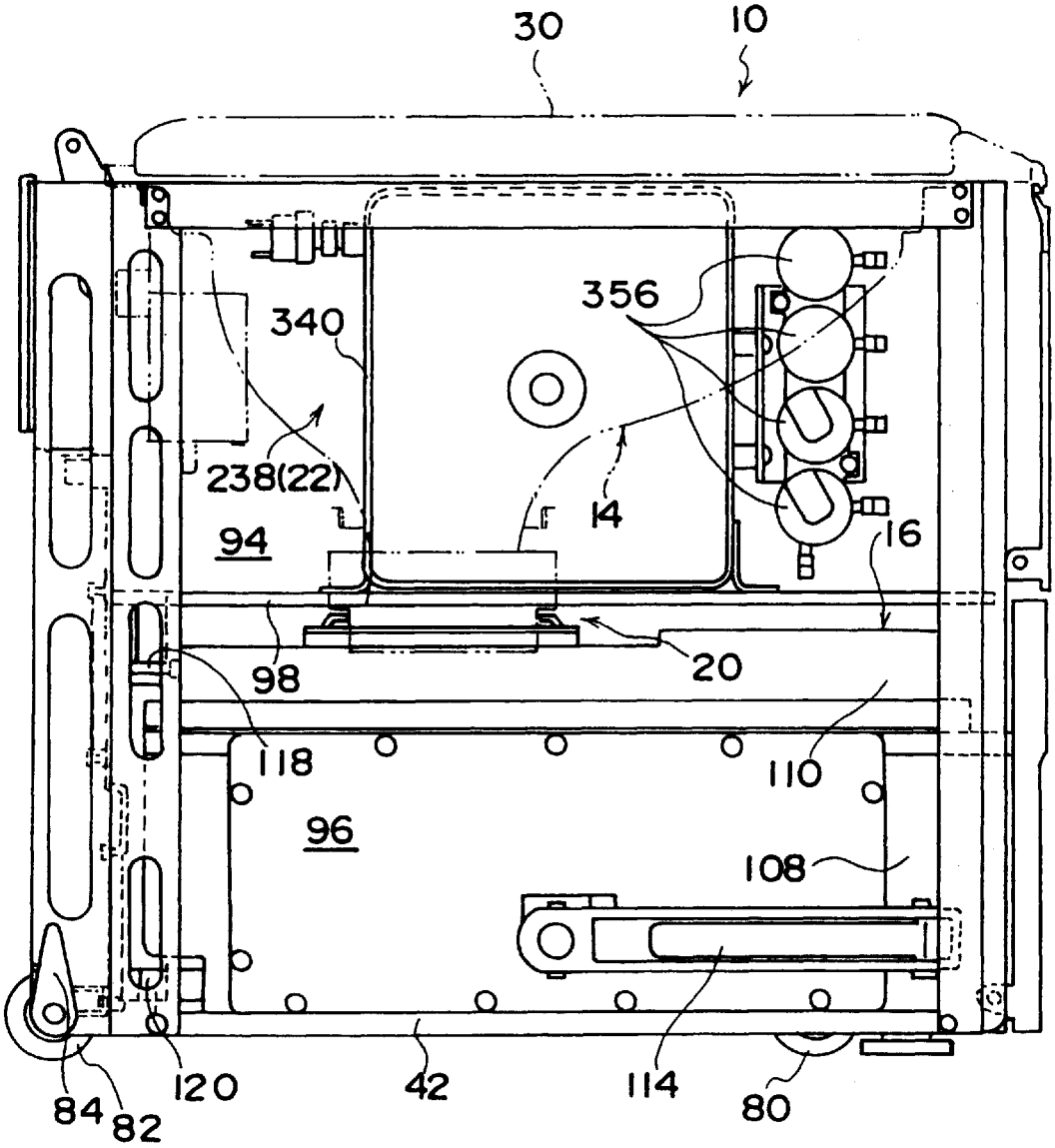
FIG. 4 is a right side view of the schematic structure of main portions of the technologically advanced portable toilet illustrated in FIG. 1.
Figure 5:
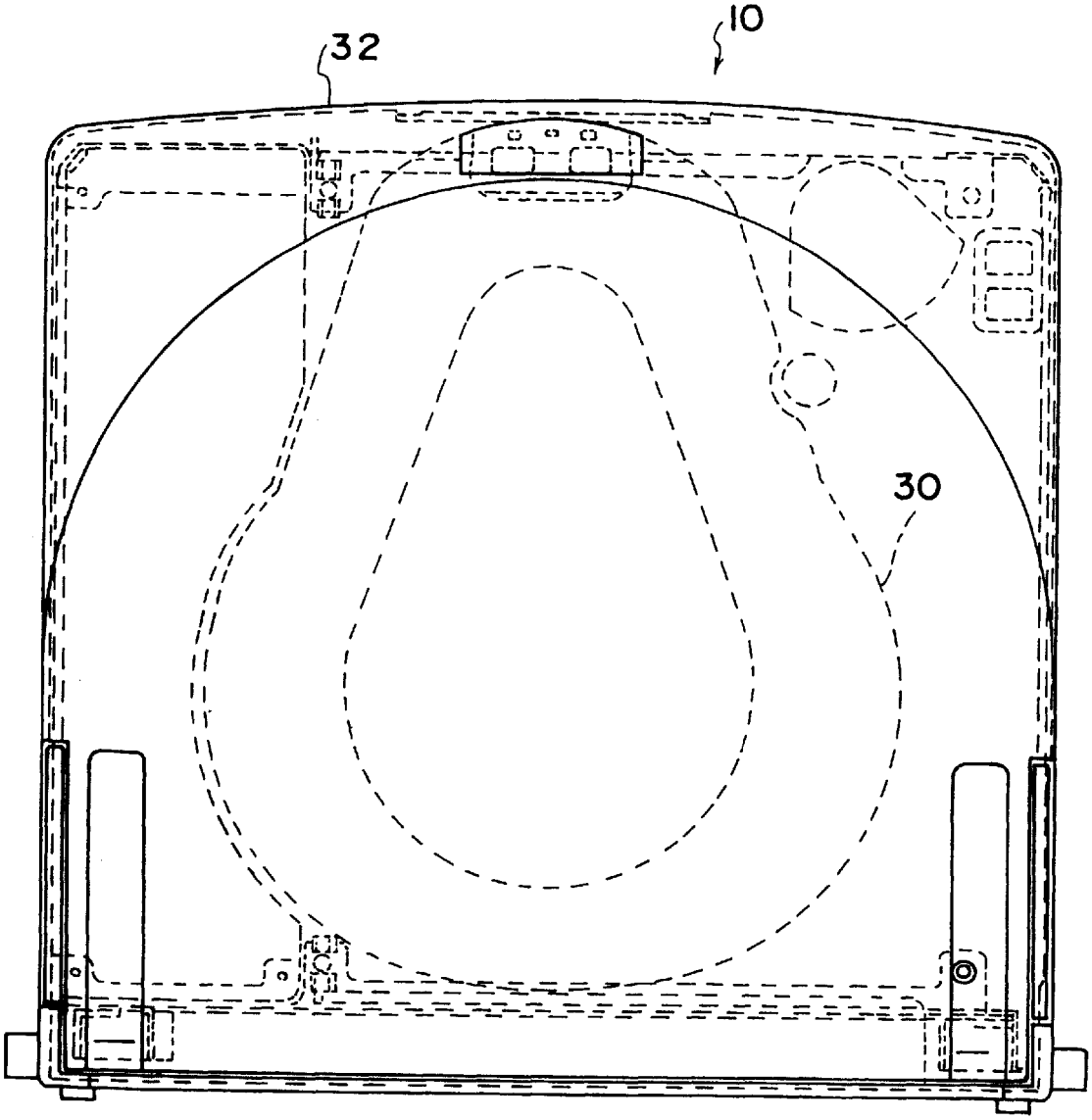
FIG. 5 is a plan view illustrating the outer structure portion of the technologically advanced portable toilet in accordance with the preferred embodiment wherein an upper cover is in a closed position.
Figure 6:
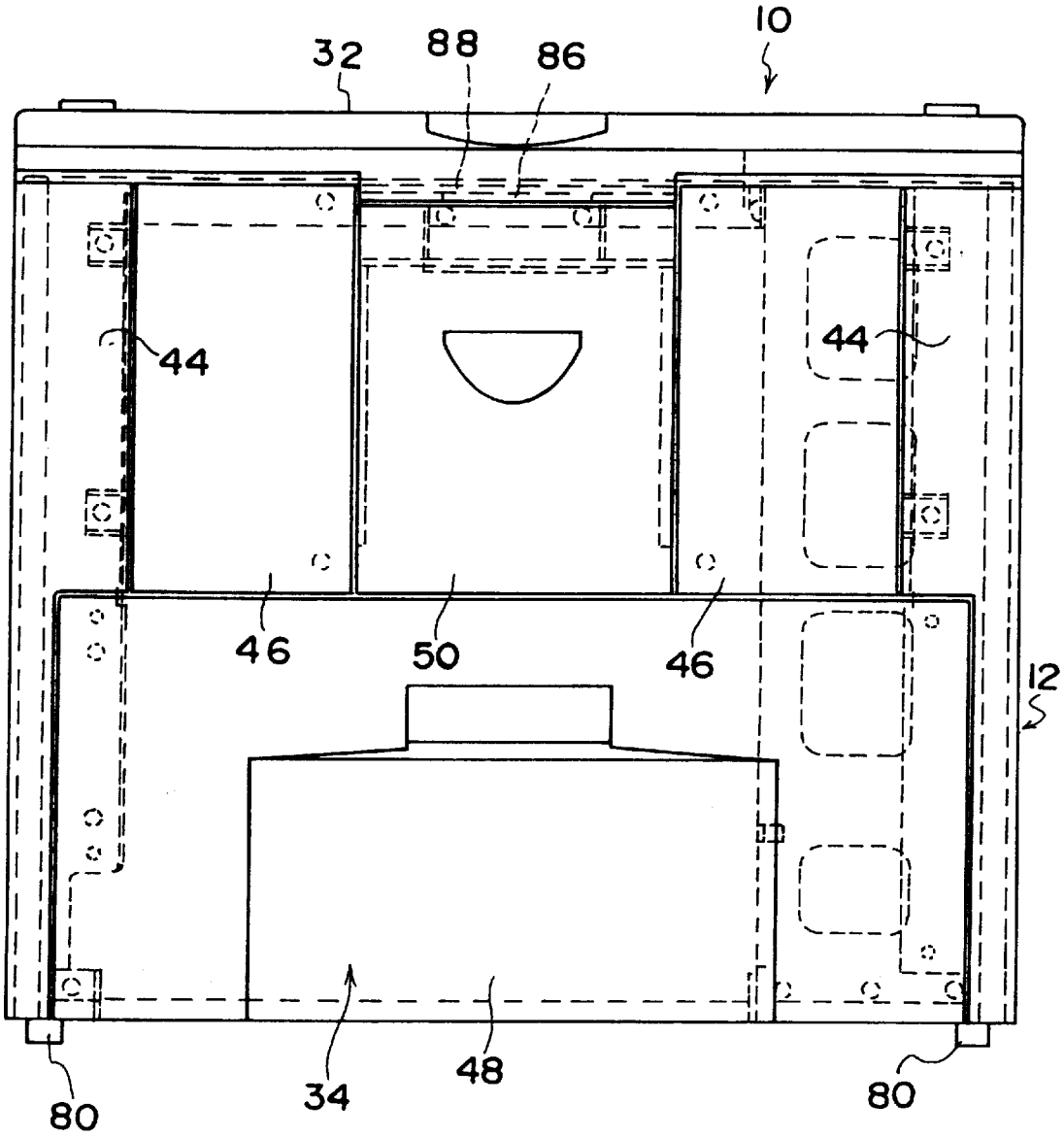
FIG. 6 is a front view illustrating the outer structure portion of the technologically advanced portable toilet illustrated in FIG. 5.
Figure 7:
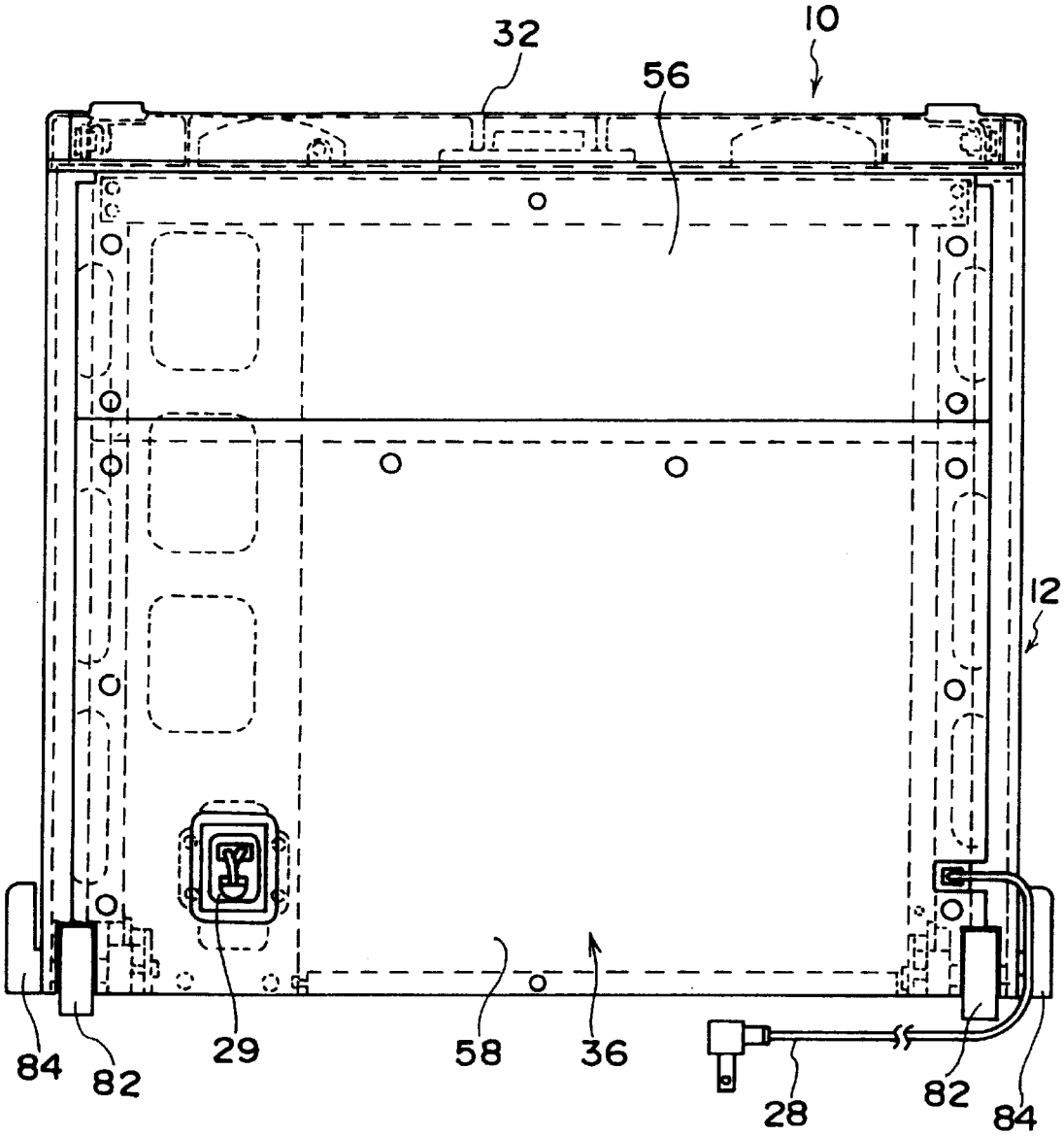
FIG. 7 is a rear view illustrating the outer structure portion of the technologically advanced portable toilet illustrated in FIG. 5.
Figure 8:
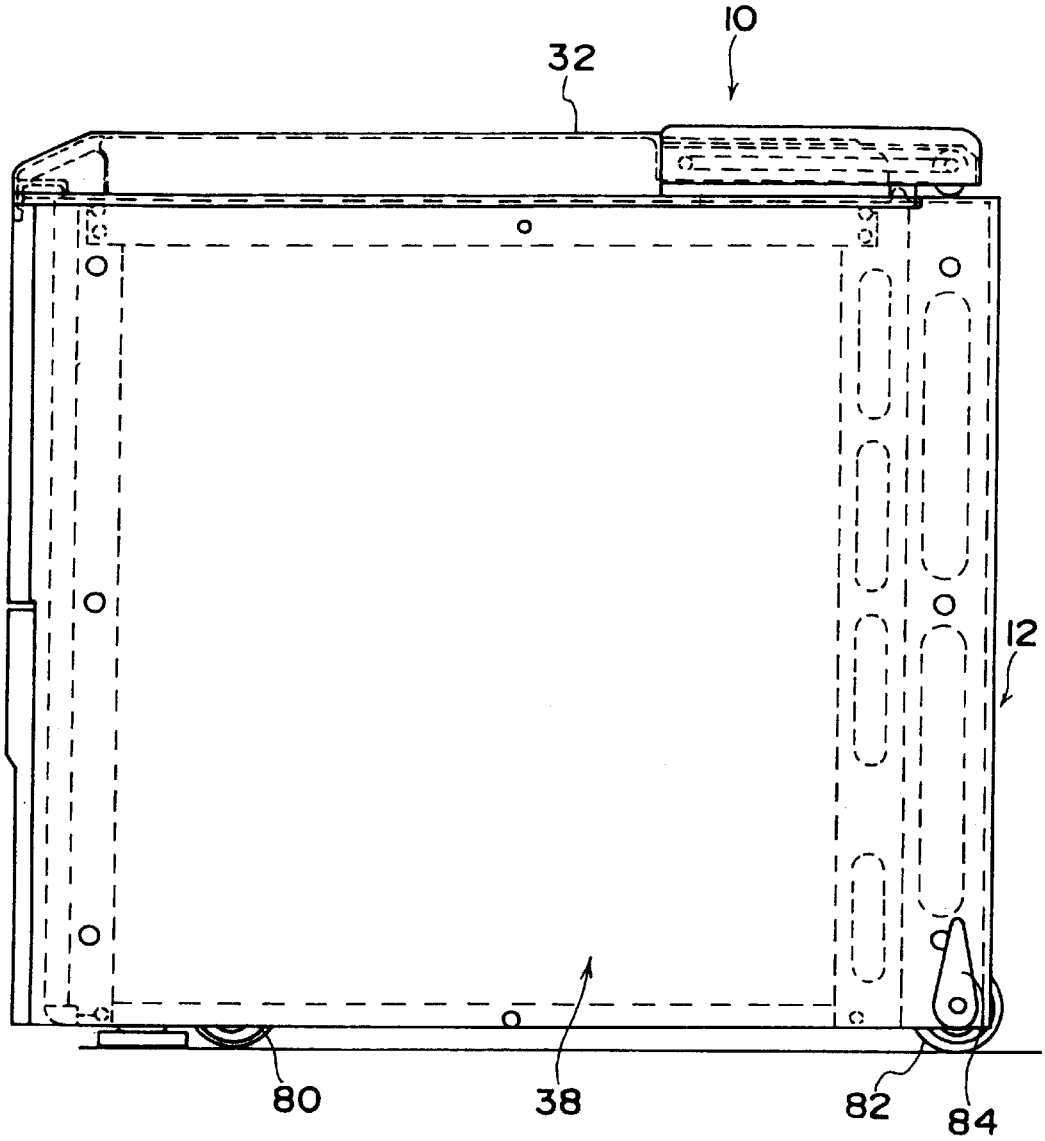
FIG. 8 is a left side view illustrating the outer structure portion of the technologically advanced portable toilet illustrated in FIG. 5.

Next, a structure of the toilet bowl 14 will be explained. As is illustrated in FIG. 4, a partition 98 is horizontally disposed at an intermediate portion in the height direction of the container body 12, in order to partition off a toilet bowl chamber 94 and a cassette chamber 96. Further, the bowl-shaped toilet bowl 14 is disposed inside the toilet bowl chamber 94, which is an empty space at the upper side partitioned off by the partition 98.

More specifically, the upper end portion of the toilet bowl 14 is positioned at the lower side of the toilet seat 30, and a lower end portion of the toilet bowl 14 is positioned inside a cylindrical boss 100 provided at a predetermined position at the partition 98 (refer to FIG. 1). The inside of the boss 100 in the partition 98 is formed as a round aperture, and the toilet bowl chamber 94 and the cassette chamber 96 communicate with each other via this boss 100.

Further, a duct 102 (refer to FIG. 9) for supplying the purifying agent is provided at the upper end portion side of the toilet bowl 14, along the circumference of the toilet seat 30. Purifying agent discharging openings are suitably spaced at predetermined positions along the circumference of the inner side of the duct 102, and the purifying agent 338 which will be described later is discharged from these purifying agent discharging openings into the toilet bowl 14.

A pair of washing nozzles 104 for jetting wash water are disposed at predetermined positions at the duct 102 side of the toilet bowl 14. Further, a washer nozzle 106 for washing the anus is disposed at a position that is to the rear of the toilet bowl 14.

Structure of Cassette 16 For Storing Waste

Next, a structure of the cassette 16 will be explained. As is illustrated in FIG. 4 and the like, the cassette 16, which is in the form of a tank, is disposed in a removable state below the toilet bowl 14, i.e., inside the cassette chamber 96. This cassette 16 has as main portions a cassette body 108 which fulfills a function of storing waste, and a cassette upper portion 110 formed at an upper portion of this cassette body 108 and onto which is disposed the shutter means 18 (which will be described later) and the like.

Equipment of the cassette 16 will be explained in detail below, with reference to FIGS. 15 to 22.

A waste discharging opening 112 (refer to FIG. 16) is provided at a bottom wall portion of the cassette body 108. An opening and closing means not indicated in the figures is disposed inside this waste discharging opening 112. This opening and closing means ordinarily holds the waste discharging opening 112 in a closed state, and when a cassette opening/closing lever (refer to FIG. 4) which is provided at the side wall portion of the cassette body 108 is pulled, opens the waste discharging opening means 112 through a linkage mechanism.

Further, a plurality of level indicators 116 (refer to FIGS. 15 and 21; broadly speaking, the level indicator 116 may be understood to be a means for detecting quantity) is disposed at a side wall portion of the cassette upper portion 110, to detect the amount (level) of waste contained in the cassette body 108. The detection signals from these level indicators 116 are taken in by a cassette water level detecting terminal 118 (refer to FIG. 4) disposed on the container body 12 and are outputted to the controller 24. Further, a cassette detection sensor 120 (see FIG. 4), for detecting whether or not the cassette 16 is installed, is disposed in the vicinity of a position in which the cassette water level detecting terminal 118 is disposed.

Cassette Cleaning Means

As illustrated in FIGS. 15 to 19, a shutter plate 168, which will be described later, and a cassette cleaning means 122 for carrying out cleaning of an inside portion of the cassette 16 are disposed at the cassette upper portion 110. This cassette cleaning means 122 is integral with the shutter plate 168. To explain more specifically, a coupler 124 is disposed at a corner portion of the cassette upper portion 110. This coupler 124 is for connecting the portable toilet with a water faucet to wash the cassette body 108. A joint 128 for cleaning, connected with the coupler 124 via a hose 126, is disposed near the coupler 124. Further, a water supply cap 130 used during washing of the cassette body 108 is held at another corner portion, i.e., a corner that faces the above-mentioned corner portion.

A cap side joint 134 is provided at this water supply cap 130. This cap side joint 134 is connected with the joint 128 for cleaning, via the hose 132. Further, an end portion of a water supply route of the cap side joint 134 opens at the bottom portion side of the water supply cap 130 (refer to FIG. 17). Further, the water supply cap 130 of the above-described structure can be firmly held at the waste receiving opening 138, which will be described later.

In addition, a pair of handles 136 (refer to FIGS. 15 and 10) for use during transportation are attached at a portion in which there is a difference in level between the cassette body 108 and the cassette upper portion 110, in such a manner that oscillation is possible.

Structure of Shutter Means 18

Next, a structure of the shutter means 18 will be explained. As is illustrated in FIG. 15 and FIGS. 20 to 22 and the like, the shutter means 18 is disposed inside the cassette upper portion 110. Schematically speaking, the structure of the shutter means 18 includes a shutter 140 which opens and closes the waste receiving opening 138, and a shutter driving portion 142 which causes the shutter 140 to swing.

Structure of Surroundings of Shutter

Figure 22:
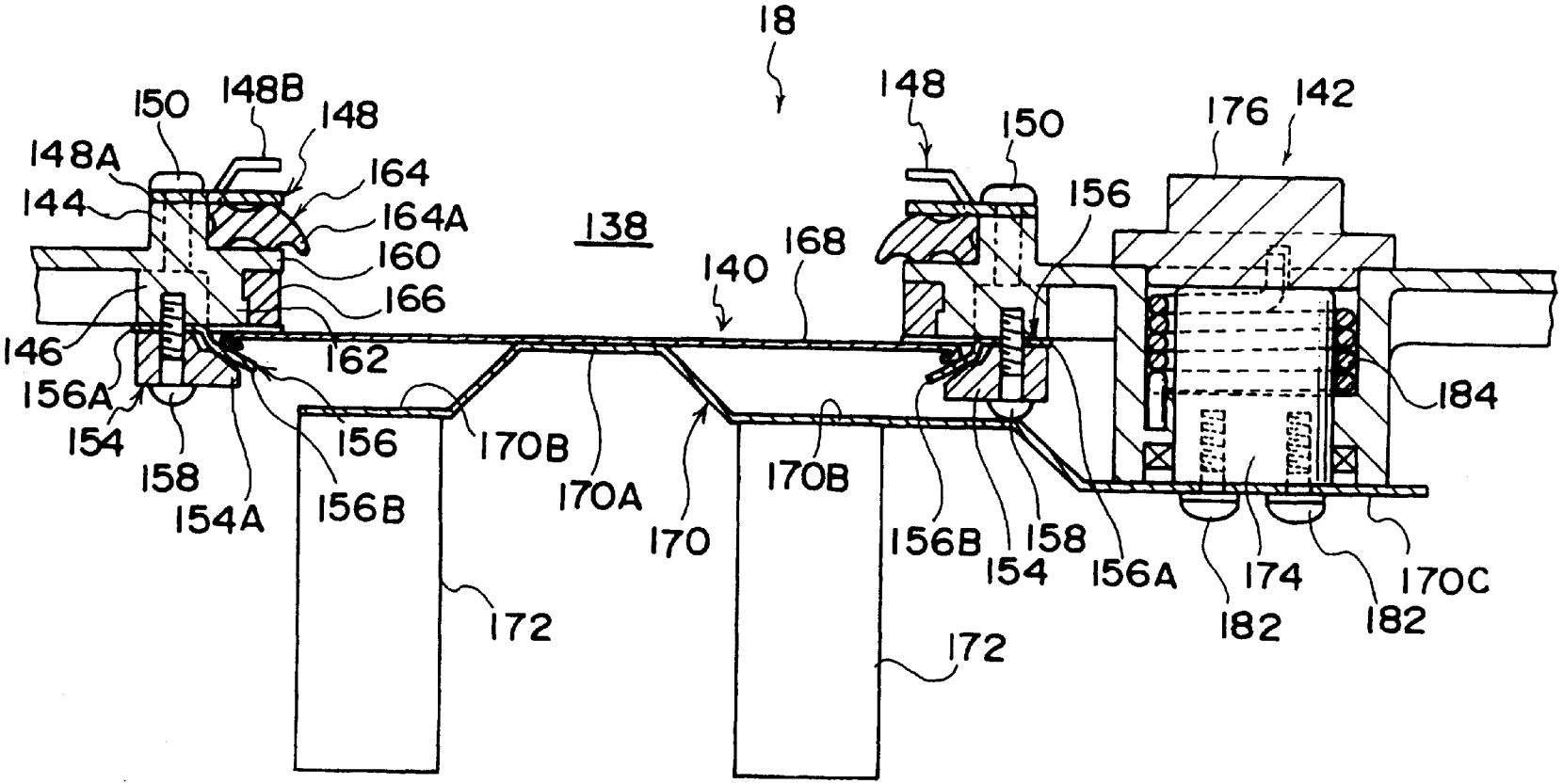
FIG. 22 is a longitudinal sectional view of main portions corresponding to FIG. 17, which indicates a detailed structure of the shutter means illustrated in FIG. 15.
Figure 23:
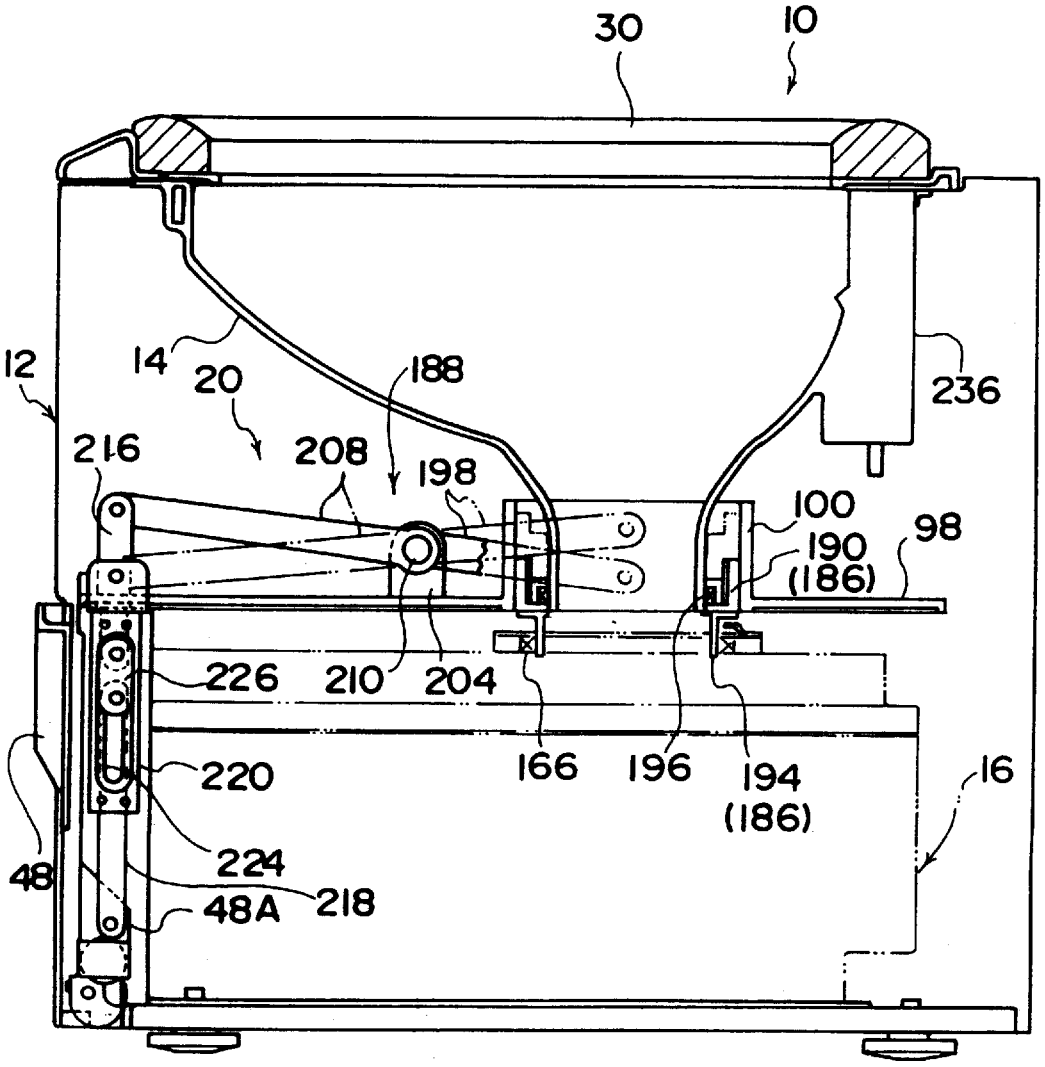
FIG. 23 is an overall side view illustrating a structure of connecting means of the technologically advanced portable toilet in accordance with the preferred embodiment.
Figure 24:
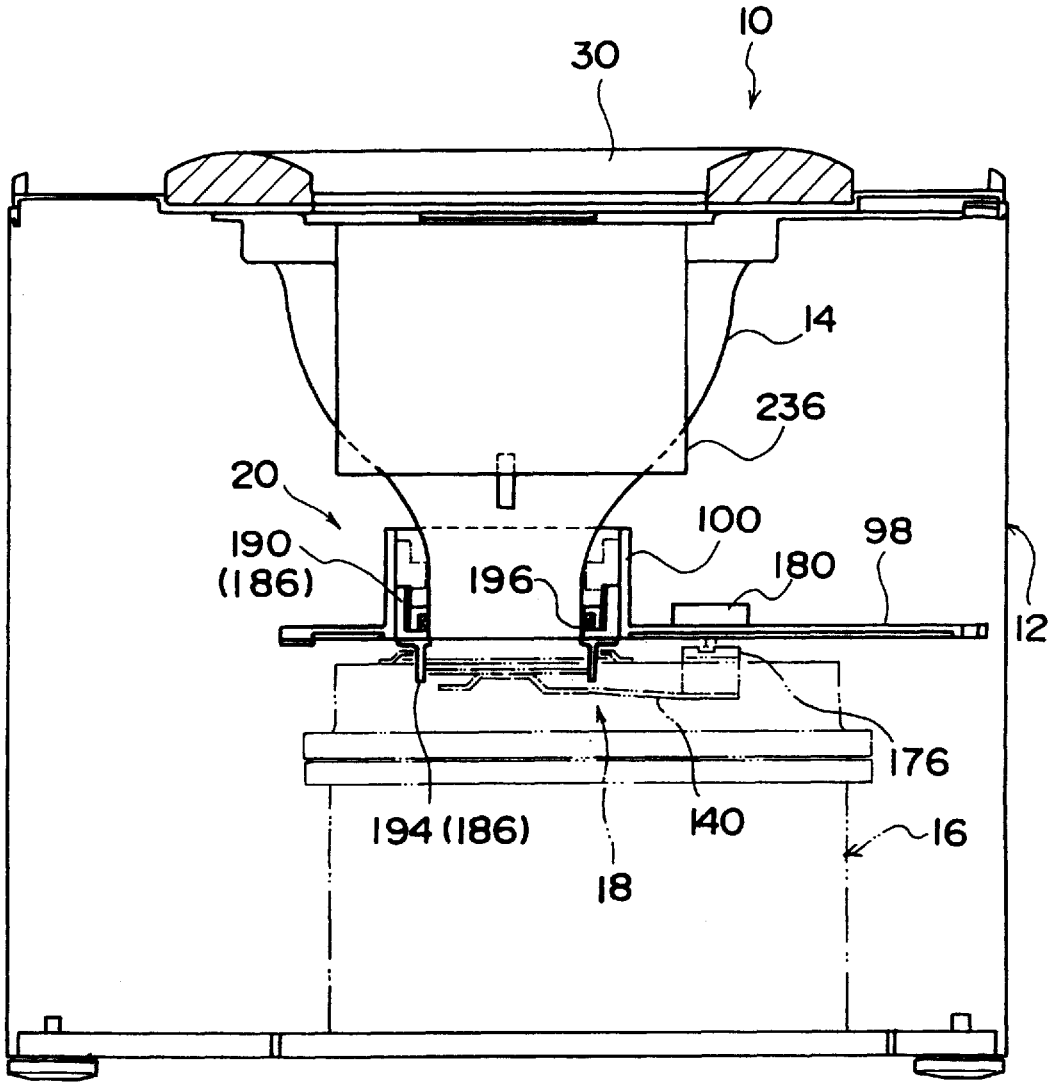
FIG. 24 is an overall rear view illustrating the structure of the connecting means of the technologically advanced portable toilet illustrated in FIG. 23.
Figure 25:
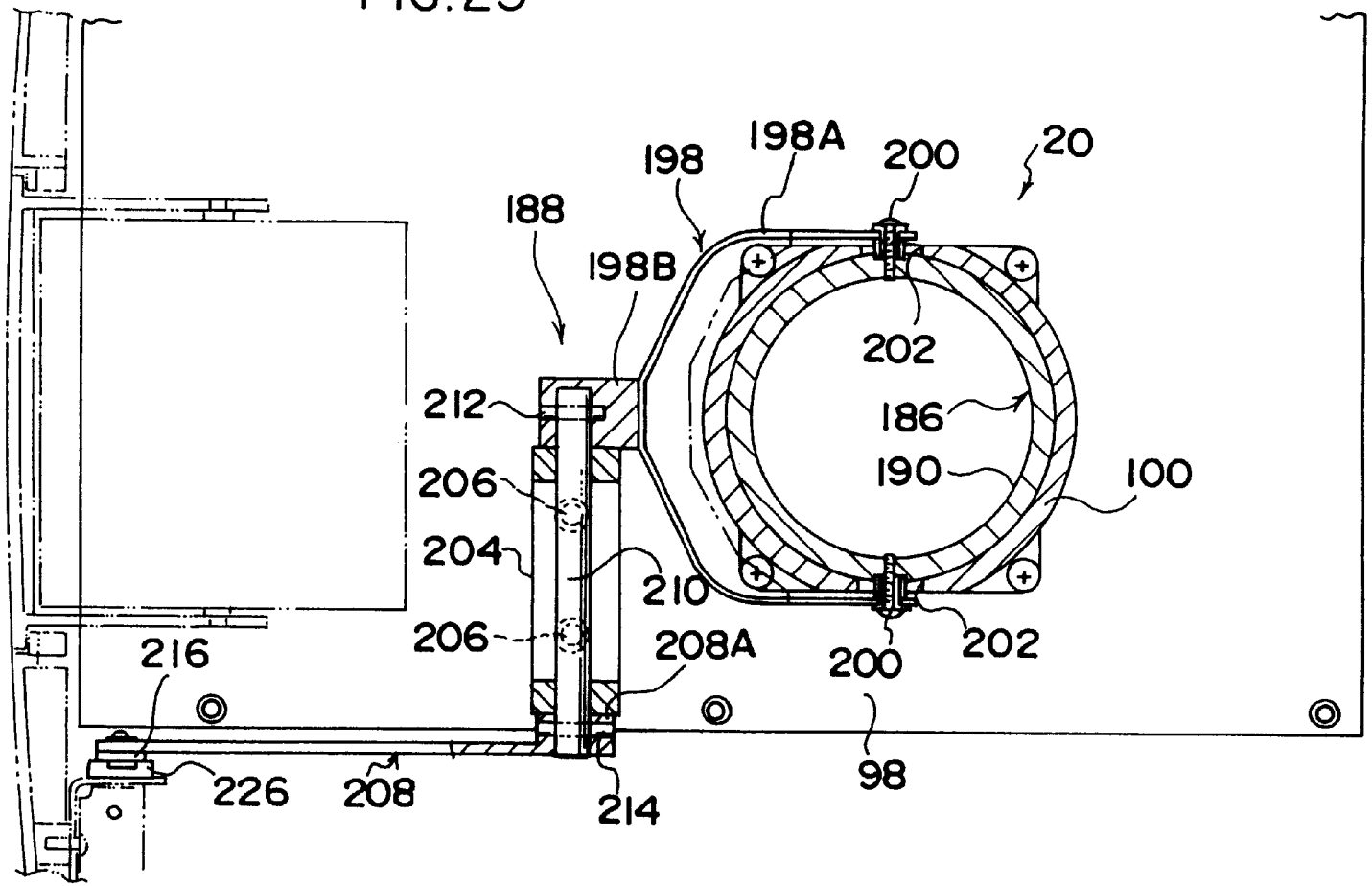
FIG. 25 is a plan view illustrating a detailed structure of the connecting means illustrated in FIG. 23 wherein the detailed structure is partially broken.
Figure 26:
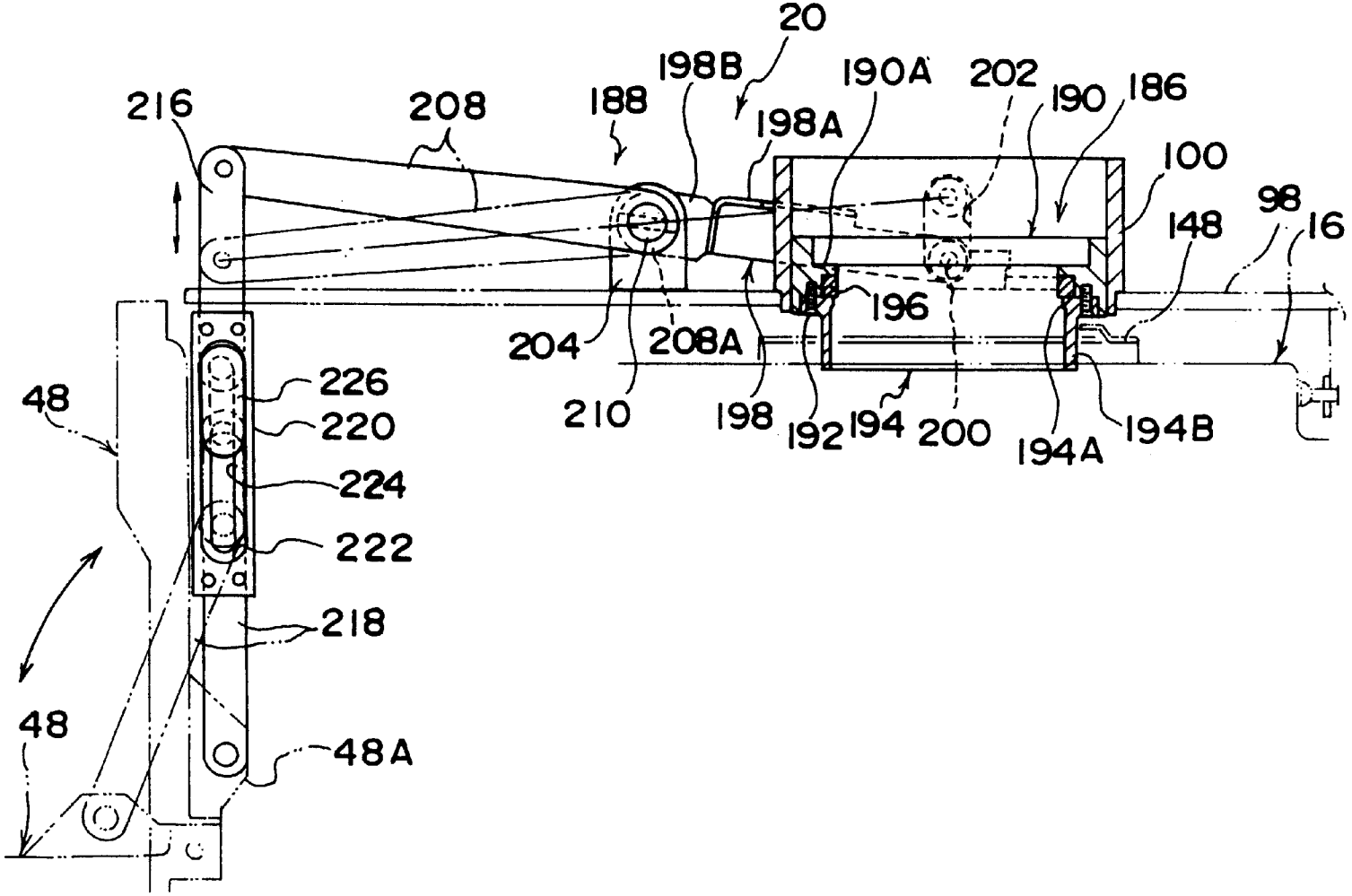
FIG. 26 is a partially broken side view illustrating the detailed structure of the connecting means illustrated in FIG. 23.
Figure 27:
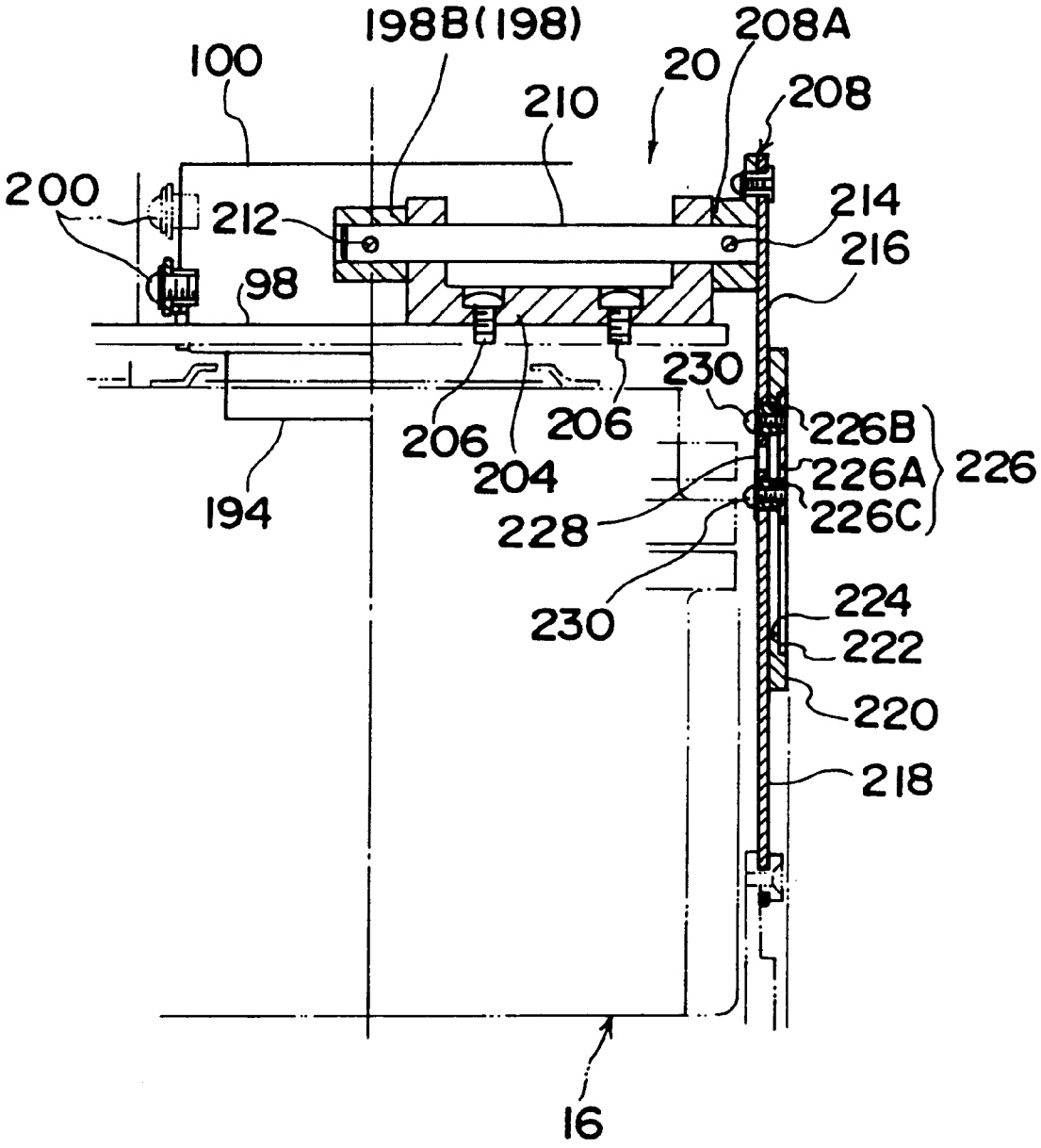
FIG. 27 is a partially broken front view illustrating the detailed structure of connecting means illustrated in FIG. 23.
Figure 28:
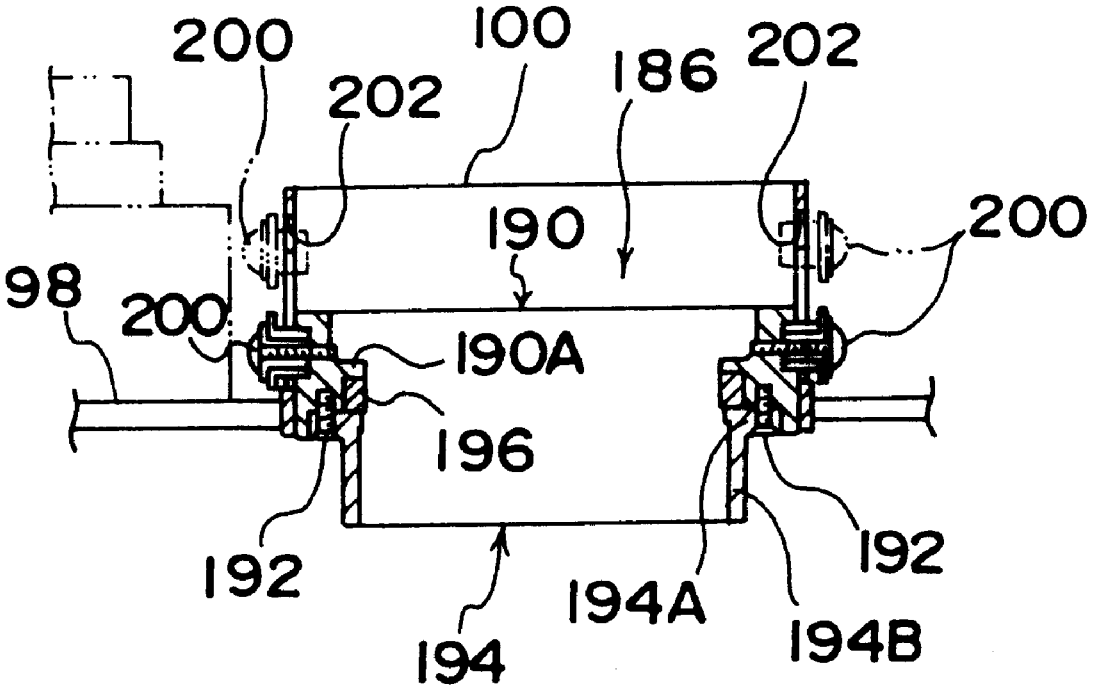
FIG. 28 is a sectional view of main portions illustrating a state in which a sleeve is being attached and detached by the connecting means.

As is particularly illustrated in FIG. 22, a cylindrical receiving portion 144, which protrudes to a given height in the direction of the boss 100 side, is integrally formed in the cassette upper portion 110 at a position that is coaxial with the boss 100. Further, an attachment seat 146 which protrudes downward to the same degree as does the receiving portion 144 is formed integrally at the back surface side of the receiving portion 144.

A ring plate-shaped lock plate 148 (broadly speaking, this lock plate 148 may be understood to be a lock means (for a water supply cap) ) is disposed at an upper end surface side of the receiving portion 144. The lock plate 148 provides a ring-shaped base 148A and a lock pawl 148B, which is shaped as shown in FIG. 22 as a cut-and-bent-up portion of a surface of the base 148A with a 120 degree interval between each lock pawl 148B along the circumference of the lock plate 148. The lock plate 148 is attached by fixing a peripheral portion of the base 148A onto the receiving portion 144 with a plurality of screws 150.

Figure 17:
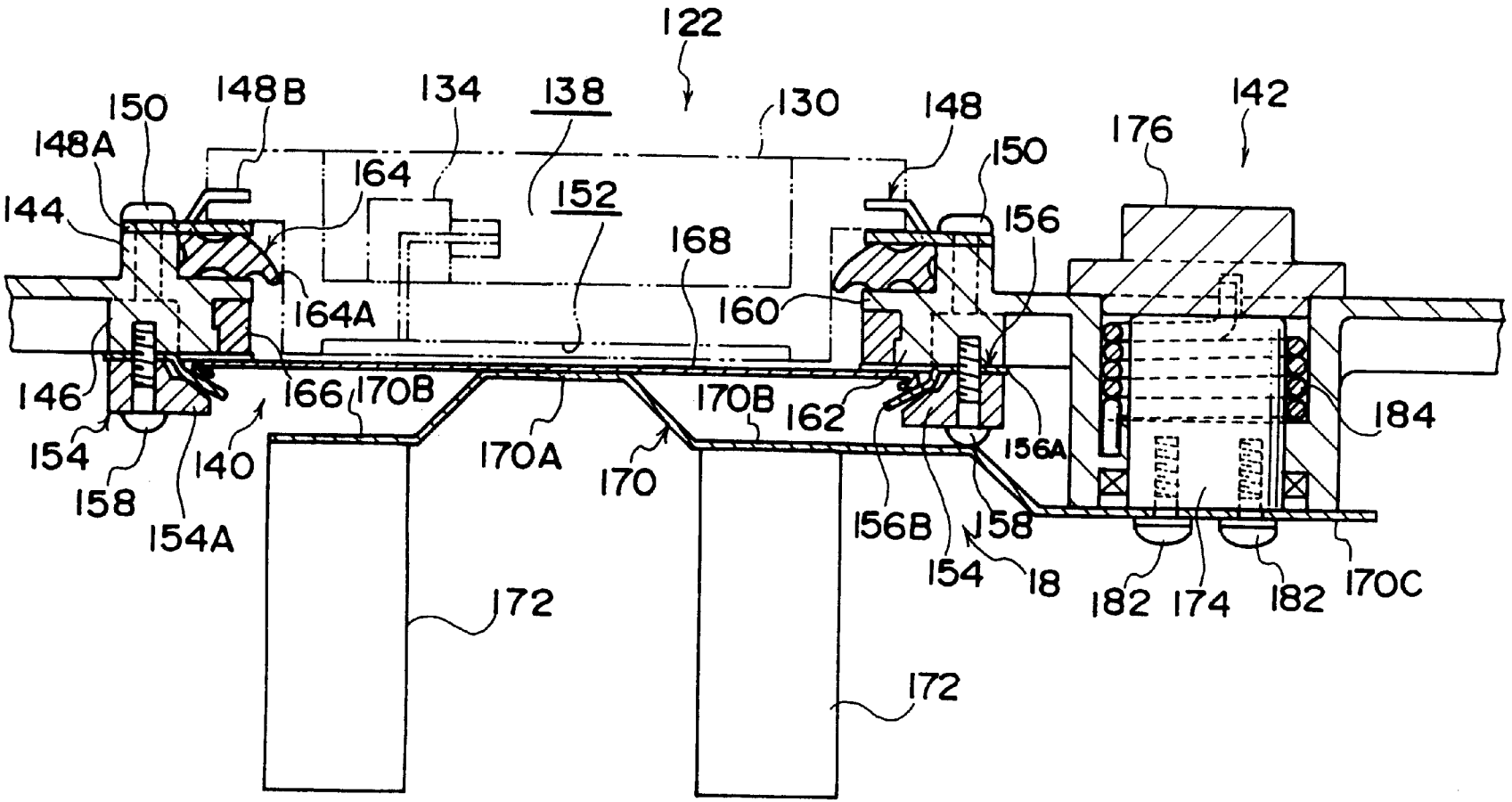
FIG. 17 is a longitudinal sectional view illustrating main portions of a structure of a cassette cleaning means which utilizes a shutter means provided at the cassette for storing waste illustrated in FIG. 15.

The perimeter of the water supply cap 130 is engaged with the lock pawls 148B of the lock plate 148 having the above-described structure (refer to FIG. 17). This structure can prevent the attached cap 130 from falling off due to water pressure or the like while washing the cassette 16. Further, in a state in which the water supply cap 130 is being held by the lock plate 148, a water chamber 152 (refer to FIG. 17) is formed between the water supply cap 130 and the shutter plate 168 (which will be described later).

Figure 15:
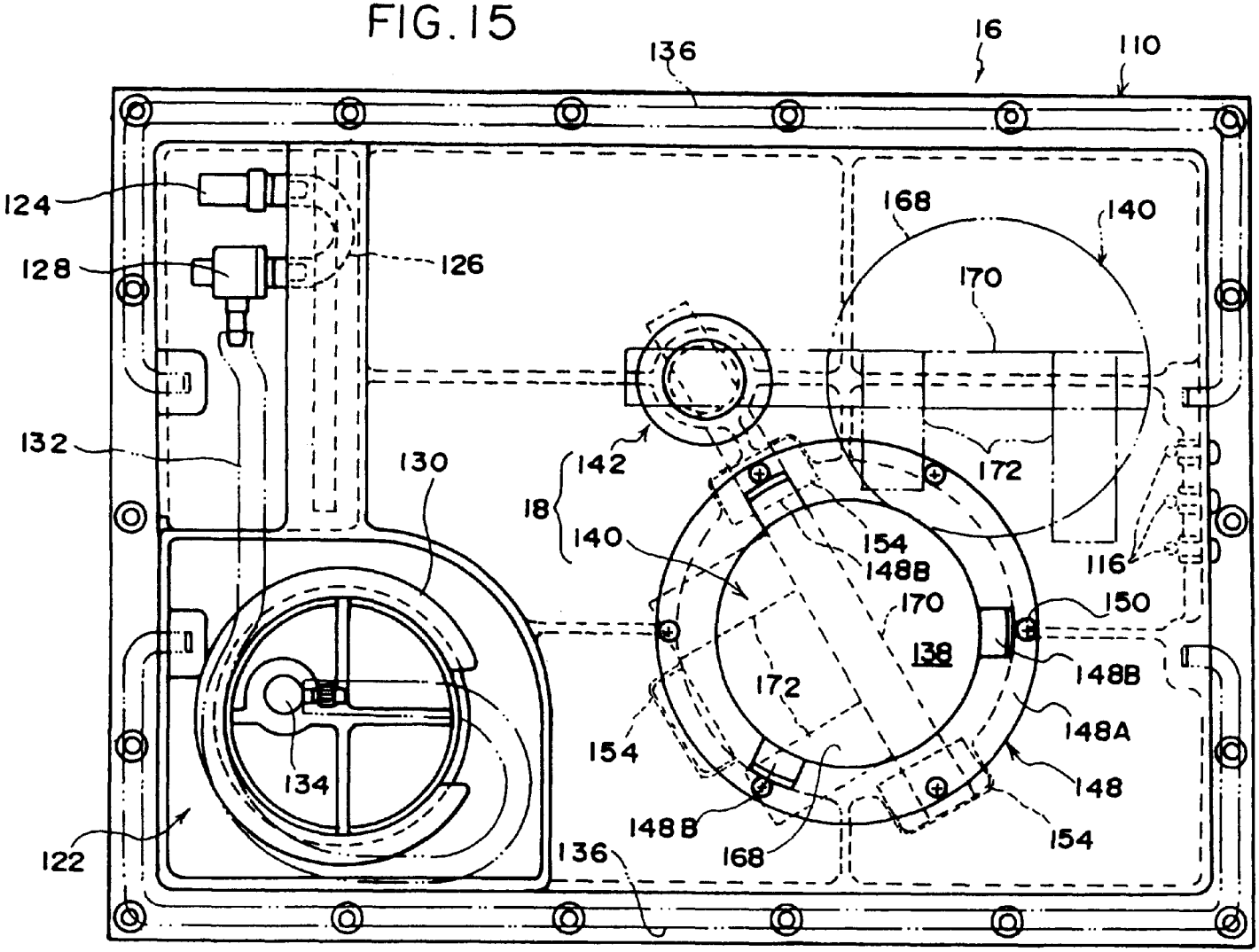
FIG. 15 is a plan view illustrating a cassette used for storing waste of the technologically advanced portable toilet in accordance with the preferred embodiment.
Figure 16:
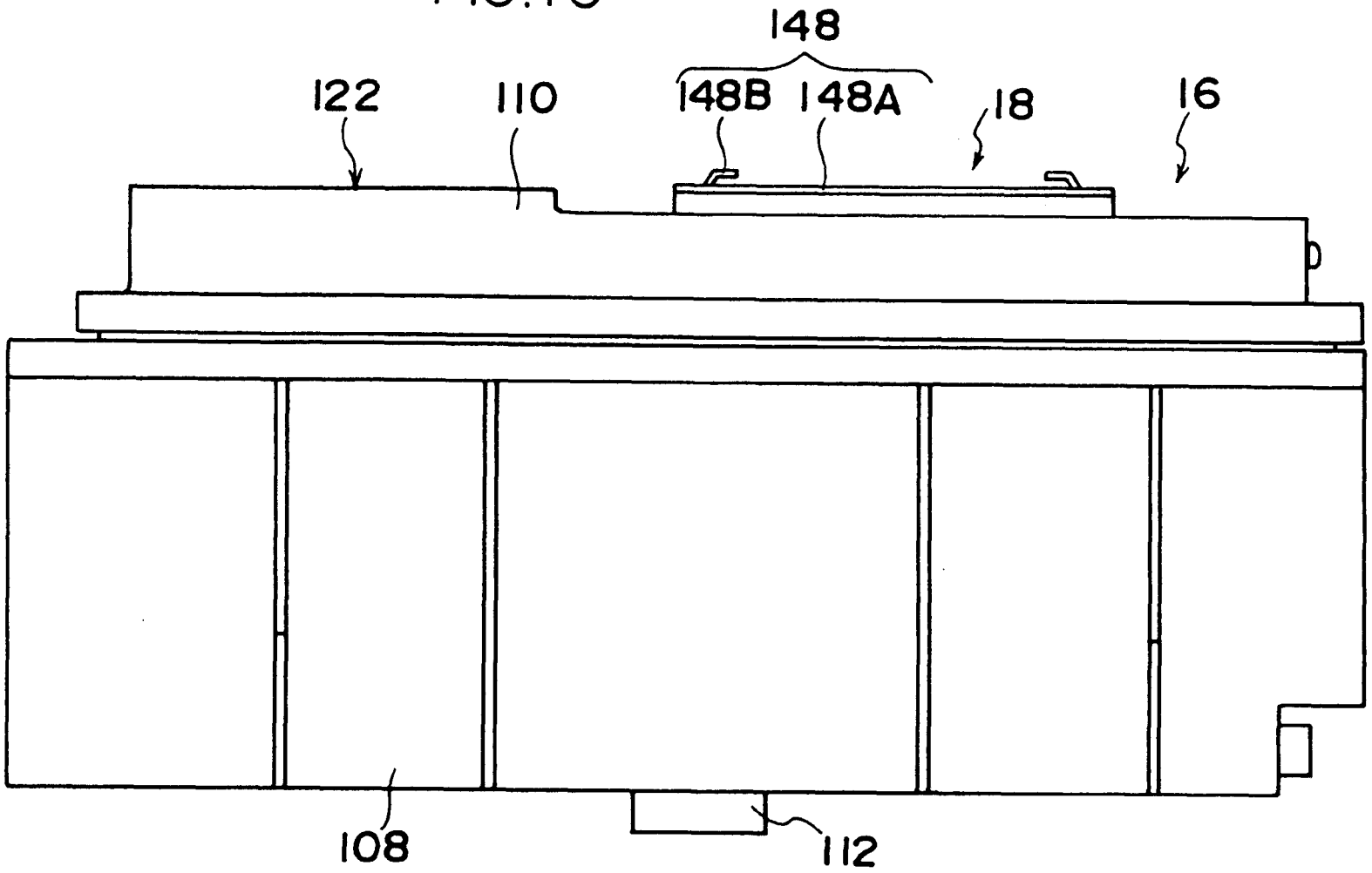
FIG. 16 is a side view of the cassette used for storing waste illustrated in FIG. 15.

On the other hand, at the side of the attachment seat 146, which is disposed at the opposite side from the receiving portions 144, holding blocks 154 are disposed at predetermined positions in the circumferential direction of the receiving portion 144 (more specifically, at three predetermined positions with a 90 degree interval between each other along a semi-periphery of the attachment seat 146 as shown in FIG. 15 such that interference with the shutter 140 can be avoided). A base 156A of a shutter lock spring 156 (broadly speaking, the shutter lock spring is a lock means (for a shutter plate) ) is interposed between an upper end surface of each of the holding blocks 154 and a lower end surface of the receiving portion 144. In this state, the shutter lock springs 156 are each fixed to the attachment seat 146, with a pair of screws 158. Lock pawls 156B, which are shaped as cut-and-bent-up portions of a distal end surface of the shutter lock spring 156, are disposed so as to protrude, when the holding blocks 154 are screwed on, at the side of wedge-shaped regulating portions 154A respectively provided at distal end portions of the holding blocks 154. Namely, the degree of elastic deformation of the lock pawls 156B is regulated by these regulating portions 154A.

Peripheral engaging portions of the shutter plate 168, which will be described later, are elastically interposed at the lock pawls 156B of the shutter lock springs 156 of the above-described structure, with a predetermined degree of spring pressure. As a result, the shutter 140 is held in a shutter closed position, by receiving a predetermined degree of spring pressure from the lock pawls 156B, which are disposed at three positions.

A horizontal supporting portion 160 which extends in the direction of the inside of the radius, and a substantially L-shaped vertical supporting portion 162 which hangs down from an inner end of this horizontal supporting portion 160 are formed integrally at a lower end portion of the inner peripheral surface side of the receiving portion 144. Further, the horizontal supporting portion 160 is also a portion of an upper wall portion of the cassette upper portion 110.

A scraper 164 (broadly speaking, the scraper 164 can be understood to be a sealing means) which is formed with an elastic material (such as rubber) is held in a compressed state between the horizontal supporting portion 160 and an inner peripheral portion of the base 148A of the lock plate 148. A distal end sealing portion 164A of the scraper 164 projects inwardly in the radial direction beyond the inner edge of the horizontal supporting portion 160 by a predetermined amount, and fulfills a sealing function and the like when the water supply cap 130 is attached.

On the other hand, a gasket 166 (broadly speaking, the gasket 166 may be understood to be a sealing means) having a substantially L-shaped cross-section and formed with an elastic material (such as rubber or the like) is held at a portion that is surrounded by the vertical supporting portion 162, the horizontal supporting portion 160 and inner peripheral portions of the bases 156A of the shutter lock springs 156. This gasket 166 fulfills a sealing function and the like between the horizontal supporting portion 160 and the shutter lock springs 156.

Shutter

The shutter 140 is held at the lock pawls 156B of the shutter lock springs 156. A structure of this shutter 140 includes the following: the disk-shaped shutter plate 168 which is elastically interposed between a reverse surface of inner peripheral portions of the bases 156A of the shutter lock springs 156 and the plurality of lock pawls 156B; and a shutter supporting portion 170 in a form of a thin strip-shaped plate that is fixed to the reverse surface of this shutter plate 168 with spot welding or the like. Further, peripheral engaging portions of the shutter plate 168 are curved into a substantially U-shaped form in order to receive a predetermined degree of spring pressure from the lock pawls 156B.

The shutter supporting portion 170 is suitably curved. Specifically, a structure of the shutter supporting portion 170 includes the following: a shutter plate side attachment portion 170A which is in the shape of a mountain and which is fixed to the reverse surface of the shutter plate 168; a pair of smoothing tool supporting portions 170B which are placed parallel with the shutter plate 168, wherein one smoothing tool supporting portion 170B is provided at each side of this attachment portion 170A; and a driving portion side attachment portion 170C which is extended further out from the smoothing tool supporting portion that is nearer to a middle portion in the longitudinal direction, with a difference in level therebetween.

A smoothing tool 172 is provided at each of the pair of smoothing tool supporting portions 170B, such that the smoothing tools 172 are parallel to each other and are suspended in a curved form, in the direction of the bottom portion side of the cassette. These smoothing tools 172 are each in the form of a slab, and function as spatulas that mix/agitate the waste (refer to FIG. 21).

Shutter Driving Portion

The shutter 140 with the previously described structure is made to swing by the shutter driving portion 142. To explain more specifically, a cylindrical pin holding body 174 is integrally formed near the cylindrical receiving portion 144, such that the pin holding body 174 extends in the direction of the bottom portion side of the cassette. A shutter driving pin 176 is disposed in an inserted state at this pin holding body 174. Further, this shutter driving pin 176 is driven/rotated with a rotary actuator 180, which operates by receiving the driving force of a cassette shutter driving cylinder 178 (refer to FIG. 1). The driving portion side attachment portion 170C of the shutter supporting portion 170 is fixed with screws 182 to the lower end surface of this shutter driving pin 176.

Further, a torsion spring 184 is installed in a coiled state at an intermediate portion in the axial direction of the shutter driving pin 176. As a result, the torsion spring 184 rotates/biases the shutter plate 168 towards a shutter closed position side (the position wherein the waste receiving opening 138 is closed, i.e., the position indicated by solid lines in FIG. 15), ordinarily via the shutter driving pin 176. When the shutter driving pin 176 receives the driving force from the rotary actuator 180 (refer to FIG. 20), the shutter driving pin 176 swings the shutter plate 168 to a shutter open position (the position wherein the waste receiving opening 138 is open, i.e., the position indicated by double-dashed chain lines in FIG. 15), resisting the bias force of the torsion spring 184.

Structure of Connecting Means 20

Next, the structure of the connecting means 20 will be explained. As is illustrated in FIGS. 23 to 28, the connecting means 20 which connects a lower end portion of the toilet bowl 14 and the cassette upper portion 110 is disposed at the partition 98. Schematically speaking, the structure of the connecting means 20 includes the following: a sleeve 186 which connects the lower end portion of the toilet bowl 14 with the waste receiving opening 138 of the cassette upper portion 110; and a sleeve driving means 188 which connects or separates the cassette lid panel 48 and the sleeve 186 by causing the sleeve 186 to interlock with an opening/closing operation of the cassette lid panel 48, thereby raising and lowering the sleeve 186.

Sleeve

The structure of the sleeve 186 includes the following: a substantially cylindrical main sleeve 190 which is fitted inside the boss 100; and a substantially cylindrical sub-sleeve 194 which is fixed at the lower end side of this main sleeve 190 with screws 192. The dimensions of the outer diameter of the main sleeve 190 substantially conform to the dimensions of the inner diameter of the boss 100, and the dimensions of the inner diameter of the main sleeve 190 are set slightly larger than the dimensions of the outer diameter of a lower end portion of the toilet bowl 14. Further, a radially extended portion 190A which extends in the radially inward direction is formed integrally at a lower end portion side of the main sleeve 190. The dimensions of the inner radius of this radially extended portion 190A substantially conform to the dimensions of the outer radius of the lower end portion of the toilet bowl 14. Further, a ring-shaped packing 196 (broadly speaking, the packing 196 can be understood to be a sealing means) is fittingly engaged with at the inner peripheral side of the radially extended portion 190A.

The structure of the sub-sleeve 194 includes the following: an attachment seat 194A which abuts against and is fastened with screws to a lower end surface of the radially extended portion 190A of the main sleeve 190; and an axially extended portion 194B which extends from this attachment seat 194A towards the lower side. Pressure is applied to the packing 196 due to the attachment seat 194A being fixed at the radially extended portion 190A and sealing is achieved. Incidentally, the dimensions of the inner radius of the axially extended portion 194B substantially conform to the dimensions of the outer radius of the lower end portion of the toilet bowl 14.

Sleeve Driving Means

As is particularly illustrated in FIGS. 25 to 28, the sleeve driving means 188 includes a connecting body 198. The connecting body 198 is comprised of a connecting portion 198A, which is substantially U-shaped when seen from a plan view, and a base end portion 198B that extends from this connecting portion 198A. Each of the pair of distal end portions of the connection portion 198A of the connecting body 198 is disposed at a side of the previously described main sleeve 190, and is fixed at this main sleeve 190 with screws 200, via a bush and a collar. Further, a long aperture 202 is formed at a predetermined position at the boss 100, in order to secure a path for movements of the screws 200, which move with the upward and downward movements of the sleeve 186.

Further, a supporting placket 204, which is U-shaped when seen in a front view, is fixed at a predetermined position at the previously mentioned partition 98, with a pair of screws 206. The base end portion 198B of the connecting body 198 is disposed at the outer side of a side portion of this supporting placket 204. Further, an end portion of a joint lever 208 is disposed at the outer side of another side portion of the supporting placket 204. At this end portion of the joint lever 208, a cylindrical boss 208A is integrally formed. This boss 208A abuts the outer side of the other side portion of the supporting placket 204.

A connecting shaft 210 penetrates the base end portion 198B of the previously described connecting body 198, as well as the boss 208A of the joint lever 208. One end portion of the connecting shaft 210 and the base end portion 198B are fixed together by a fixing pin 212 being inserted. Similarly, another end portion of the connecting shaft 210 and the boss 208A of the joint lever 208 are fixed together by a fixing pin 214 being inserted.

Further, another end portion of the joint lever 208 is connected to an upper end portion of a first raising/lowering link 216 disposed at the back surface side of the cassette lid panel 48, such that rotation relative to the first raising/lowering link 216 is possible. A second raising/lowering link 218 having the same structure as the first raising/lowering link 216 is disposed at the lower side of this first raising/lowering link 216.

The lower end portion side of this first raising/lowering link 216 and the upper end portion side of this second raising/lowering link 218 are held inside a slide holder 220 having a transverse cross-sectional form that is substantially U-shaped. A long and thin cavity portion 222 is formed at a top wall portion of this slide holder 220, in a range that avoids positions of attachment portions for fixing the slide holder (upper end side and lower end side). Further, at a bottom portion of this cavity portion 222, a long aperture 224 is formed, to the degree that is demanded by opening/closing strokes of the cassette lid panel 48.

A slider 226 is fitted into the inside of the cavity portion 222 of the slide holder 220. The structure of this slider 226 includes a slide base 226A which slides along a bottom surface of the cavity portion 222, and a pair of cylindrical portions 226B and 226C which are provided in upright positions with respect to this slide base 226A. Incidentally, it is also possible for the slide base 226A and the pair of cylindrical portions 226B and 226C to be each formed as separate (independent) members.

One of the cylindrical portions, namely, cylindrical portion 226B, is inserted into a round aperture in a lower end portion of the first raising/lowering link 216, and the other cylindrical portion, namely, cylindrical portion 226C, is inserted into a round aperture in an upper end portion of the second raising/lowering link 218. The lower end portion of the first raising/lowering link 216 and the upper end portion of the second raising/lowering link 218 are connected with each other via the slider 226, due to screws 230 being screwed on to the above-mentioned portions after plate-shaped washers 228 are applied. Further, a lower end portion of the second raising/lowering link 218 is connected to a leg portion 148A provided at the back surface side of the cassette lid panel 48, in such a manner that rotation with respect to the leg portion 148A is possible.

Thus, in cases in which the cassette lid panel 48 is in a closed position, the other end portion of the joint lever 208 is in a raised position, via the second raising/lowering link 218 and the first raising/lowering link 216. As a result, the sleeve 186 is positioned in a lowered position (connected position) wherein the sleeve 186 is inserted into the waste receiving opening 138. Alternatively, in cases in which the cassette lid panel 48 is in an open position, the other end portion of the joint lever 208 is in a lowered position, via the second raising/lowering link 218 and the first raising/lowering link 216. As a result, the sleeve 186 is positioned in a raised position (separated position; released connection position) wherein the sleeve 186 is withdrawn to the upper side from the waste receiving opening 138.

Structure of Purifying Agent Producing/Supplying Means 22

Next, the structure of the purifying agent producing/supplying means 22 will be explained. As is illustrated in FIGS. 1 to 4 and FIGS. 29–30 and the like, the purifying agent producing/supplying means 22 is provided at the periphery of the toilet bowl 14 so as to hem the toilet bowl 14. Schematically speaking, the structure of this purifying agent producing/supplying means 22 includes the following: an ozone producing mechanism 232, a tank assembly 234, a bubble generating tank 236, and a compressed air supplying portion 238.

Ozone Producing Mechanism

Figure 3:
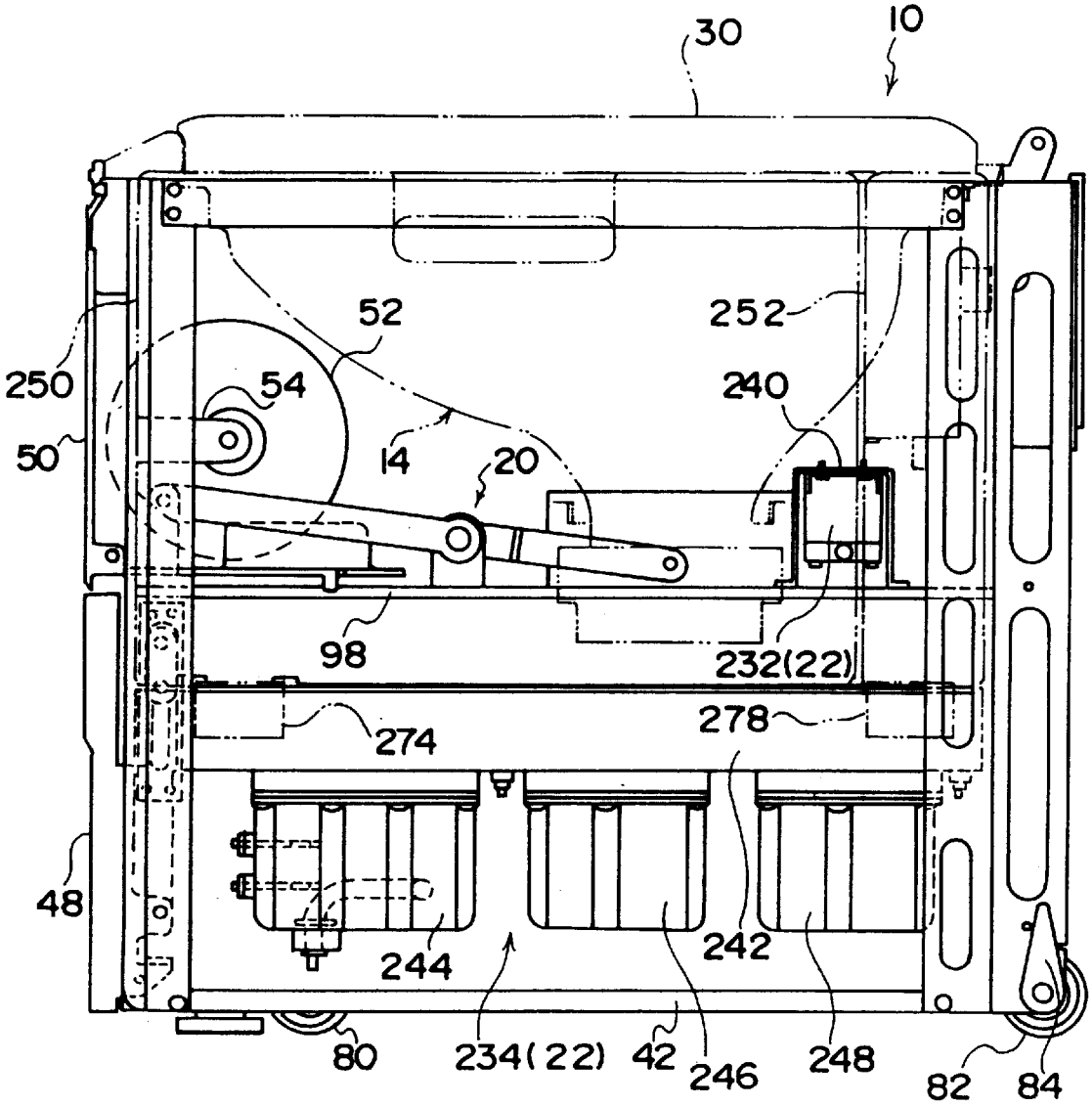
FIG. 3 is a left side view of the schematic structure of main portions of the technologically advanced portable toilet illustrated in FIG. 1.

As is illustrated in FIGS. 1 and 3, the ozone producing mechanism 232 is provided to the rear of a lower end portion of the toilet bowl 14, and is fixed to the partition 98 via a pair of fixing brackets 240. This ozone producing mechanism 232 is an apparatus that produces ozone; it is possible to apply apparatuses that carry out silent discharging in oxygen or in clean dry air (ozonizers), apparatuses that utilize ozone lamps, or the like. Further, the ozone producing mechanism 232 is connected with one of a plurality of solenoid valves 356, which will be described later.

Tank Assembly

As is illustrated in FIG. 3, the tank assembly 234 is formed as a complex of a plurality of tanks. Specifically, the structure of the tank assembly 234 includes the following: a main tank 242 in the shape of a flat rectangular parallelopiped; a washer tank 244 which is fixedly mounted to the lower portion side of this main tank 242; a water tank 246; a fixed amount mixing tank 248; and a liquid A tank 250 and a liquid B tank 252, which are mounted at the upper portion side of the main tank 242, in such a manner that removal is possible.

Figure 29:
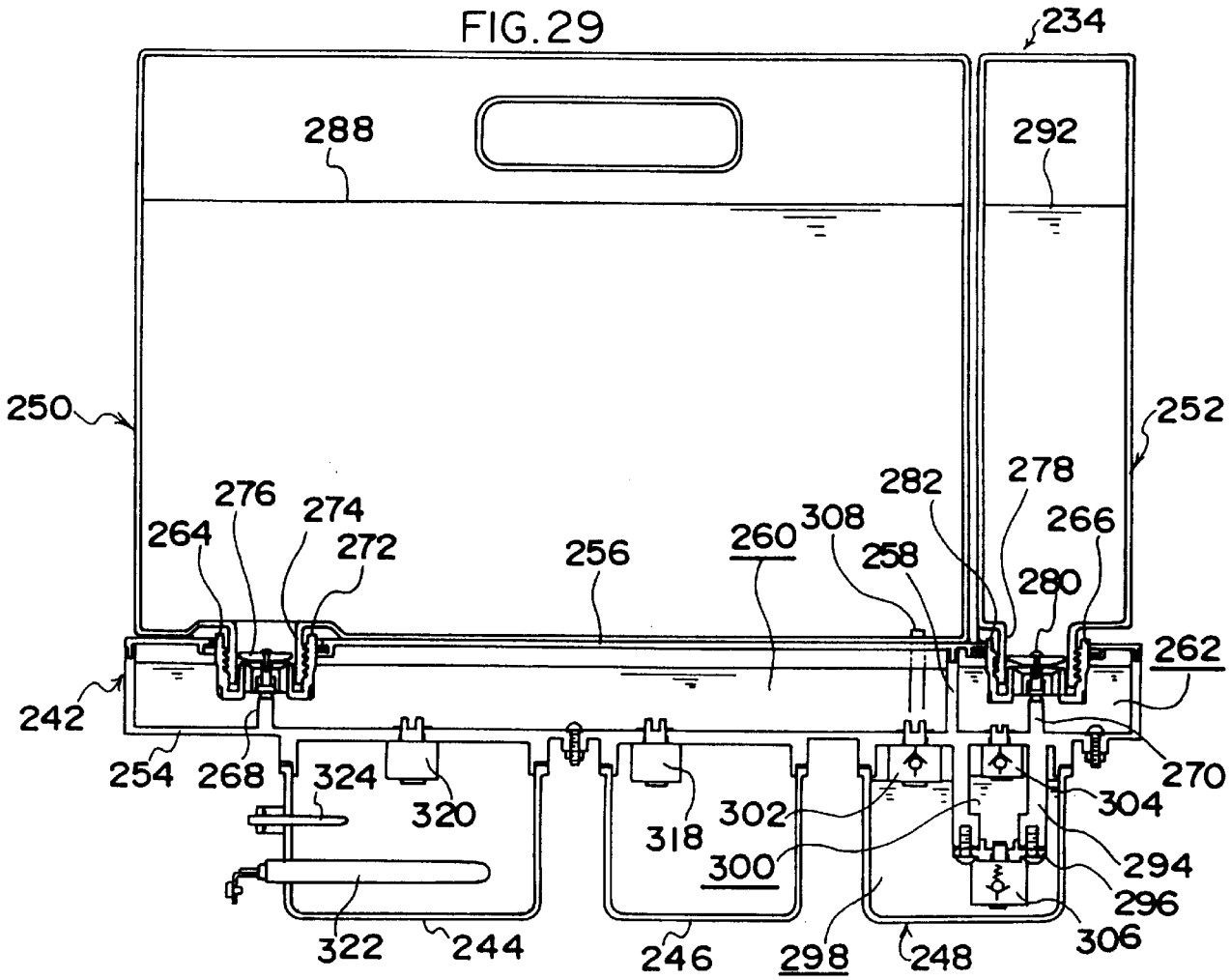
FIG. 29 is a side view illustrating a structure of a tank assembly in a purifying agent producing/supplying means of the technologically advanced portable toilet in accordance with the preferred embodiment.
Figures 30A, 30B:
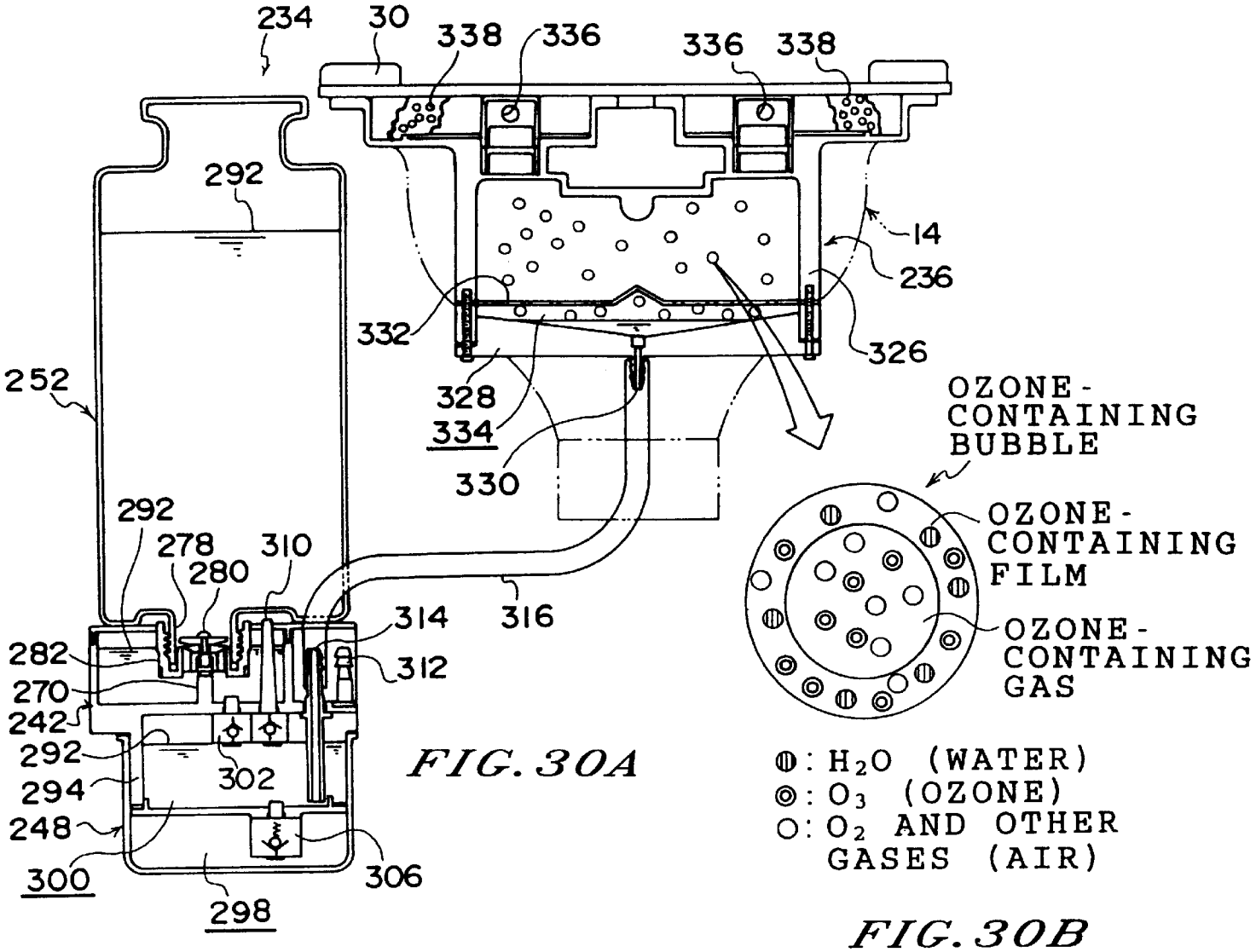
FIG. 30 is a rear view illustrating a structure of a bubble generating tank and the tank assembly in the purifying agent producing/supplying means of the technologically advanced portable toilet in accordance with the preferred embodiment.
Figure 31:
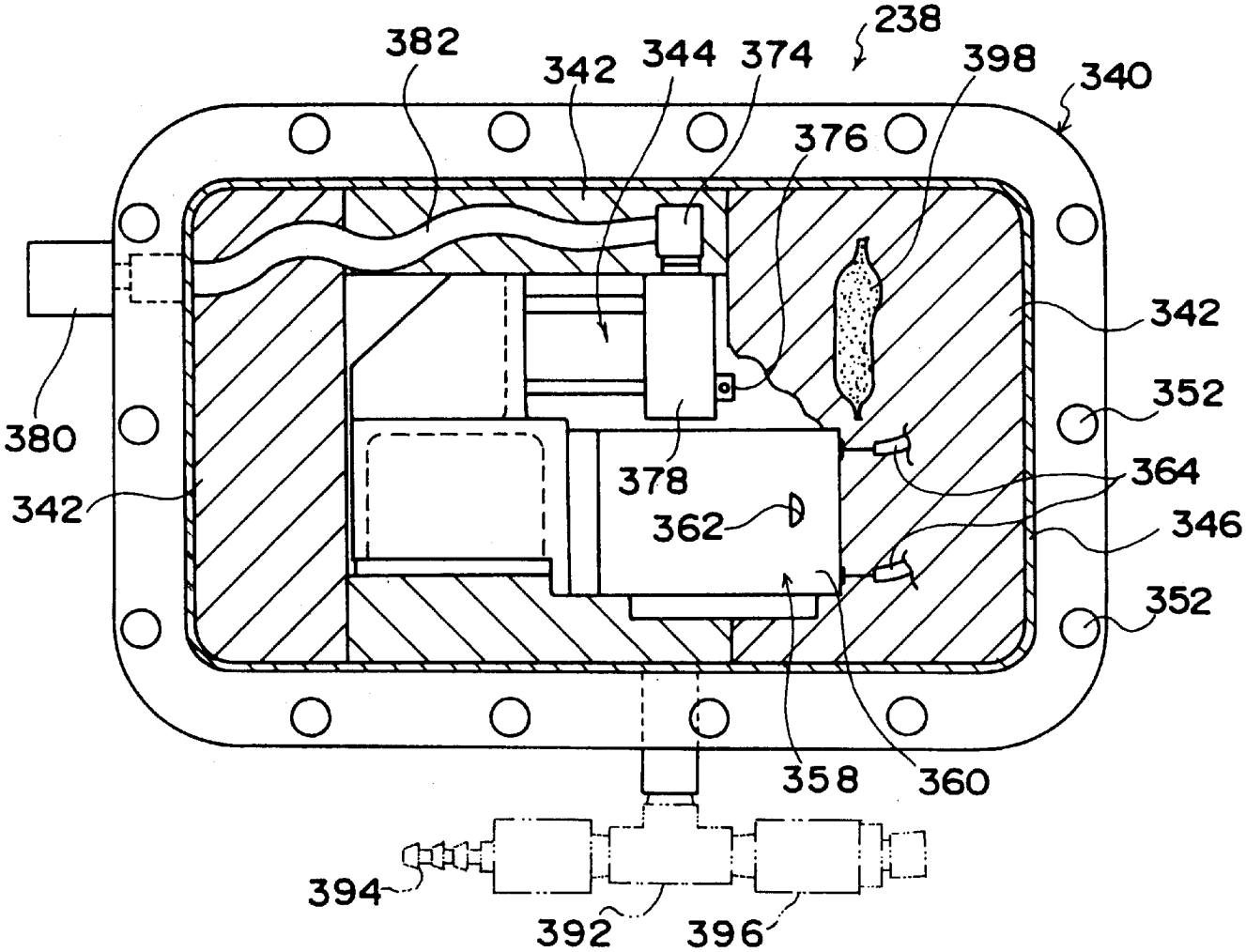
FIG. 31 is a plan view illustrating a structure of a compressed air supplying portion in the purifying agent producing/supplying means of the technologically advanced portable toilet in accordance with the preferred embodiment, wherein the structure is horizontally broken.
Figure 32:
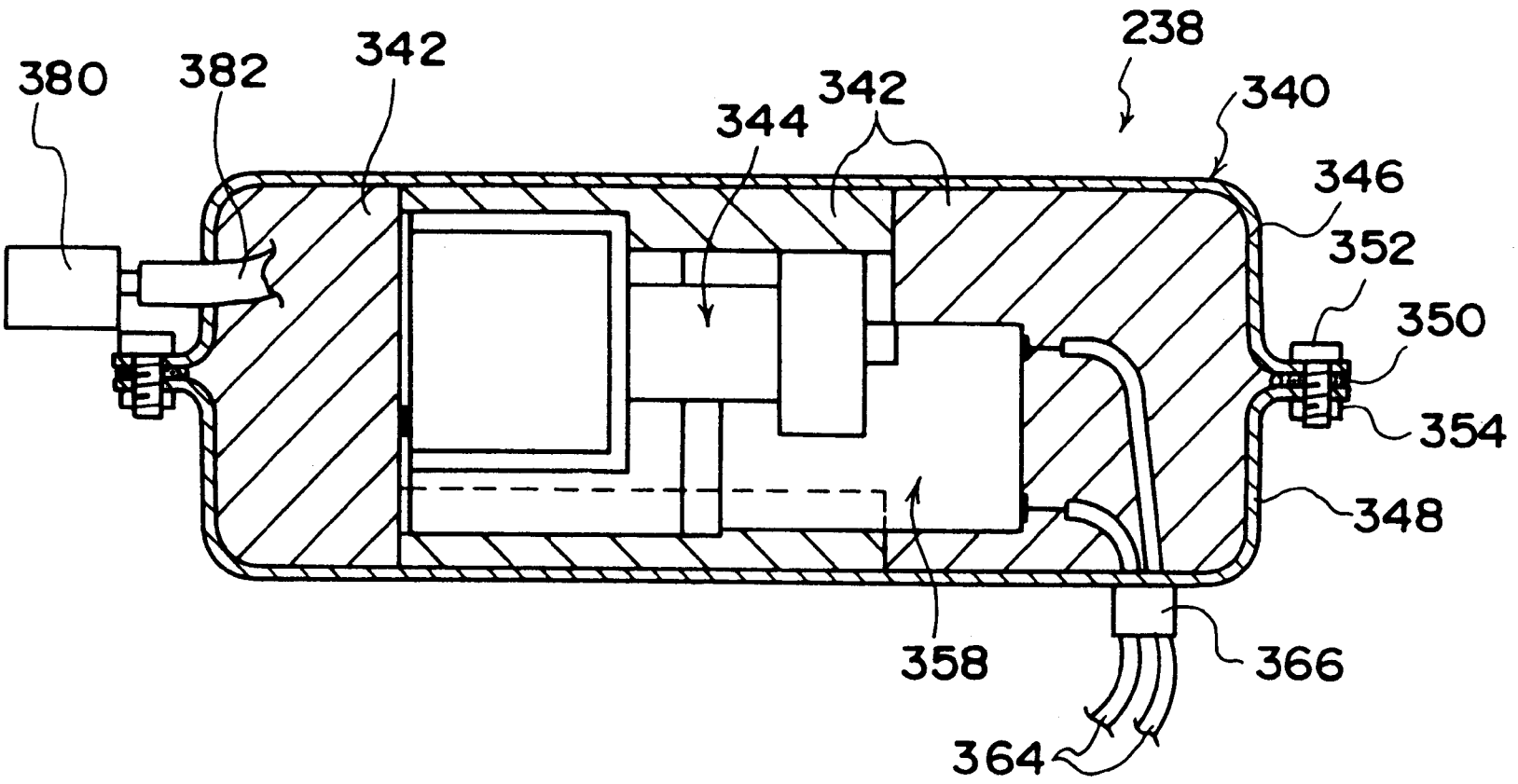
FIG. 32 is a transverse sectional view of the compressed air supplying portion illustrated in FIG. 31.
Figure 33:
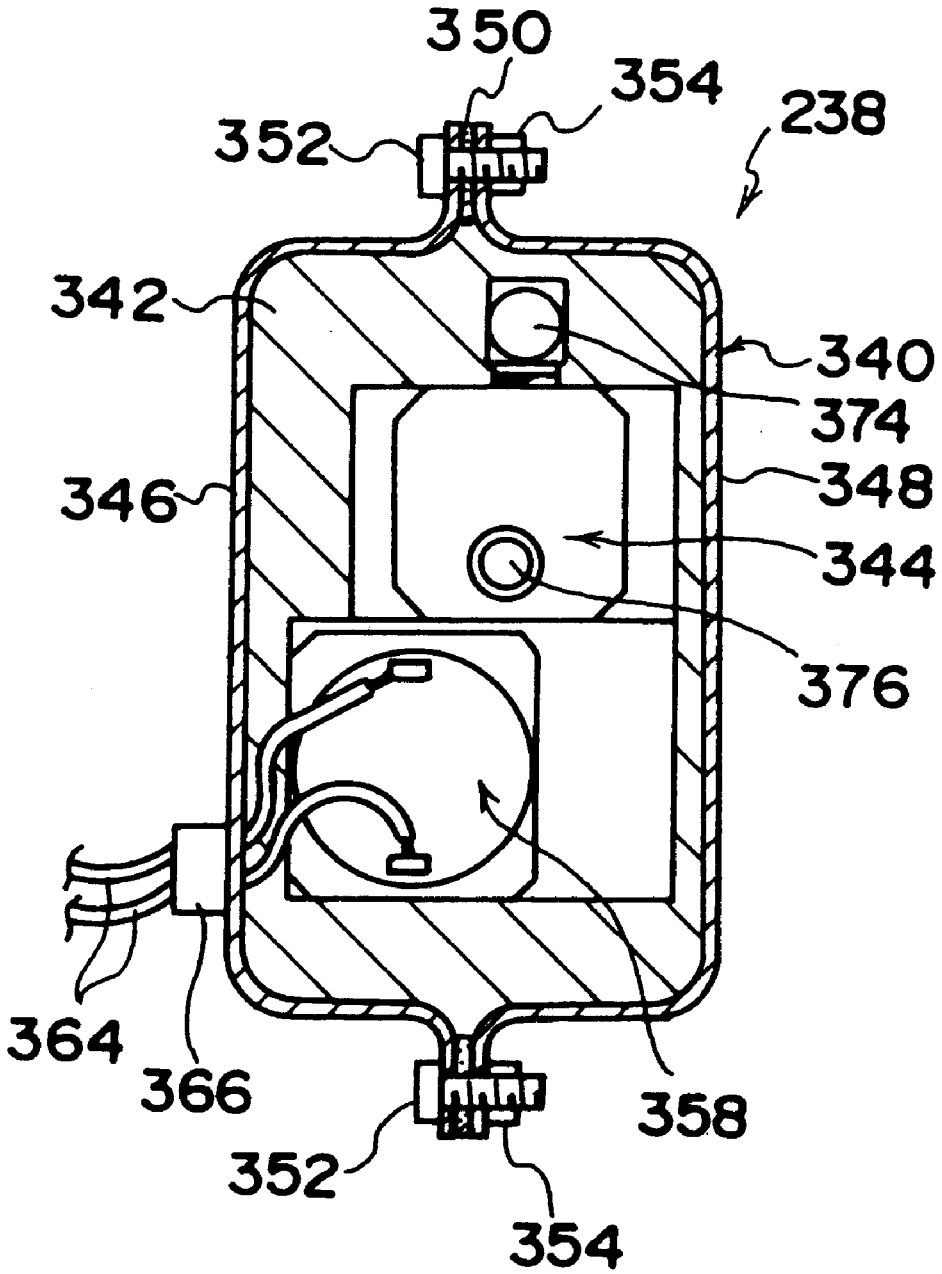
FIG. 33 is a longitudinal sectional view of the compressed air supplying portion illustrated in FIG. 31.

To explain in detail, the structure of the main tank 242 includes a tank body 254, and a lid body 256 which is fitted onto this tank body 254, as is illustrated in FIGS. 29 and 30. At a predetermined position at an inner portion of this tank body 254, a partition wall 258 is provided in an upright position, and as a result, the main tank 242 is divided into a liquid A containment chamber 260 and a liquid B containment chamber 262. A liquid A insertion opening 264 is formed at the side of the liquid A containment chamber 260 in the lid body 256, and a liquid B insertion opening 266 is formed at the side of the liquid B containment chamber 262. Further, at bottom portions of the tank body 254, upward pushing pins 268 and 270 are formed in positions that are coaxial with the liquid A insertion opening 264 and the liquid B insertion opening 266, respectively.

A liquid A tank 250 which stores a liquid A (water) 288 is mounted in such a manner that removal is possible, at the side of the liquid A containment chamber 260 on the lid body 256 of the main tank 242. An insertion portion 274, which is inserted inside the liquid A insertion opening 264 with a cap 272 being screwed on, is formed at a lower end portion of the liquid A tank 250. Further, a valve body 276, which is biased in the closed direction and can be moved in the upward and downward directions, is provided at an axis center portion of the cap 272. Thus, when the insertion portion 274 of the liquid A tank 250 is inserted into the liquid A insertion opening 264, the valve body 276 is pushed upward by the upward pushing pin 268 in spite of water pressure, and at the same time, the liquid A 288 flows into the liquid A containment chamber 260 of the main tank 242.

Further, the liquid B tank 252 which stores a liquid B (a surfactant solution) 292 is mounted on the lid body 256 at the side of the liquid B containment chamber 262 in such a manner that removal is possible. An insertion portion 278 which is inserted into the liquid B insertion opening 266 is likewise formed at a lower end portion of the liquid B tank 252. A cap 282 which provides a valve body 280 of the same structure as the valve 276 is screwed into the insertion portion 278. Thus, when the insertion portion 278 of the liquid B tank 252 is inserted into the liquid B insertion opening 266, the valve body 280 is pushed upward by the upward pushing pin 270 in spite of water pressure, and at the same time, the liquid B 292 flows into the liquid A containment chamber 260 of the main tank 242.

Further, a tank cover 284 (refer to FIG. 9) is provided such that that opening and closing is possible at the upper surface side of the liquid B tank 252 and of the liquid A tank 250. The tank cover 284 is structured such that by placing this tank cover 284 in an open state, the liquid A (water) 288 is supplied from a liquid A supplying opening 286 (refer to FIG. 1) and the liquid B 292 (the surfactant solution) is supplied from a liquid B supplying opening 290.

On the other hand, the fixed amount mixing tank 248 is attached to one side of a lower end portion of the tank body 254. Inside this tank body 248, a cylindrical partition wall 294, in an inserted state, is disposed so as to protrude from a lower end portion of the tank body 254. A lid 296 is fixed at a distal end portion of this partition wall 294. As a result of this structure, an inside portion of the fixed amount mixing tank 248 is divided into an outer portion space with respect to the partition wall 294 (i.e., a liquid A storage chamber 298) and an inner portion space with respect to the partition wall 294 (i.e., a liquid B storage chamber 300).

Further, a first check valve 302 and a second check valve 304 are disposed at a bottom portion of the main tank 242, specifically, at the liquid A storage chamber 298 side and the liquid B storage chamber 300 side, respectively. Further, a third check valve 306 is disposed at the lid 296. Further, at the liquid A storage chamber 298 side and the liquid B storage chamber 300 side, a breather 308 (refer to FIG. 29) and a breather 310 (refer to FIG. 30), both of which are of a check valve system and provide a check valve at a lower end portion, are respectively disposed.

Further, as is illustrated in FIG. 30, an air supplying connector 312, which is connected via the solenoid valves 356 which will be described later and a hose which is not illustrated, is disposed at the liquid A storage chamber 298 side of the fixed amount mixing tank 248. As a result of this structure, compressed air (containing ozone gas) which has been fed under pressure from a compressed air supplying portion 238, which will be described later, is fed under pressure to the inside of the liquid A storage chamber 298.

Further, a liquid supply connector 314 is provided at the liquid B storage chamber side of the fixed amount mixing tank 248. This liquid supply connector 314 is connected with a liquid flow connector 330 of the bubble generating tank 236 which will be described later, via a supplying hose 316.

Further, the water tank 246 is fixedly mounted to the lower portion side of the main tank 242, in a position that is adjacent to the fixed amount mixing tank 248. A fourth check valve 318 is disposed at a position at a bottom portion of the main tank 242 that corresponds with the position of the water tank 246. As a result of this structure, water that has flowed into the liquid A containment chamber 260 is stored inside the water tank 246 as well. Further, via a hose which is not illustrated, the water tank 246 is connected with the washing nozzles 104 for cleaning the toilet bowl.

Further, the washer tank 244 is fixedly mounted to the lower portion side of the main tank 242, in a position that is adjacent to the water tank 246. A fifth check valve 320 is disposed at a position at a bottom portion of the main tank 242 that corresponds with the position of the washer tank 244. As a result of this structure, water that has flowed inside the liquid A containment chamber 260 is stored inside the washer tank 244 as well. Further, a heater 322 for heating a washer fluid that has been stored and a temperature sensor 324 for detecting the water temperature are disposed inside the washer tank 244. Further, the washer tank 244 is connected with the washer nozzle 106 for washing the anus, via a hose which is not illustrated.

Bubble Generating Tank

As is illustrated in FIG. 30 and the like, the bubble generating tank 236 is disposed at an upper portion of the rear surface side of the toilet bowl 14. This bubble generating tank 236 provides the following: a housing body 326 of a given form that is open at the bottom side, and a housing bottom portion 328 that is fixed to a lower end portion of this housing body 326 and closes up and covers the housing body 326.

A water slope is installed at an upper end surface of the housing bottom portion 328 so that the central portion side of the housing bottom portion 328 is indented. Further, the previously mentioned liquid flow connector 330, to which the supplying hose 316 is connected, is disposed facing downward at the central portion as shown in FIG. 30. Further, a perforated plate 332 whose cross-sectional shape is a raised mountain shape is installed overhead the housing bottom portion 328. The empty space between this perforated panel 332 and an upper portion of the housing body 326 is a bubble generating chamber (bubbling chamber) 334. The liquid flow connector 330 penetrates the housing bottom portion 328; therefore, due to this liquid flow connector 330, an outer portion of the bubble generating tank 236 and the bubble generating chamber 334 communicate with each other.

Further, a pair of bubble releasing openings 336 are provided at an upper portion of the housing body 326. These bubble releasing openings 336 communicate with the duct 102 of the toilet bowl 14. Via this duct 102, the bubble releasing openings 336 provide the purifying agent 338, which is an aggregate of bubbles that contain ozone generated inside the bubble generating chamber 334, to the inside of the toilet bowl 14.

Compressed Air Supplying Portion

As is illustrated in FIGS. 1 and 4, the compressed air supplying portion 238 is provided at the upper side of a side portion of the toilet bowl 14. Specifically, as is illustrated in FIGS. 31 to 34, the structure of the compressed air supplying portion 238 includes a substantially rectangular parallelopiped-shaped air tank 340, and a compressor 344 and a motor 358 which are float-supported with elastic supporting bodies 342 loaded inside this air tank 340.

The air tank 340 provides an upper housing 346 and a lower housing 348, both of which are box-shaped. A packing 350 is interposed between the outer peripheral flanges thereof, and in this state, the upper housing 346 and the lower housing 348 are firmly joined by a bolt 352 and a nut 354. Further, a plurality of solenoid valves 356 are attached in an assembled state at the front side of the air tank 340 (refer to FIG. 4).

The compressor 344, with which the motor 358 is integrated, is built into a central portion inside this air tank 340. In other words, the present embodiment proposes and adopts an in-tank system in which the compressor 344 is disposed inside the air tank 340. An air hole 362 is formed at a motor housing 360 of the motor 358, and electric supply lines 364 of the motor 358 can be drawn out to an exterior portion via a sealing grommet 366 which is fixed to the upper housing 346.

Figure 34:
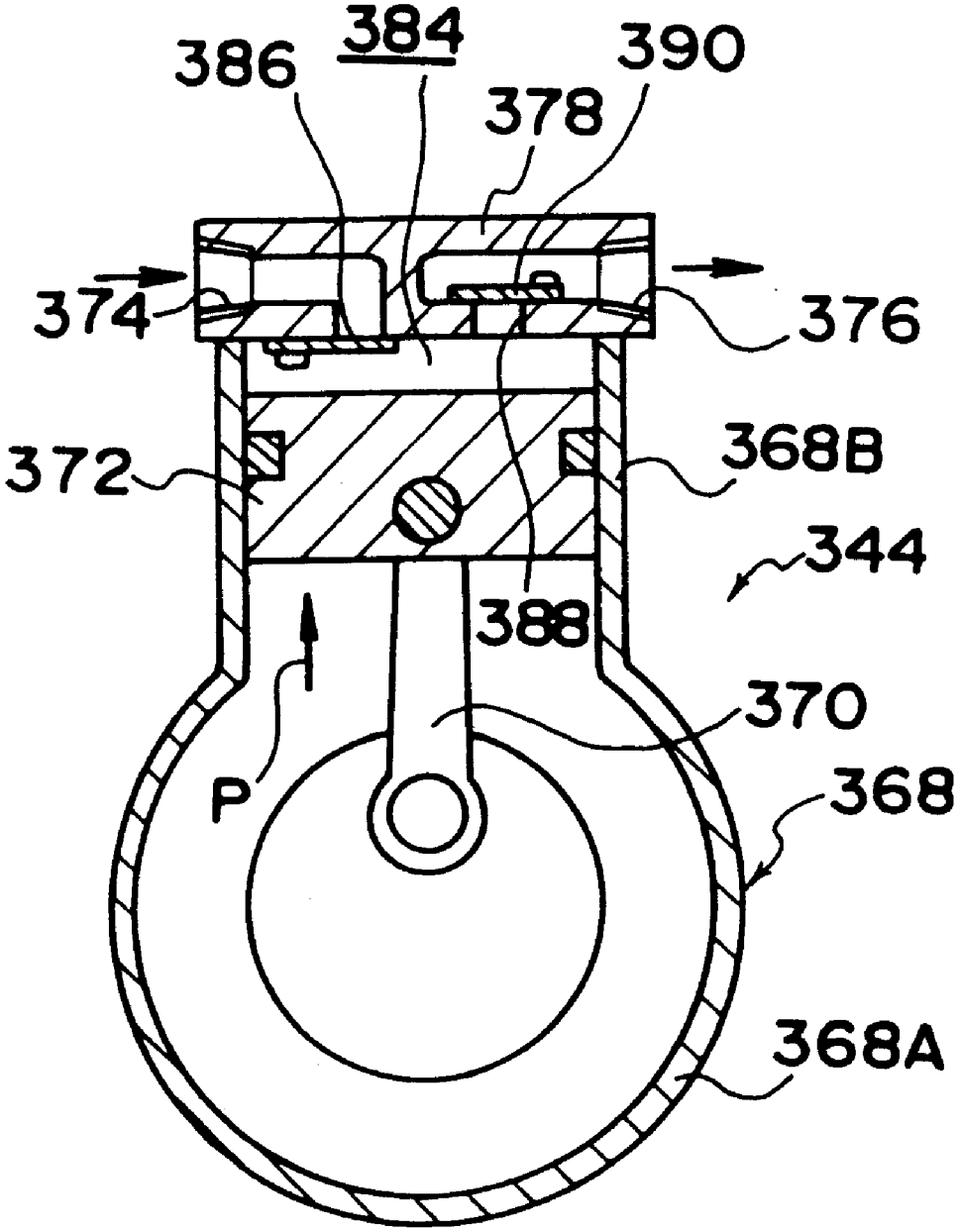
FIG. 34 is a longitudinal sectional view of a compressor utilized in the compressed air supplying portion illustrated in FIG. 31.

Further, as is illustrated in FIG. 34, the compressor 344 provides a compressor housing 368 whose structure includes a base 368A and a cylindrical cylinder portion 368B which extends from this base 368A.

A piston rod 370 which moves eccentrically due to the motor 358 driving/rotating is accommodated inside the base 368A of the compressor housing 368. Further, a piston 372 which is connected with a distal end portion of the piston rod 370 and which moves to-and-fro along an axis of the cylinder portion 368B is accommodated inside the cylinder portion 368B. Further, an air intake/exhaust port housing 378, in which an air intake port 374 and an exhaust port 376 are provided alongside each other, is attached at a distal end portion of the cylinder portion 368.

A distal end portion of the air intake port 374 is connected with an air intake filter 380 disposed at a side portion of the upper housing 346, via an air intake hose 382. Further, another distal end portion of the air intake hose 374 is made to communicate with the inside of the compressed air chamber 384, which is formed inside the cylinder portion 368B. Further, a plate spring-shaped air intake leaf valve (air intake check valve) 386, for opening and closing an open end of the other end portion of the air intake port 374, is attached at this open end of the other end portion of the air intake port 374.

On the other hand, a distal end portion of the exhaust port 376 opens to the inside of the air tank 340. Further, another distal end portion of the exhaust port 376 is covered and closed, and in its place, the side of this other distal end portion of the exhaust port 376 and the inside of the compressed air chamber 384 formed inside the cylinder portion 368B are connected, due to a connecting pore 388 formed at the air intake/exhaust port housing 378. Further, at the side of the other distal end portion of the exhaust port 376, a plate spring-shaped exhaust leaf valve (exhaust check valve) 390 is attached, for opening and closing the connecting pore 388.

Further, a compressed air supplying connector 394 and a relief valve 396 are disposed at the lower housing 348 of the air tank 340, via a joint 392. The compressed air supplying connector 394 is connected with the solenoid valves 356 via a hose which is not illustrated, and the relief valve 396 functions as a safety valve for carrying out bleeding of air in cases in which the pressure inside the tank reaches a set upper limit.

A plurality of the elastic supporting bodies 342 are loaded inside the air tank 340, and due to these elastic supporting bodies 342, the compressor 344 and the motor 358 of the above-described structure are float-supported.

The present embodiment utilizes a sponge that is of a closed-cell type rather than an open-cell type as the elastic supporting bodies 342. Further, in order to float-support the entire compressor 344 with which the motor 358 is integrated, the elastic supporting bodies 342 are appropriately fragmented when being loaded inside the air tank 340. As a result, the motor 358 and the compressor 344 are built into the air tank 340 in a state in which the motor 358 and the compressor 344 do not contact the air tank 340.

Further, in the present embodiment, a desiccant (silica gel) 398 having a characteristic of absorbing and releasing moisture is charged in the vicinity of the exhaust port 376, in the elastic supporting bodies of the above-described structure.

Other Structures

As is illustrated in FIG. 1 and the like, a manual pump 400 is disposed at the front side of the air tank 340 in the container body 12. The manual pump 400 is operated by moving a manual pump lever 78 which is disposed at the previously mentioned top wall portion 40. This manual pump 400 is disposed so as to be able to clean with wash water at least, when unable to operate the compressor 344.

Next, a method of using the technologically advanced portable toilet 10 relating to the present embodiment, and a series of operations which accompany this method will be explained.

In the beginning, a process through which the tank assembly attains a initial state will be briefly explained. First, the power switch 72 of the operating panel 76 is turned off, and together with the upper cover 32 being opened the tank cover 284 is opened. Next, the liquid A tank 250 and the liquid B tank 252, which contain sufficient amounts of the liquid A (water) 288 and the liquid B (a surfactant solution) 292, are inserted from the upper side, and are mounted at an upper portion of the main tank 242.

After mounting the liquid A tank 250 on the main tank 242, the valve body 276 which is at the liquid A tank 250 side is pushed upward and opened by the upward pushing pin 268. Accordingly, as a result of free fall that depends on self-weight, the liquid A (water) 288 inside the liquid A tank 250 flows inside the liquid A containment chamber 260 of the main tank 242. The liquid A 288 that has flowed into the liquid A containment chamber 260 flows ultilizing free fall into the liquid A storage chamber 298 of the fixed amount fall mixing tank 248, the water tank 246, and the washer tank 244, via the first check valve 302, the fourth check valve 318, and the fifth check valve 320, respectively.

Further, in cases in which the liquid A 288 has flowed inside the liquid A storage chamber 298, inner portion air therein is released into the atmosphere from the breather 308. The flow-in operation of the liquid A 288 automatically stops when the liquid level of the breather 308 and the liquid level inside the liquid A containment chamber 260 become the same. Further, at this time, the liquid A 288 stored inside the liquid A storage chamber 298 of the fixed amount mixing tank 248 does not flow into the liquid B storage chamber 300 due to the third check valve 306 being disposed. Further, the liquid A 288 stored inside the washer tank 244 is held in a state of being heated with the heater 322 at a predetermined temperature. As a result, it becomes possible to operate the washer, and the heater lamp 68 of the control panel 70 is lit with the controller 24.

On the other hand, fundamentally the same flow-in process occurs on the liquid B tank 252 side as well. Namely, after mounting the liquid B tank 252 on the main tank 242, the valve body 280 which is at the liquid B tank 252 side is pushed upward and opened by the upward pushing pin 270. Accordingly, as a result of free fall that depends on self-weight, the liquid B (a surfactant solution) 292 flows inside the liquid B containment chamber 262 of the main tank 242. The liquid B 292 that has flowed into the liquid B containment chamber 262 flows utilizing free fall into the liquid B storage chamber 300 of the fixed amount mixing tank 248 via the second check valve 304.

Further, in cases in which the liquid B 292 has flowed inside the liquid B storage chamber 300, inner portion air therein is released into the atmosphere from the breather 310. The flow-in operation of the liquid B 292 automatically stops when the liquid level of the breather 310 and the liquid level inside the liquid B containment chamber 262 become the same. Further, at this time, the liquid B 292 stored inside the liquid B storage chamber 300 of the fixed amount mixing tank 248 does not flow into the liquid A storage chamber 298 due to the third check valve 306 being disposed.

Further, even in cases in which either the liquid A 288 previously contained inside the liquid A tank 250 or the liquid B 292 previously contained inside the liquid B tank 252 is gone, the no-liquid lamp 64 of the control panel 70 is lit by the controller 24, and it becomes known that the liquid is gone.

After the tank assembly 234 attains the initial state in the above-described manner, the tank cover 284 and the upper cover 32 is closed again. Thereafter, the technologically advanced portable toilet 10 in accordance with the present embodiment is used in a manner stated hereinafter, and a series of operations are carried out.

First, a user removes the anchoring pawl 86 of the upper cover 32 from the engagement portion 88 provided at the container body 12 side, and disengages them. When the upper cover 32 is opened, the fact that the upper cover 32 has been opened is detected by the upper cover detection sensor 90 and outputted to the controller 24. As a result, the controller 24 causes the purifying agent producing/supplying means 22 to operate. Namely, control over supplying the purifying agent 338, which is an aggregate of bubbles containing ozone and which will be described later, is carried out.

The controller 24, in order to cause the ozone producing mechanism 232 and the compressed air supplying portion 238 to operate, provides electricity to the ozone producing mechanism 232 and the motor 358, and energizes the solenoid valves 356. As a result, ozone gas is produced, the compressor 344 receives the driving force of the motor 358 and operates, and air from exterior portions is drawn in through the air intake port 374 and compressed inside the compressed air chamber 384. Thereafter, the compressed air is expelled through the exhaust port 376. The compressed air that is expelled is fed under pressure, together with the ozone gas, via a hose that is not illustrated and the air supplying connector 312, into the liquid A storage chamber 298.

As a result, the third check valve 306, which forms a division between the liquid A storage chamber 298 and the liquid B storage chamber 300 of the fixed amount mixing tank 248, is released due to rising pressure, and the liquid A 288 stored inside the liquid A storage chamber 298 flows inside the liquid B storage chamber 300. The liquid A (water) 288 that has flowed into the liquid B storage chamber 300 mixes with the liquid B (a surfactant solution) 292 stored inside the liquid B storage chamber 300. Further, at this time, the mixing ratio of the liquid A 288 and the liquid B 292 is uniformly determined based on the volume ratio of the liquid A storage chamber 298 and the liquid B storage chamber 300.

The mixed solution of the fixed amounts (fixed ratio) of the liquid A 288 and the liquid B 292 that was mixed inside the liquid B storage chamber 300 flows from the liquid supply connector 314 disposed inside the liquid B storage chamber 300, via a supplying hose 316, through a liquid flow connector 330 disposed at a lower end portion of the bubble generating tank 236, and into the bubble generating chamber (bubbling chamber) 334. In this manner, even after the liquid A 288 stored inside the liquid A storage chamber 298 and the liquid B 292 stored inside the liquid B storage chamber 300 are completely mixed to become a mixed solution and the mixed solution is delivered to the bubble generating chamber 334, compressed air continues to be delivered, and thus bubbling occurs in the bubble generating chamber 334. As a result, the purifying agent 338, which is an aggregate of ozone-containing bubbles, is generated.

A supplementary explanation regarding these ozone-containing bubbles will be given hereinafter. As described by the supplementary diagram in FIG. 30, the structure of the ozone-containing bubbles comprises a film in which ozone is dissolved, and a gas containing ozone that is surrounded by this ozone-containing film.

Further, while the compressed air is being delivered, the first check valve 302, the second check valve 304 and the breathers 308 and 310 are maintained in a closed state, and therefore, the liquid A 288 and the liquid B 292 do not flow into the liquid A storage chamber 298 and the liquid B storage chamber 300.

The purifying agent 338 produced in the above manner passes through the perforated plate 332 and is delivered from the pair of bubble releasing openings 336 to the inside of the duct 102, which encircles an upper end portion of the toilet bowl 14. The purifying agent 338 is discharged into the toilet bowl 14 through purifying agent discharging openings, which are not illustrated and are formed at the inner side of the duct 102. The toilet bowl 14 is filled with a predetermined amount of the purifying agent 338. The process of supplying the purifying agent 338 takes a predetermined amount of time.

Further, when the solenoid valves 356 are de-energized by the controller 24 after the purifying agent 338 has been produced and supplied, compressed air is no longer supplied to the inside of the fixed amount mixing tank 248. As a result, the first check valve 302, the second check valve 304, and the breathers 308 and 310 are opened again, and the liquid A 288 and the liquid B 292 again flow into the liquid A storage chamber 298 and the liquid B storage chamber 300, respectively, in preparation for the next use.

After this state is attained, the user sits on the toilet seat 30 and relieves him or herself. Incidentally, at this time, the seat is comfortable since the toilet seat 30 is made from a spongy resin material with a cushioning property. If the user pushes the washer switch 62 on the control panel 70, washer fluid is ejected from the washer nozzle 106, and the anus is washed. Further, when the paper lid panel 50 is opened, the toilet paper 52 held in the paper holder 54 can be used.

The waste and the like that has accumulated inside the toilet bowl 14 is covered with the purifying agent 338 to extinguish odors. More specifically, by being covered by the purifying agent 338, which is an aggregate of ozone-containing bubbles, the diffusion path of the waste odors is intercepted, and diffusion of these odors is prevented. Further, when the ozone-containing bubbles defoam, the ozone-containing film of the ozone-containing bubbles becomes ozone water, which has an effect of extinguishing odors and killing germs, adheres to and seeps into the wastes. As a result, killing germs and extinguishing odors in the wastes is carried out. Further, when each of the ozone-containing bubbles is burst, the ozone-containing gas surrounded by the ozone-containing film is released and diffused inside the toilet bowl 14. As a result, even the odors that have already been released by the wastes are extinguished by this ozone-containing gas.

Thereafter, in the same state or after the user has closed the upper cover 32, when the cleaning switch 60 of the control panel 70 is pushed, the solenoid valves are energized by the controller 24, the shutter means 18 is operated, and the toilet bowl 14 is washed with the wash water.

Specifically, when the solenoid valves are energized by the controller 24, water from the water tank 246 is jetted from the washing nozzles 104. Thus, the inside of the toilet bowl 14 is washed. Simultaneously with this washing, the cassette shutter driving cylinder 178 of the shutter means 18 is driven, and the shutter driving pin 176 is rotated via the rotary actuator 180. As a result, the shutter plate 168, which was in a closed position (the position indicated by the solid lines in FIG. 15), is swung to an open position (the position indicated by the double-dashed chain line in FIG. 15), and the wastes and the wash water flow together into the cassette 16.

After a predetermined amount of time has passed, the shutter plate 168 is moved from the open position back to a closed position by the controller 24. At this time, a protruding portion of solid components of the wastes is made level by the smoothing tools 172 provided at the shutter plate 168 (refer to FIG. 21). Further, since a smoothing operation is carried out by the smoothing tools 172 each time the technologically advanced portable toilet 10 is used, the volumes of solid and liquid components of the wastes are stabilized. Since the volume of the wastes inside the cassette 16 is constantly detected by the level indicators 116, the cassette full water level lamp 66 of the control panel 70 is lit by the controller 24 when the wastes contained inside the cassette 16 reaches a high water level.

When the cassette full water level lamp 66 is lit, it is necessary to dump the wastes contained inside the cassette 16. Accordingly, as the next step, the cassette 16 is separated from a lower end portion of the toilet bowl 14 and removed from the container body 12. Thereafter, a waste-dumping operation and a washing operation of the cassette 16 are carried out.

First, when opening the cassette lid panel 48, the rotary actuator 180 is operated again by the controller 24, and the opening/closing operation of the shutter 140 is carried out for a moment. As a result, water drops and the like accumulated on the shutter plate 168 are collected inside the cassette 16, and inside portions of the container body 12 are not dirtied when the cassette 16 is being removed from the container body 12.

Similar to the aforementioned, when the cassette lid panel 48 is opened, the sleeve driving means 188 is mechanically operated. Namely, the second raising/lowering link 218, which is connected to the cassette lid panel 48, is swung as it lowers, and simultaneously the first raising/lowering link 216, which is connected with this second raising/lowering link 218, is lowered. As a result, the joint lever 208 is swung to the lower side about the connecting shaft 210 as the axis, causing the connecting shaft 210 to rotate along an axis. Accordingly, the connecting body 198, which is fixed to the connecting shaft 210, is swung about the connecting shaft 210 as the axis, and the sleeve 186 held at the connecting body 198 is raised to a raised position. Thus, the sub-sleeve 194, which forms a lower side of the sleeve 186, is removed from the waste receiving opening 138 of the cassette 16. As a result, it becomes possible to remove the cassette 16.

Figure 18:
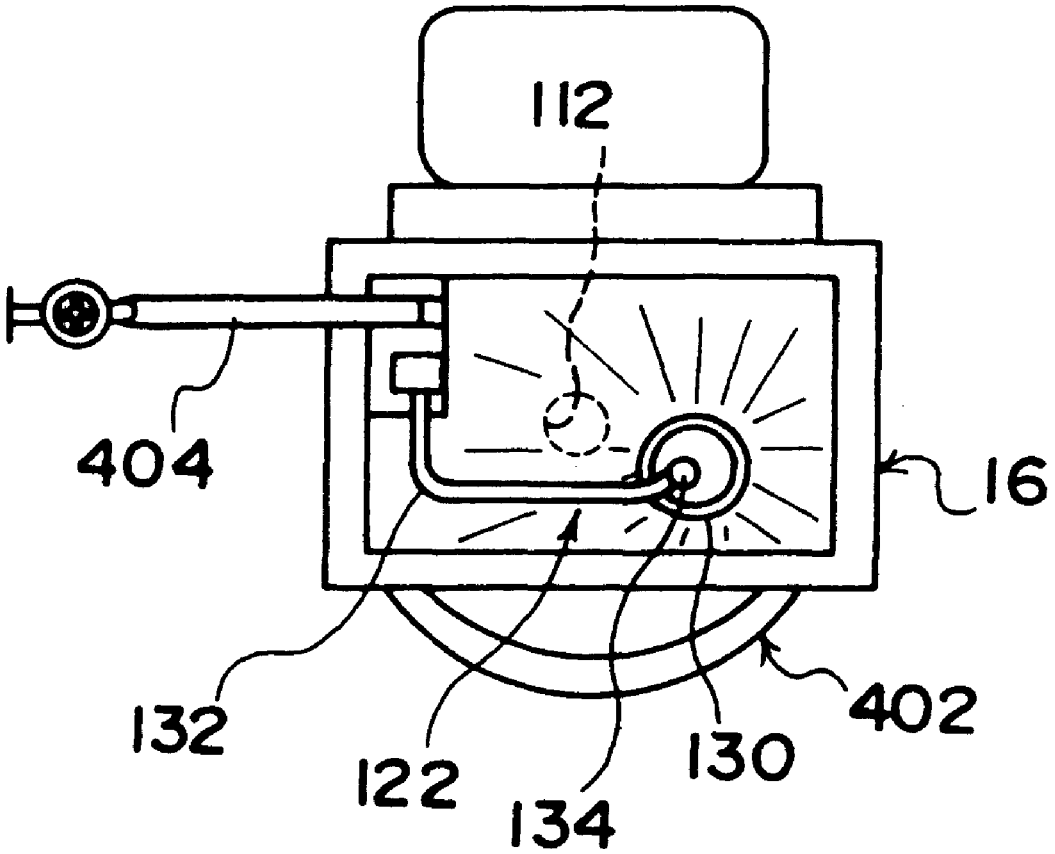
FIG. 18 is a schematic plan view illustrating a state of cleaning utilizing the cassette cleaning means illustrated in FIG. 17.
Figure 19:
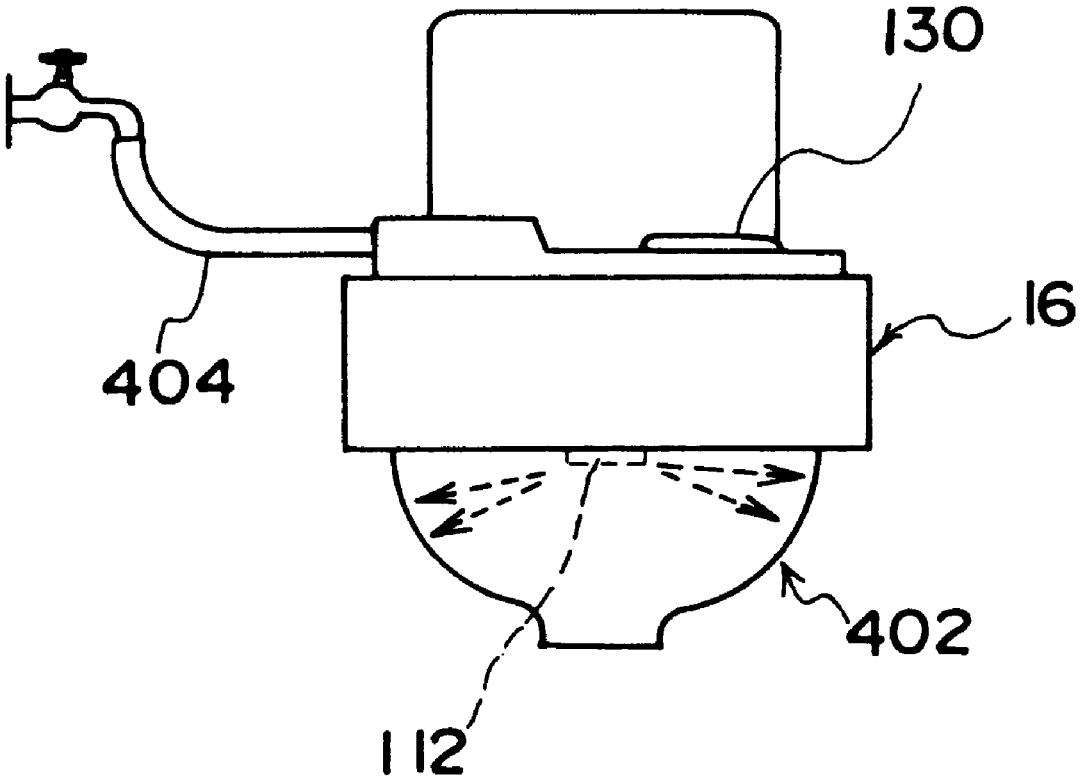
FIG. 19 is a schematic front view likewise illustrating the state of cleaning utilizing the cassette cleaning means.
Figure 20:
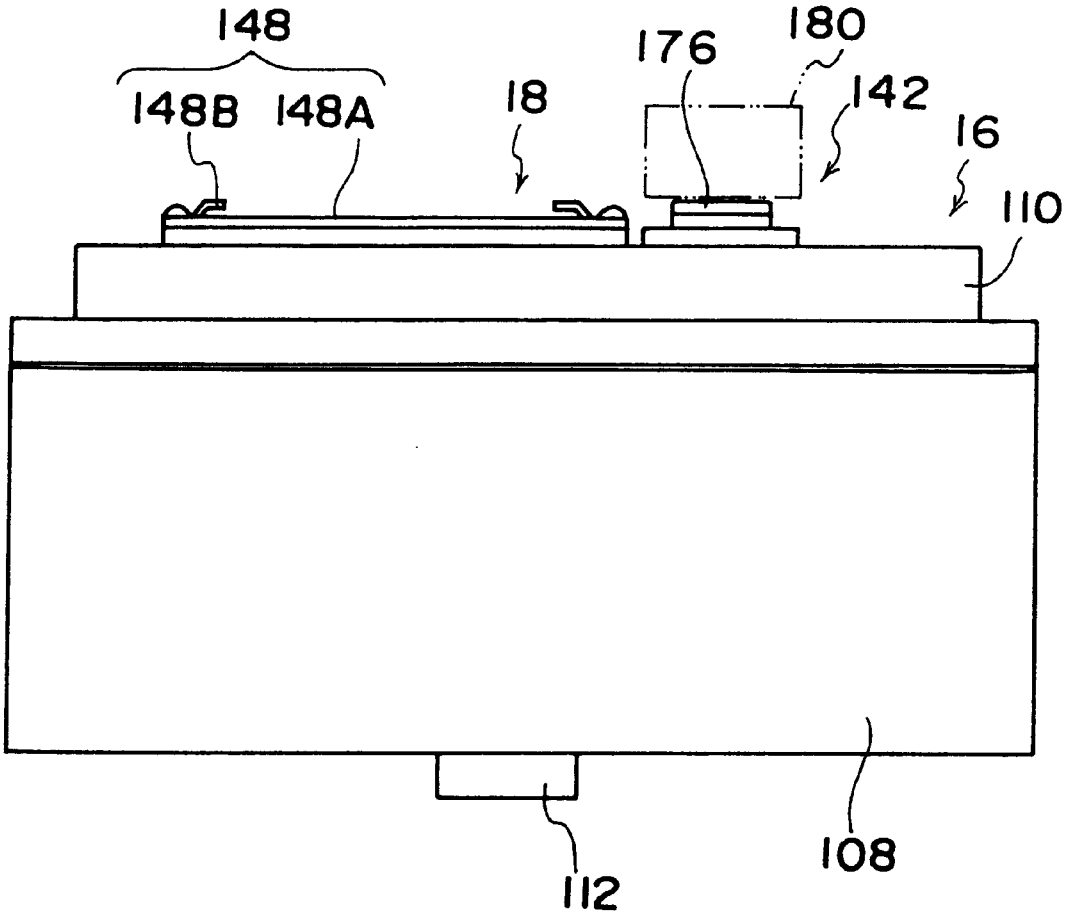
FIG. 20 is a side view of the cassette for storing waste illustrated in FIG. 15 as seen from the shutter means side.

Next, the cassette 16 is removed from the container body 12, and as is illustrated in FIGS. 18 and 19, is mounted on a Western-style toilet bowl 402. After mounting the cassette 16 on the Western-style toilet bowl 402, the water supply cap 130 attached to the cassette upper portion 110 is removed and is attached to the waste receiving opening 138. At this time, if the water supply cap 130 is rotated a predetermined amount, the water supply cap 130 is locked, due to a plurality of lock pawls 148B of the lock plate 148. Next, a water faucet and the coupler 124 are connected with a hose 404.

After carrying the above operations, the cassette opening/closing lever 114 is swung. As a result, the waste discharging opening 112 is opened by an opening/closing means which is provided at the lower end portion of the cassette 15 and which is not illustrated, and the wastes and the like collected inside the inner portion are vigorously dumped into the Western-style toilet bowl 402.

Thereafter, when the water faucet is turned on, water from the water faucet is delivered to the inside of the water chamber 152, which is formed between the shutter plate 168 and the bottom surface of the water supply cap 130, via the coupler 124, the hose 126, the joint 128 for cleaning, the hose 132, and the cap-side joint 134.

When the water pressure inside the water chamber 152 exceeds a predetermined value, the shutter plate 168 is displaced while being elastically deformed, and a ring-shaped space (clearance) is formed between outer peripheral portions of this shutter plate 168 and the bases 156A of the shutter lock springs 156. Then, the water from the water faucet that is inside the water chamber 152 is jetted from this space, around the entire 360 degree periphery thereof. As a result, wastes and the like adhering to the inside wall surface of the cassette 16 are cleanly washed off, and are discharged from the waste discharging opening 112 into the Western-style toilet bowl 402.

After finishing the above cleaning operation of the inside of the cassette 16, the cassette opening/closing lever 114 is swung back to the original position, covering the waste discharging opening 112, and the water supply cap 130 is reattached to the set position on the cassette upper portion 110. Then, the cassette 16 is mounted again inside the container body 12, and the cassette lid panel 48 is closed. When the cassette lid panel 48 is closed, the sleeve driving means 188 carries out a reverse operation of the aforementioned opening movements, the cassette 16 and the toilet bowl 14 are placed in a connected state, and a series of operations comes to an end.

Next, an explanation of effects of the technologically advanced portable toilet 10 relating to the present embodiment will be given, based upon the above explanation of a series of operations.

Basic Effects of Technologically Advanced Portable Toilet

The present embodiment is of a structure which provides a purifying agent producing/supplying means 22 inside the container body 12, and which supplies a purifying agent 338, formed as an aggregate of ozone-containing bubbles, to the inside of the toilet bowl 14 upon the upper cover 22 being opened. Therefore, it is possible to obtain a good effect in terms of extinguishing odors.

It is possible to obtain a very good effect in terms of extinguishing odors since, in particular: the purifying agent 338 used in the present embodiment intercepts the path of diffusion of the odors of the waste products as previously mentioned; extinguishing odors and killing germs of the waste products are carried out as ozone water produced by defoaming adheres to and seeps into the waste products; and odors that were already released are extinguished with the ozone-containing gas released during defoaming.

Further, in the present embodiment, as previously mentioned, preparation for extinguishing odors with the purifying agent 338 is carried out before the user excretes wastes, due to the fact that the purifying agent producing/supplying means 22 is made to operate with the controller 24 when the upper cover 32 is opened, and the purifying agent 338 is supplied for a predetermined amount of time. Therefore, it is possible to obtain an effective odor-extinguishing operation.

Effects of Tank Assembly

In the present embodiment, the tank assembly 234 is proposed, which comprises a plurality of tank complexes and which produces the purifying agent 338 which is an aggregate of ozone-containing bubbles. Namely, a structure was adopted in which mixing is carried out based on a fixed volume (ratio) in the fixed amount mixing tank 248, utilizing the liquid A 288 and the liquid B 292 each falling due to its own weight. Therefore, it is possible to carry out mixing of fixed amounts (ratio) of the liquid A 288 and the liquid B 292 in a stable and efficient manner. As a result, in accordance with the present embodiment, irregularities in the quality of the purifying agent 338 can be prevented.

Further, since complicated structures are not necessary in actualizing mixing of fixed amounts with the tank assembly 234, it is possible to simplify the structure and to decrease the danger of the apparatus malfunctioning.

Effects of Compressed Air Supplying Portion

The air tank 340, the compressor 344 (and the motor 358) conventionally would have been provided separately. However, in the present embodiment, the elastic supporting bodies 342 are loaded into the air tank 340, and due to these elastic supporting bodies 342, the compressor 344 and the motor 358 are float-supported such that a non-contact state with regard to wall surfaces of the air tank 340 is achieved. Therefore, it is possible to decrease remarkably operating noise of the compressor 344 and the motor 358 that leaks into exterior portions.

Figure 35:
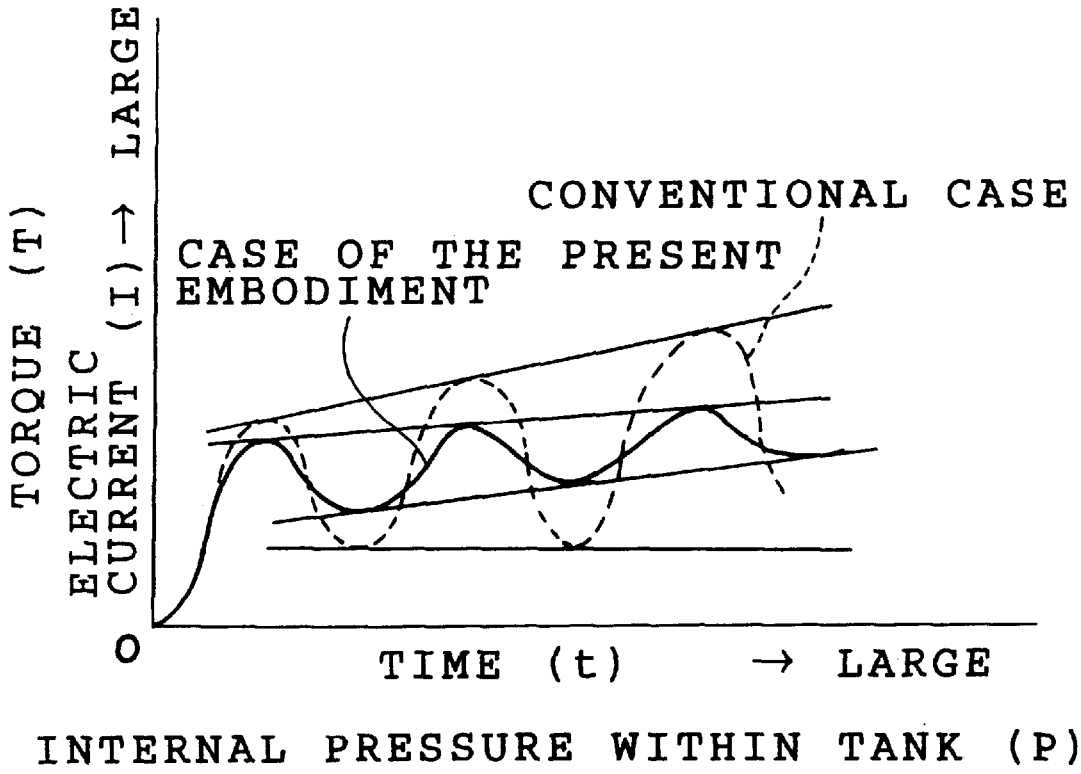
FIG. 35 is a graph explaining an effect resulting in cases in which the compressed air supplying portion illustrated in FIG. 31 was utilized.

More specifically, 1) by housing the compressor 344 and the motor 358 in the air tank 340 (built-in), the operating noise of the compressor 344 and the motor 358 is made to be in a closed condition by the upper housing 346 and the lower housing 348, and it is possible to insulate sound.
2) Since the compressor 344 and the motor 358 are float-supported by the elastic supporting bodies 342, it is possible to prevent the operating noise of the compressor 344 and the motor 358 from being directly transmitted to the upper housing 346 and the lower housing 348.
3) By having the compressor 344 and the motor 358 built into the air tank 340, internal pressure P increases during operation. However, since this internal pressure P (refer to FIG. 34) works in a direction that compresses the piston 372 in the compression process, current peaks become smaller as shown in FIG. 35. On the other hand, in the air intake process, the internal pressure P resists the movement of the piston 372 towards the air intake side. Therefore, current troughs become higher in the air intake process. Accordingly, the difference between current peaks and current troughs is small in comparison with that of conventional structures, and therefore, torque fluctuation (vibration) becomes extremely small. Thus, undesired sounds, such as those generated by mechanical system backlash or the like, are reduced as well.

In accordance with the present embodiment, the above operations/effects 1) to 3) work in combination, and it is possible to reduce remarkably leakage of operating noise of the compressor 344 and the motor 358 into exterior portions in the above manner.

Further, in accordance with the present embodiment, it is possible to reduce dead space by building the compressor 344 and the motor 358 into the air tank 340. This effect is extremely significant in terms of the quality of the technologically advanced portable toilet 10. Further, since the inside of the housing of the motor 358 communicates with the exterior via the air hole 362 of the motor 358, it is possible to utilize the space of the inner portion of the housing of the motor 358 as part of the capacity of the air tank 340. Accordingly, this structure also contributes to efficient use of space in a relatively small area.

In the present embodiment, an open-cell type sponge (a sponge wherein the cells communicate with each other from the surface to inner portions) is used, rather than a closed-cell type sponge (a sponge having closed (isolated) cells). Therefore, the form of the elastic supporting bodies 342 hardly changes, and it is possible to preserve well the performance of float-supporting the compressor 344 and the motor 358.

Namely, when using a closed-cell type sponge, there is a possibility of changing the shape of the sponge itself due to a fluctuation in internal pressure, incurring a decrease in supporting performance. In contrast, when using an open-cell type sponge, since the cells inside the sponge are connected with exterior portions, there is no possibility of being influenced by a fluctuation in internal pressure, and the form of the elastic supporting bodies 342 will not change due to such an influence. Accordingly, excellent supporting performance can always be ensured. Further, since the volume of the sponge in terms of effective volume is small, it does not influence the size of the tank body, and the tank body can be made compact.

Since the compressor 344 and the motor 358 are built into the air tank 340, during operation the compressor 344 and the motor 358 generate heat. As a result, the temperature inside the air tank 340 repeatedly rises and returns to room temperature during operation, depending upon the operating condition. Accordingly, it becomes difficult for condensation inside the air tank 340 to occur. As a result, in accordance with the present embodiment, it is possible to prevent the air tank 340 from rusting and to prevent water drops from being mixed in the air that is expelled from the exhaust port 376.

In the present embodiment, it is possible to make it even more difficult for condensation to form, by disposing the desiccant 398 having a characteristic of absorbing and releasing moisture inside the air tank 340 in the elastic supporting bodies 342 (in the vicinity of the exhaust port 376). Accordingly, sufficient durability may be expected, even when using the motor 358 having a moderate price.

Effects of Shutter Means

In the present embodiment, the shutter means 18 is disposed, which precisely closes or opens as is necessary the waste receiving opening 138 with the shutter 140 which is swung by the shutter driving portion 142. Therefore, the purifying agent 338 does not leak into the cassette 16, and accumulation thereof on top of the shutter plate 168 is possible. As a result, it is possible to extinguish odors and kill germs reliably, using the purifying agent 338.

Further, in the present embodiment, the smoothing tools 172 is provided at the shutter plate 168, to even out solid components inside the wastes that have accumulated inside the cassette 16. Therefore, it is possible to prevent the occurrence of discrepancies between the volume detected by the level indicators 116 and the actual volume of wastes.

Figure 21:
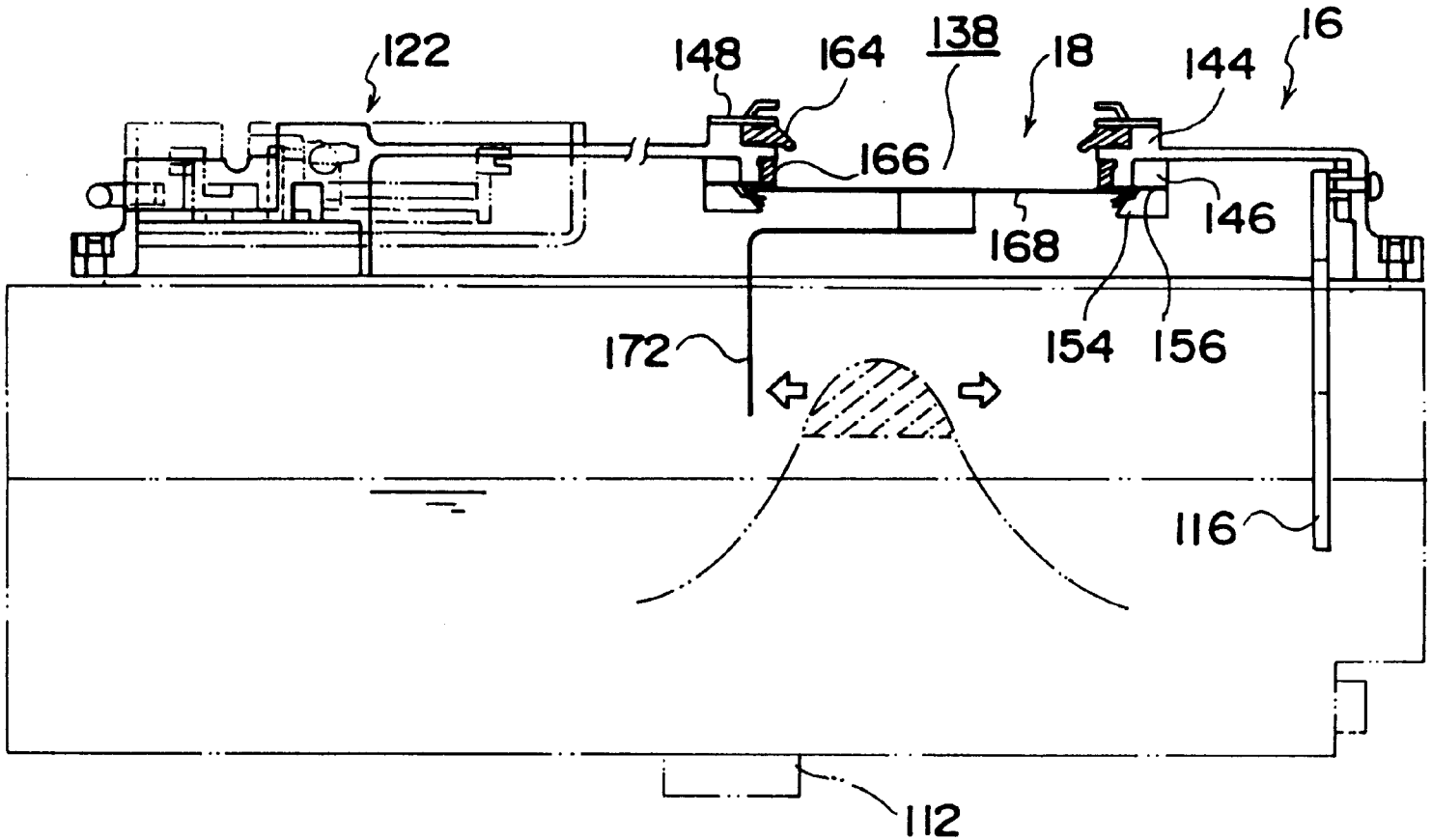
FIG. 21 is a schematic longitudinal sectional view illustrating, as the focus, the shutter means illustrated in FIG. 15 and level indicators.

Namely, when wastes are stored inside the cassette 16, the solid components and the liquid components separate normally. More specifically, as is illustrated by FIG. 21, a portion of the solid components protrudes from the liquid components. As a result, the volume detected by the level indicators 116 may be less than the actual volume of wastes, and although the controller 24 determines that it is possible to store more wastes, in actuality the cassette 16 may not be able to store more wastes. Further, if the solid components and the liquid components separate, when removing the cassette 16 from the container body 12 and disposing the wastes there is a disadvantage of disposal being difficult.

However, in the present embodiment, due to the swinging movement of the smoothing tools 172 which accompanies the swinging operation of the shutter plate 156, the solid components in the wastes are evened out (agitated), and the solid components and the liquid components are mixed, becoming substantially homogeneous. Thus, the level (height) of the wastes stored inside the cassette 16 is equalized, and a discrepancy between the detected volume and the actual volume of wastes can be prevented from occurring. As a result, it is possible to improve reliability with respect to storing wastes in the cassette 16.

Further, since the wastes stored inside the cassette 16 are in a state wherein the solid components and the liquid components are mixed to become substantially homogeneous, during disposal, it is easy to dispose of the wastes, and wastes are not likely to remain.

Effect of Cassette Cleaning Means

In the present embodiment, the water supply cap 130 and the like is disposed at the cassette upper portion 110, and during disposal of the wastes, the water supply cap 130 is attached to the waste receiving opening 138 such that the water chamber 152 is formed between the shutter plate 168 and the water supply cap 130, wherein the elastic displacement of the shutter plate 168 is utilized to jet water from the entire 360 degree periphery thereof. Due to this, carrying out operations such as shaking the cassette 16 by hand in order to clean the soilage adhered to the inside of the cassette 16 becomes unnecessary. As a result, it is possible to improve to a remarkable degree the cleaning operation property of inner portions of the cassette 16.

Effect of Connecting Means

In the present embodiment, the connecting means 20 is proposed, which connects or separates the lower end portion of the toilet bowl 14 and the cassette 16 by linking with the opening/closing operation of the cassette lid panel 48, utilizing the cassette-system cassette 16 as a waste containment tank. Thus, it is possible to eliminate the labor of attaching/detaching the lower end portion of the toilet bowl 14 and the cassette 16. As a result, it is possible to improve greatly the attachment/detachment operation property of the lower end portion of the toilet bowl 14 and the cassette 16.

Effects of Toilet Seat

In the present embodiment, the toilet seat 30 is formed with a resin material in a spongy state with a cushioning property and a predetermined degree of hardness. By completely closing the upper cover 32, the entire periphery of the upper surface of the toilet seat 30 adheres (seals) to the reverse surface of the upper cover 32 due to its elastic restoring force, so it is possible to prevent odors from inside the toilet bowl 14 from leaking into exterior portions. Namely, it is possible to obtain a deodorizing effect.

Further, as the toilet seat 30 has a cushioning property, it is possible to improve seated comfort of the user, and the technologically advanced portable toilet 10 imparts a feeling of luxury. Due to the same reason, the strain on the user's buttocks is lightened, and so it is possible to obtain an effect wherein the user does not tire even after sitting for a relatively long time. Also, for the same reason, it is possible to obtain a sensation of warmth at low temperatures, even without a toilet seat heater.

Since the toilet seat 30 has a cushioning property, i.e., resiliency, in a case in which a person inadvertently sits or stands on the upper cover 32 in a closed position, it is possible to prevent the upper cover 32 from breaking easily.

Further, since a completely sealed condition is obtained between the toilet seat 30 and the upper cover 32, there is a merit wherein wastes do not spill into exterior portions even in the event of the technologically advanced portable toilet 10 tipping over.

Variation in Structure

Next, variation in the structure and the like in each of the structural elements will be explained.

Regarding Purifying Agent Producing/Supplying Means

In the present embodiment, a structure is adopted wherein the purifying agent 338, which is formed as an aggregate of ozone-containing bubbles, is supplied to the inside of the toilet bowl 14. However, possible structures are not limited to the above, and any purifying agent formed as an aggregate of bubbles having an odor-extinguishing effect may be applied.

Further, in the present embodiment, a structure is adopted wherein the purifying agent 338 is supplied to the inside of the toilet bowl 14. However, possible structures are not limited to the above. A structure may be adopted wherein the purifying agent 338 is supplied to the inside of the cassette 16, or wherein the purifying agent 338 is supplied to both the inside of the toilet bowl 14 and the inside of the cassette 16.

In the present embodiment, a method is adopted wherein the liquid A 288 and the liquid B 292 is mixed in fixed amounts with the tank assembly 234, compressed air including ozone gas is fed under pressure into the fixed amount mixing tank 248 with the compressed air supplying portion 238, the purifying agent 338, as an aggregate of ozone-containing bubbles, is made as a result of bubbling in the bubble generating tank 236 and then the produced purifying agent 338 is supplied to the inside of the toilet bowl 14. However, possible methods are not limited to the above. A method may be adopted wherein after the purifying agent 338 which is an aggregate of ozone-containing bubbles is supplied to the inside of the toilet bowl 14, namely, after the mixed solution of the liquid A 288 and the liquid B 292 is used up, ozone gas by itself is supplied to the inside of the toilet bowl 14. By adopting the above-stated method, it is possible to increase the effect of extinguishing odors still further, since the odor-extinguishing effect of ozone gas is sustained even after the delivery of the purifying agent has finished.

In the present embodiment, the purifying agent producing/supplying means 22 is formed as a single circuit. However, possible structures are not limited to the above. It is possible to form a two-system circuit wherein an ozone gas delivery system and a fixed amount mixed solution delivery circuit are independent. In other words, a structure may be adopted wherein rather than delivering ozone gas to the fixed amount mixing tank 248, the mixed solution is delivered with compressed air, via the fixed amount mixed solution delivery circuit, and ozone gas by itself is delivered from the time when bubbling begins, via the ozone gas delivery circuit.

Regarding Compressed Air Supplying Portion

In the present embodiment, a structure is adopted wherein the elastic supporting bodies 342 are loaded inside the air tank 340, and the compressor 344 and the motor 358 are float-supported. However, possible structures are not limited to the above. It is possible to apply any structure capable of float-supporting the compressor 344 and the motor 358 inside the air tank 340.

For example, a structure may be adopted wherein a rubber mount is disposed at a plurality of positions as an elastic supporting body, and the compressor 344 and the like are float-supported by these rubber mounts. Further, the concept of the elastic supporting body includes both bias means such as a spring and the like, as well as resin bodies such as rubber, sponge and the like.

Regarding Shutter Means

Figure 36A:
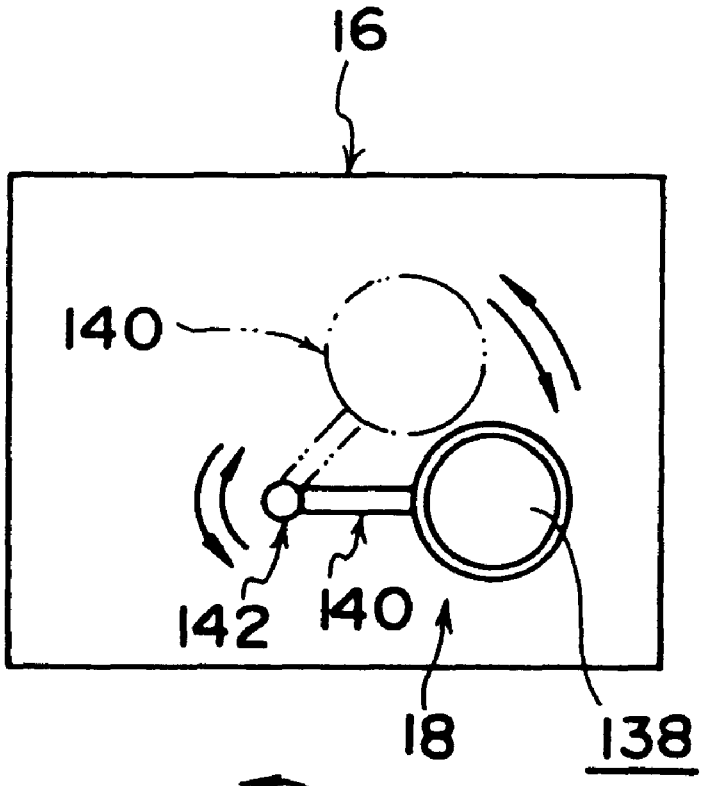
FIG. 36A is a plan view schematically illustrating a swinging movement of the shutter means in the preferred embodiment.
Figure 36B:
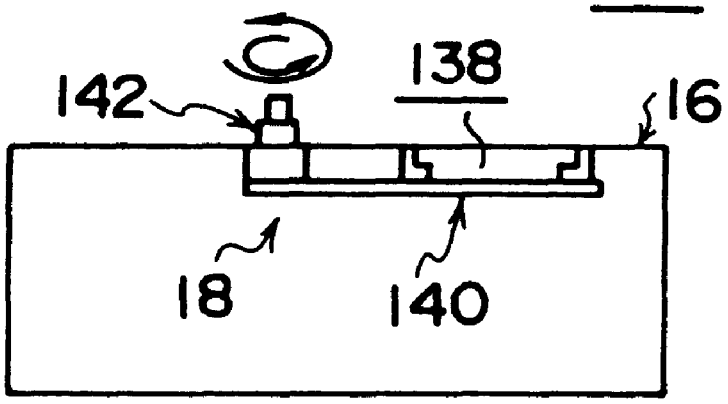
FIG. 36B is a side view thereof.
Figure 37A:
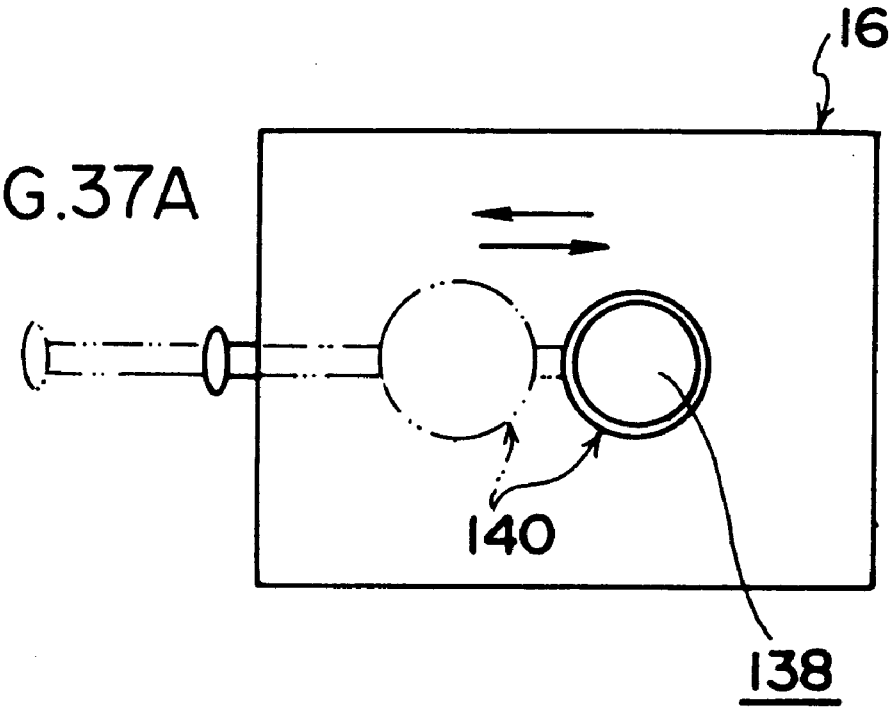
FIG. 37A is a plan view schematically illustrating a sliding movement of a modified shutter means.
Figure 37B:
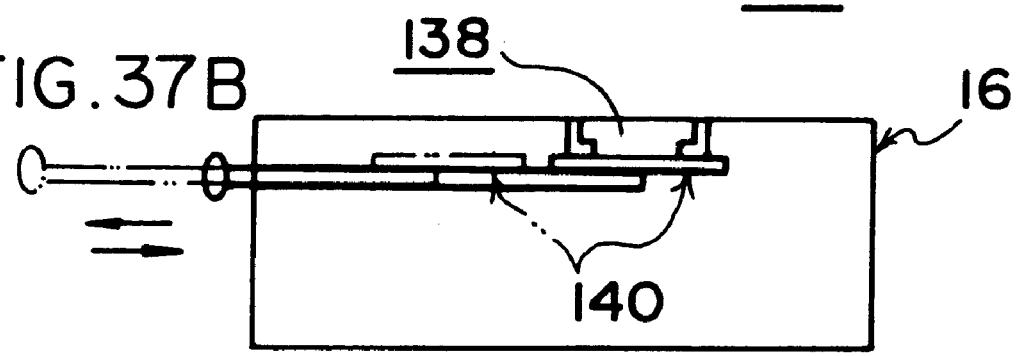
FIG. 37B is a side view thereof.

In the present embodiment, as illustrated in FIGS. 36A and 36B, a method may be adopted wherein the shutter 140 is swung by driving the shutter driving portion 142, thereby opening/closing the waste receiving opening 138. However, possible structures are not limited to the above. As illustrated in FIGS. 37A and 37B, a method may be adopted wherein the waste-receiving opening 138 is opened/closed by sliding the shutter 140. Further, in this case, it is possible to adopt a structure of a rack and pinion type or the like as the shutter driving portion that slides the shutter 140.

In the present invention, a shutter means 18, which has a relatively elaborate structure including the shutter driving porion 142 and the shutter 140, has been adopted. However, possible structures are not limited to the above and a simpler structure may be provided. For example, a shutter means formed as a rubber sleeve having a plurality of slits therein may be disposed at the waste receiving opening 138.

The shutter means 18 is disposed in the present embodiment. However, possible structures are not limited to the above. A structure may be adopted wherein a shutter means is not used. In this case, it is preferable to undertake measures such as slightly curving a lower end portion of the toilet bowl 14, or the like. Even with undertaking such measures, if a shutter means is not disposed, in accordance with the present embodiment, it is possible to obtain an odor-extinguishing effect as it is.

Regarding Toilet Seat Cover

In the present embodiment, the upper cover 32 which is a toilet seat cover is provided such that rotation with respect to the container body 12 is possible. However, possible structures are not limited to the above. The upper cover 32 may be provided so as to be attachable/detachable with respect to the container body 12.

What is claimed is:

1. A technologically advanced portable toilet comprising:

a toilet bowl in the form of a bowl, disposed inside a container body and having a lower end portion formed as an aperture;

a toilet seat disposed at an upper end side of the toilet bowl inside the container body;

a toilet seat cover provided at the container body, said toilet seat cover being either rotatable or attachable/detachable and able to close or open the toilet seat by rotation or attachment/detachment;

a waste storage tank disposed at a lower side of the toilet bowl inside the container body, said waste storage tank communicating with said toilet bowl; and purifying agent producing/supplying means provided inside the container body, said means producing a purifying agent formed as an aggregate of bubbles having an odor extinguishing effect and supplying said purifying agent to at least one of an inside of said toilet bowl and an inside of said waste storage tank, wherein said bubbles are ozone-containing bubbles comprising an ozone-containing film wherein ozone is dissolved inside the film, and an ozone-containing gas enclosed inside this ozone-containing film.

2. A technologically advanced portable toilet according to claim 1 wherein said purifying agent producing/supplying means is formed so as to comprise:

a tank assembly that mixes fixed amounts of each of a plurality of types of liquids necessary for producing said bubbles; and a compressed air supplying portion for supplying compressed air to this tank assembly.

3. A technologically advanced portable toilet according to claim 2, wherein said compressed air supplying portion comprises:

an air tank; and a compressor that is float-supported inside said air tank, by being elastically supported inside said air tank.

4. A technologically advanced portable toilet according to claim 3, wherein said air tank further comprises a built-in motor, and by providing an air hole in a housing of the motor, space inside said housing is made to communicate with space outside said housing.

5. A technologically advanced portable toilet according to claim 3, wherein a desicant having a characteristic of absorbing and releasing moisture is disposed inside said air tank.

6. A technologically advanced portable toilet according to claim 3, wherein elastic supporting bodies for elastically supporting said compressor and said motor are further included inside said air tank and as this elastic supporting body, an open-cell type sponge, wherein cells communicate with each other from a surface of said sponge toward an interior portion thereof, is used.

7. A technologically advanced portable toilet according to claim 2, wherein said bubbles are formed by utilizing compressed air supplied from said compressed air supplying portion, to mix ozone gas with a surfactant solution which is produced with said tank assembly.

8. A technologically advanced portable toilet according to claim 1, further comprising:

a shutter provided so as to be movable with respect to a closed position wherein a communicating passage of said toilet bowl and said waste storage tank is obstructed, and to an open position wherein said communicating passage is not obstructed, said purifying agent being supplied to the inside of the toilet bowl.

9. A technologically advanced portable toilet according to claim 8, wherein smoothing tools for evening wastes stored inside the waste storage tank are provided at said shutter.

10. A technologically advanced portable toilet according to claim 8, further comprising cleaning means for cleaning said waste storage tank, said shutter being disposed in the vicinity of a waste receiving opening provided at an upper portion of the waste storage tank, such that said cleaning means, when mounted at said waste receiving opening, forms a water chamber between itself and said shutter, and an opening is formed due to the shutter being elastically displaced as the water pressure inside said water chamber rises, jetting wash water from said opening in the peripheral direction of said shutter.

11. A technologically advanced portable toilet according to claim 1, wherein said waste storage tank is of a cassette-style that is attachable/detachable with respect to the container body, said container body providing a lid panel that is opened and closed during attachment/detachment of said waste storage tank, further providing connecting means which, when said lid panel is closed, interlocks with said closing operation to connect a lower end portion of said toilet bowl with the waste storage tank, and which, when said lid panel is open, interlocks with said opening operation to separate said lower end portion of the toilet bowl from the waste storage tank.

12. A technologically advanced portable toilet according to claim 1, wherein said toilet seat is formed of an elastic material, is formed as a ring-shaped seat that follows a circumferential direction without interruption at an upper end portion of the toilet bowl, and is made to closely contact a reverse surface of said toilet seat cover along the entire circumference of said toilet seat when the toilet seat cover is closed, due to an elastic restoring force.

13. A technologically advanced portable toilet according to claim 1 structured such that after the purifying agent formed as an aggregate of the bubbles is supplied, ozone gas by itself can be further supplied to the inside of the toilet bowl.

14. A technologically advanced portable toilet according to claim 1 structured such that the purifying agent can be supplied by opening the toilet seat by either rotating or removing the toilet seat cover, thereby operating said purifying agent producing/supplying means.

15. A method of supplying a purifying agent for use with a technologically advanced portable toilet including:

a step for providing a technologically advanced portable toilet comprising a toilet bowl in the form of a bowl, disposed inside a container body and having a lower end portion formed as an aperture, a toilet seat disposed at an upper end side of the toilet bowl inside the container body, a toilet seat cover provided at the container body, said toilet seat cover being either rotatable or attachable/detachable with respect to the container body and able to close or open the toilet seat by rotation or attachment/detachment, a waste storage tank disposed at a lower side of the toilet bowl inside the container body, said waste storage tank communicating with said toilet bowl, and purifying agent producing/supplying means provided at the container body, for producing a purifying agent formed as an aggregate of, bubbles having an odor extinguishing effect, wherein said bubbles are ozone-containing bubbles comprising an ozone-containing film wherein ozone is dissolved inside the film, and an ozone-containing gas enclosed inside this ozone-containing film, and supplying said purifying agent to at least one of an inside of said toilet bowl and an inside of said waste storage tank;

a step for producing a purifying agent with the purifying agent producing/supplying means; and a step wherein the purifying agent producing/supplying means supplies the purifying agent to at least one of the inside of the toilet bowl and the inside of the waste storage tank, by opening the toilet seat by either rotating or removing the toilet seat cover, thereby operating said purifying agent producing/supplying means.

16. A method of supplying a purifying agent for use with a technologically advanced portable toilet according to claim 15 wherein the step for providing the technologically advanced portable toilet includes a step for providing, as said purifying agent producing/supplying means, a tank assembly and compressed air supplying means.

17. A method of supplying a purifying agent for use with a technologically advanced portable toilet according to claim 16 wherein the step for producing the purifying agent includes:

a step for mixing fixed amounts in the tank assembly by utilizing free fall descent, which depends upon self-weight, of each of a plurality of types of liquids necessary for producing the bubbles, and a step for producing bubbling by supplying compressed air to this plurality of types of liquids mixed in fixed amounts, with said compressed air supplying means.

18. A method of supplying a purifying agent for use with a technologically advanced portable toilet according to claim 17 wherein the step for producing bubbling includes a step for mixing ozone gas into compressed air and supplying the result to the plurality of types of liquids mixed in fixed amounts.

19. A method of supplying a purifying agent for use with a technologically advanced portable toilet according to claim 15 wherein the step in which the purifying agent is supplied to at least one of the inside of the toilet bowl and the inside of the waste storage tank includes a step for supplying the purifying agent formed as the aggregate of ozone-containing bubbles and thereafter further supplying ozone gas by itself to the inside of the toilet bowl.

* * * * *